US011043741B2

(12) United States Patent
Tatomir

(10) Patent No.: US 11,043,741 B2
(45) Date of Patent: Jun. 22, 2021

(54) ANTENNA ARRAY SYSTEM FOR PRODUCING DUAL POLARIZATION SIGNALS

(71) Applicant: The Boeing Company, Chicago, IL (US)

(72) Inventor: Paul J. Tatomir, Palm Desert, CA (US)

(73) Assignee: THE BOEING COMPANY, Chicago, IL (US)

( * ) Notice: Subject to any disclaimer, the term of this patent is extended or adjusted under 35 U.S.C. 154(b) by 507 days.

(21) Appl. No.: 15/717,883

(22) Filed: Sep. 27, 2017

(65) Prior Publication Data

US 2018/0212324 A1 Jul. 26, 2018

Related U.S. Application Data

(63) Continuation-in-part of application No. 15/382,375, filed on Dec. 16, 2016, which is a continuation of (Continued)

(51) Int. Cl.

| | |
|---|---|
| ***H01Q 3/22*** | (2006.01) |
| ***H01Q 21/06*** | (2006.01) |
| ***H01Q 13/02*** | (2006.01) |
| ***H01Q 15/24*** | (2006.01) |
| ***H01Q 21/00*** | (2006.01) |
| ***H01Q 21/24*** | (2006.01) |
| ***H01Q 13/22*** | (2006.01) |

(Continued)

(52) U.S. Cl.

CPC ..... *H01Q 3/22* (2013.01); *H01Q 3/34* (2013.01); *H01Q 13/0233* (2013.01); *H01Q 13/0258* (2013.01); *H01Q 13/22* (2013.01); *H01Q 15/24* (2013.01); *H01Q 19/19* (2013.01); *H01Q 21/005* (2013.01); *H01Q 21/0043* (2013.01); *H01Q 21/064* (2013.01); *H01Q 21/24* (2013.01); *H01P 5/182* (2013.01)

(58) Field of Classification Search

CPC .. H01Q 3/22; H01Q 13/0233; H01Q 21/0043; H01Q 21/005; H01Q 21/064; H01Q 13/22; H01Q 21/24

See application file for complete search history.

(56) References Cited

U.S. PATENT DOCUMENTS

| | | |
|---|---|---|
| 2,848,691 A | 8/1958 | Harkless |
| 3,039,097 A | 6/1962 | Strumwasser et al. |

(Continued)

FOREIGN PATENT DOCUMENTS

| | | |
|---|---|---|
| CN | 101814657 A | 8/2010 |

OTHER PUBLICATIONS

European Search Report dated Jul. 3, 2015 issued in Application No. EP15152493, 4 pgs.

(Continued)

*Primary Examiner* — Cassi J Galt
(74) *Attorney, Agent, or Firm* — Moore IP Law

(57) ABSTRACT

An antenna array system ("AAS") for directing and steering an antenna beam is described in accordance with the present disclosure. The AAS may include a feed waveguide having a feed waveguide length, at least two directional couplers in signal communication with the feed waveguide, at least two pairs of planar coupling slots along the feed waveguide length, and at least two horn antennas.

22 Claims, 25 Drawing Sheets

Related U.S. Application Data application No. 14/180,873, filed on Feb. 14, 2014, now Pat. No. 9,537,212.

(51) Int. Cl.

| | |
|---|---|
| ***H01Q 3/34*** | (2006.01) |
| ***H01Q 19/19*** | (2006.01) |
| *H01P 5/18* | (2006.01) |

(56) References Cited

U.S. PATENT DOCUMENTS

| | | | | |
|---|---|---|---|---|
| 3,078,463 | A | 2/1963 | Lamy | |
| 3,238,473 | A * | 3/1966 | Salzberg | H01P 5/182 333/113 |
| 3,281,851 | A | 10/1966 | Goebels | |
| 3,473,162 | A | 10/1969 | Veith | |
| 4,348,680 | A | 9/1982 | Collier | |
| 4,742,355 | A | 5/1988 | Wolfson et al. | |
| 4,864,308 | A | 9/1989 | Raab et al. | |
| 4,868,574 | A | 9/1989 | Raab | |
| 5,410,318 | A | 4/1995 | Wong et al. | |
| 5,650,793 | A | 7/1997 | Park | |
| H2028 | H | 6/2002 | Koscica | |
| 6,542,130 | B2 * | 4/2003 | Falk | H01Q 21/0043 343/768 |
| 7,034,774 | B2 | 4/2006 | Kuo et al. | |
| 7,286,093 | B2 | 10/2007 | Artis et al. | |
| 7,289,077 | B2 | 10/2007 | Artis et al. | |
| 7,436,371 | B1 | 10/2008 | Paulsen | |
| 7,466,281 | B2 | 12/2008 | Haziza | |
| 7,576,703 | B1 | 8/2009 | Herting et al. | |
| 7,900,340 | B2 | 3/2011 | Artis et al. | |
| 7,994,969 | B2 | 8/2011 | Van Caekenberghe et al. | |
| 8,525,747 | B2 | 9/2013 | Focke et al. | |
| 9,252,477 | B1 | 2/2016 | Simons et al. | |
| 9,537,212 | B2 | 1/2017 | Rosen et al. | |
| 2007/0013598 | A1 | 1/2007 | Artis et al. | |
| 2007/0069967 | A1 | 3/2007 | Artis et al. | |
| 2015/0263429 | A1 | 9/2015 | Vahidpour et al. | |
| 2017/0294719 | A1 | 10/2017 | Tatomir | |
| 2018/0212324 | A1 | 7/2018 | Tatomir | |

OTHER PUBLICATIONS

Solbach, K.; ,"Below-resonant-length slot radiators for traveling-wave-array antennas," Antennas and Propagation Magazine, IEEE, vol. 38, No. 1, pp. 7-14, Feb. 1996.

Coetzee, J.C.; Ng, Y.T.; Joubert, J.; , "A meandering waveguide planar slot array," Microwave Conference, 1999 Asia Pacific , vol. 3, pp. 917-919, 1999.

CN Notification of the First Office Action, Application No. 201510076803X, dated Jul. 24, 2018.

Ehyaie, Daniel. "Novel Approaches to the Design of Phased Array Antennas." Thesis Dissertation University of Michigan, Horace H. Rackam School of Graduate Studies. 2011. pp. 1-153. (Year: 2011).

* cited by examiner

ANTENNA ARRAY SYSTEM FOR PRODUCING DUAL POLARIZATION SIGNALS

CROSS-REFERENCE TO RELATED APPLICATION AND CLAIM OF PRIORITY

The present patent application is a continuation-in-part ("CIP") of U.S. patent application Ser. No. 15/382,375, filed on Dec. 16, 2016, titled "Antenna Array System For Producing Dual Polarization Signals Utilizing A Meandering Waveguide," and claims priority under 35 U.S.C. § 120 to both U.S. patent application Ser. No. 15/382,375 and U.S. patent application Ser. No. 14/180,873, filed on Feb. 14, 2014, titled "Antenna Array System For Producing Dual Polarization Signals Utilizing A Meandering Waveguide," issued as U.S. Pat. No. 9,537,212 on Jan. 3, 2017, which applications are both hereby incorporated herein by this reference in their entirety.

BACKGROUND

1. Field

This present invention relates generally to microwave devices, and more particularly, to antenna arrays.

2. Related Art

In today's modern society, satellite communication systems have become common place. There are now numerous types of communication satellites in various orbits around the Earth transmitting and receiving huge amounts of information. Telecommunication satellites are utilized for microwave radio relay and mobile applications, such as, for example, communications to ships, vehicles, airplanes, personal mobile terminals, Internet data communication, television, and radio broadcasting. As a further example, with regard to Internet data communications, there is also a growing demand for in-flight Wi-Fi® Internet connectivity on transcontinental and domestic flights. Unfortunately, because of these applications, there is an ever increasing need for the utilization of more communication satellites and the increase of bandwidth capacity of each of these communication satellites.

A problem to solving this need is that individual communication satellite systems are very expensive to fabricate, place in Earth orbit, operate, and maintain. Another problem to solving this need is that there are limiting design factors to increasing the bandwidth capacity in a communication satellite. One of these limiting design factors is the relatively compact physical size and weight of a communication satellite. Communication satellite designs are limited by the size and weight parameters that are capable of being loaded into and delivered into orbit by a modern satellite delivery system (i.e., the rocket system). The size and weight limitations of a communication satellite limit the type of electrical, electronic, power generation, and mechanical subsystems that may be included in the communication satellite. As a result, the limit of these types of subsystems are also limiting factors to increasing the bandwidth capacity of a satellite communication.

It is appreciated by those of ordinary skill in the art, that in general, the limiting factors to increase the bandwidth capacity of a communication satellite is determined by the transponders, antenna system(s), and processing system(s) of the communication satellite.

With regard to the antenna system (or systems), most communication satellite antenna systems include some type of antenna array system. In the past reflector antennas (such as parabolic dishes) were utilized with varying numbers of feed array elements (such as feed horns). Unfortunately, these reflector antenna systems typically scanned their antenna beams utilizing mechanical means instead of electronic means. These mechanical means generally include relatively large, bulky, and heavy mechanisms (i.e., antenna gimbals).

More recently, there have been satellites that have been designed utilizing non-reflector phased array antenna systems. These phased array antenna systems are capable of increasing the bandwidth capacity of the antenna system as compared to previous reflector type of antenna systems. Additionally, these phased array antenna systems are generally capable of directing and steering antenna beams without mechanically moving the phase array antenna system. Generally, dynamic phased array antenna systems utilize variable phase shifters to move the antenna beam without physically moving the phased array antenna system. Fixed phased array antenna systems, on the other hand, utilize fixed phased shifters to produce an antenna beam that is stationary with respect to the face of the phased array antenna system. A such, fixed phased array antenna systems require the movement of the entire antenna system (with for example, an antenna gimbal) to directing and steering the antenna beam.

Unfortunately, while dynamic phased array antenna systems are more desirable then fixed phased array antenna systems they are also more complex and expensive since they require specialized active components (e.g., power amplifiers and active phase shifters) and control systems. As such, there is a need for a new type of phased array antenna system capable of electronically scanning an antenna beam that is robust, efficient, compact, and solves the previously described problems.

SUMMARY

An antenna array system ("AAS") for directing and steering an antenna beam is disclosed in accordance with the present disclosure. The AAS includes: a straight feed waveguide having a feed waveguide wall, a feed waveguide length, a first feed waveguide input at a first end of the straight feed waveguide, and a second feed waveguide input at a second end of the straight feed waveguide; a plurality of cross-couplers, and in signal communication with the straight feed waveguide; and a plurality of horn antennas in signal communication with the plurality of cross-couplers. The straight feed waveguide is configured to receive a first input signal at the first feed waveguide input and a second input signal at the second feed waveguide input. Each horn antenna is in signal communication with a corresponding cross-coupler and each horn antenna is configured to produce a first polarized signal from the received first input signal and a second polarized signal from the received second input signal. In this example, the first polarized signal is cross polarized with the second polarized signal.

In an example of operation, the AAS performs a method for directing and steering an antenna beam. The method includes receiving the first input signal at the first feed waveguide input and the second input signal at the second feed waveguide input, where the second input signal is propagating in the opposite direction of the first input signal along the straight feed waveguide. The AAS then couples the first input signal to a first cross-coupler, of the at least two cross-couplers (of the plurality of cross-couplers), where the first cross-coupler produces a first coupled output signal of the first cross-coupler, and couples the first input signal to a second cross-coupler, of the at least two cross-couplers, where the second cross-coupler produces a first coupled output signal of the second cross-coupler. The AAS also couples the second input signal to the second cross-coupler, where the second cross-coupler produces a second coupled output signal of the second cross-coupler, and couples the second input signal to the first cross-coupler, where the first cross-coupler produces a second coupled output signal of the first cross-coupler. The AAS then radiates a first polarized signal from a first horn antenna, of the at least two horn antennas (of the plurality of horn antennas), in response to the first horn antenna receiving the first coupled output signal of the first cross-coupler and radiates a second polarized signal from the first horn antenna, in response to the first horn antenna receiving the second coupled output signal of the first cross-coupler. The AAS also radiates a first polarized signal from a second horn antenna, of the at least two horn antennas, in response to the second horn antenna receiving the second coupled output signal of the second cross-coupler and radiates a second polarized signal from the second horn antenna, in response to the second horn antenna receiving the second coupled output signal of the second cross-coupler. As discussed earlier, the first polarized signal of the first horn antenna is cross polarized with the second polarized signal of the first horn antenna and the first polarized signal of the second horn antenna is cross polarized with the second polarized signal of the second horn antenna, and the first polarized signal of the first horn antenna is polarized in the same direction as the first polarized signal of the second horn antenna and second polarized signal of the first horn antenna is polarized in the same direction as the second polarized signal of the second horn antenna.

Other devices, apparatus, systems, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
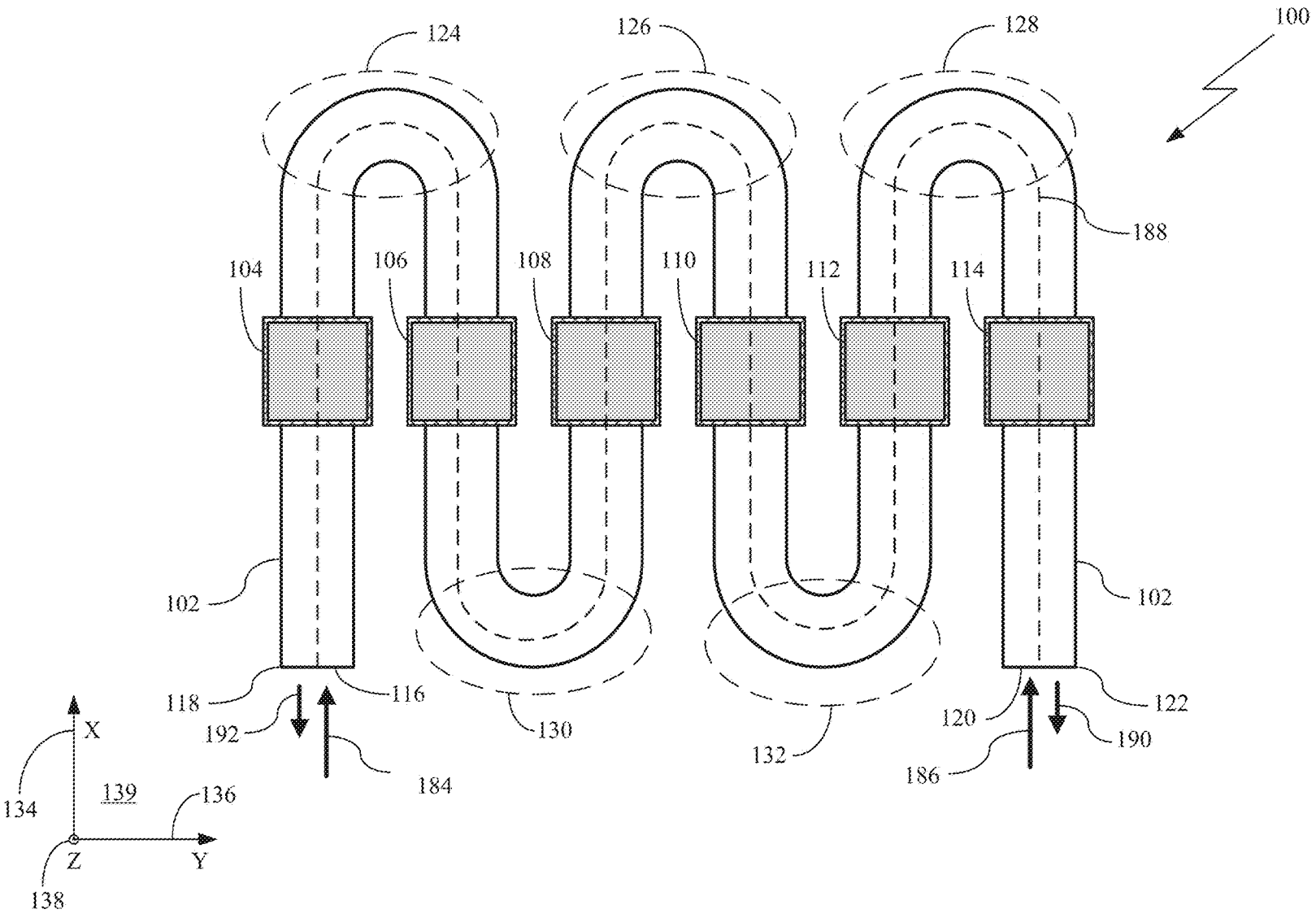
FIG. 1A is a top view of the example of the implementation of an antenna array system in accordance with the present disclosure.

An antenna array system for directing and steering an antenna beam is described in accordance with the present disclosure. In an example of an implementation, the AAS may include a feed waveguide having a feed waveguide length, at least two directional couplers in signal communication with the feed waveguide, at least two pairs of planar coupling slots along the feed waveguide length, and at least two horn antennas. The feed waveguide may have a feed waveguide wall, at least one turn along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least two directional couplers, has a bottom wall that is adjacent to the waveguide wall of the feed waveguide and each directional coupler is configured to produce a first coupled signal from the first input signal and a second coupled signal from the second input signal. A first pair of planar coupling slots, of the at least two pairs of planar coupling slots, corresponds to the a first directional coupler, of the at least two directional couplers, and a second pair of planar coupling slots, of the at least two pairs of planar coupling slots, corresponds to the a second directional coupler, of the at least two directional couplers. Additionally, the first pair of planar coupling slots are cut into the feed waveguide wall of the feed waveguide and the adjacent bottom wall of the first directional coupler and the second pair of planar coupling slots are cut into the feed waveguide wall of the feed waveguide and the adjacent bottom wall of the second directional coupler.

A first horn antenna, of the at least two horn antennas, is in signal communication with the first directional coupler and a second horn antenna, of the at least two horn antennas, is in signal communication with the second directional coupler. The first horn antenna is configured to receive both the first coupled signal and the second coupled signal from the first directional coupler and the second horn antenna is configured to receive both the first coupled signal and the second coupled signal from the second directional coupler. Additionally, the first horn antenna is configured to produce a first polarized signal from the received first coupled signal and a second circularly signal from the received second coupled signal and the second horn antenna is configured to produce a first polarized signal from the received first coupled signal and a second polarized signal from the received second coupled signal, where the first polarized signal of the first horn antenna is cross polarized with the second polarized signal of the first horn antenna and the first polarized signal of the second horn antenna is cross polarized with the second polarized signal of the second horn antenna. Furthermore, the first polarized signal of the first horn antenna is polarized in the same direction as the first polarized signal of the second horn antenna and second polarized signal of the first horn antenna is polarized in the same direction as the second polarized signal of the second horn antenna.

The polarizations of the first polarized signals and second polarized signals of the first horn antenna and second horn antenna, respectively, may be any desired polarization scheme including linear polarization, circular polarization, elliptical polarization, etc. As an example, the first polarized signal and the second polarized signal of the first horn antenna may be a first linearly polarized signal and second linearly polarized signal where the first linearly polarized signal and second linearly polarized signal are cross polarized (i.e., the polarizations are orthogonal) because one may be "vertical" polarized and the other may be "horizontal" polarized. Similarly, the first polarized signal and second polarized signal of the first horn antenna may be a first linearly polarized signal and the second linearly polarized signal where the first linearly polarized signal and second linearly polarized signal are cross polarized. Additionally, in this example, the first linearly polarized signal of the first horn antenna and the first linearly polarized signal of the second horn antenna may be polarized in the same direction (i.e., both may be vertical polarized or both may be horizontally polarized). Similarly, the second linearly polarized signal of the first horn antenna and the second linearly polarized signal of the second horn antenna may be polarized in the same direction.

In the case of circular polarization, the first polarized signal and the second polarized signal of the first horn antenna may be a first circularly polarized signal and the second circularly polarized signal of the first horn where the first circularly polarized signal and second circularly polarized signal are cross polarized because the first circularly polarized signal of the first horn antenna rotates in the opposite direction of the second circularly polarized signal of the first horn antenna (i.e., one may be right-hand circularly polarized and the other may be left-hand circularly polarized). Similarly, the first polarized signal and the second polarized signal of the second horn antenna may be a first circularly polarized signal and the second circularly polarized signal of the second horn antenna where the first circularly polarized signal and second circularly polarized signal are cross polarized because the first circularly polarized signal of the second horn antenna rotates in the opposite direction of the second circularly polarized signal of the second horn antenna.

Additionally, in this example, the first circularly polarized signal of the first horn antenna and the first circularly polarized signal of the second horn antenna may be polarized in the same direction (i.e., both may rotate in the same direction such that both may be right-hand circularly polarized ("RHCP") or both may be left-hand circularly polarized ("LHCP")). Similarly, the second circularly polarized signal of the first horn antenna and the second circularly polarized signal of the second horn antenna may be polarized in the same direction.

In an example of operation, the AAS performs a method that includes receiving a first input signal at the first feed waveguide input and a second input signal at the second feed waveguide input, wherein the second input signal is propagating in the opposite direction of the first input signal. Coupling the first input signal to a first directional coupler, of the at least two directional couplers, where the first directional coupler produces a first coupled output signal of the first directional coupler and coupling the first input signal to a second directional coupler, of the at least two directional couplers, where the second directional coupler produces a first coupled output signal of the second directional coupler. The method also includes coupling the second input signal to the second directional coupler, wherein the second directional coupler produces a second coupled output signal of the second directional coupler and coupling the second input signal to the first directional coupler, where the first directional coupler produces a second coupled output signal of the first directional coupler. The method further includes radiating a first circularly polarized signal from a first horn antenna, of the at least two horn antennas, in response to the first horn antenna receiving the first coupled output signal of the first directional coupler and radiating a second circularly polarized signal from the first horn antenna, in response to the first horn antenna receiving the second coupled output signal of the first directional coupler. The method moreover includes radiating a first circularly polarized signal from a second horn antenna, of the at least two horn antennas, in response to the second horn antenna receiving the second coupled output signal of the second directional coupler and radiating a second circularly polarized signal from the second horn antenna, in response to the second horn antenna receiving the second coupled output signal of the second directional coupler.

In another example of an implementation, the AAS may include a feed waveguide having a feed waveguide length, at least four directional couplers in signal communication with the feed waveguide, at least four pairs of planar coupling slots along the feed waveguide length, and at least two horn antennas. The feed waveguide may have a feed waveguide wall, at least five turns along the feed waveguide length, a first feed waveguide input at a first end of the feed waveguide, and a second feed waveguide input at a second end of the feed waveguide. The feed waveguide is configured to receive a first input signal at the first feed waveguide input and a second input signal at the second feed waveguide input.

Each directional coupler, of the at least four directional couplers, has a bottom wall that is adjacent to the waveguide wall of the feed waveguide and each directional coupler is configured to produce a coupled signal from either the first input signal or the second input signal. A first pair of planar coupling slots, of the at least four pairs of planar coupling slots, corresponds to the a first directional coupler, of the at least four directional couplers; a second pair of planar coupling slots, of the at least four pairs of planar coupling slots, corresponds to the a second directional coupler, of the at least four directional couplers; a third pair of planar coupling slots, of the at least four pairs of planar coupling slots, corresponds to the a third directional coupler, of the at least four directional couplers; and a fourth pair of planar coupling slots, of the at least four pairs of planar coupling slots, corresponds to the a fourth directional coupler, of the at least four directional couplers. The first pair of planar coupling slots are cut into the feed waveguide wall of the feed waveguide and the adjacent bottom wall of the first directional coupler; the second pair of planar coupling slots are cut into the feed waveguide wall of the feed waveguide and the adjacent bottom wall of the second directional coupler; the third pair of planar coupling slots are cut into the feed waveguide wall of the feed waveguide and the adjacent bottom wall of the third directional coupler; and the fourth pair of planar coupling slots are cut into the feed waveguide wall of the feed waveguide and the adjacent bottom wall of the fourth directional coupler.

A first horn antenna, of the at least two horn antennas, is in signal communication with the first directional coupler and the second directional coupler and a second horn antenna, of the at least two horn antennas, is in signal communication with the third directional coupler and the fourth directional coupler. The first horn antenna is configured to receive the coupled signal from the first directional coupler and the coupled signal from the second directional coupler and the second horn antenna is configured to receive the coupled signal from the third directional coupler and the coupled signal from the fourth directional coupler. Additionally, the first horn antenna is configured to produce a first polarized signal from the received coupled signal from the first directional coupler and a second polarized signal from the received coupled signal from the second directional coupler and the second horn antenna is configured to produce a first polarized signal from the received coupled signal from the third directional coupler and a second polarized signal from the received coupled signal from the fourth directional coupler. The first polarized signal of the first horn antenna is cross polarized with the opposite direction of the second polarized signal of the first horn antenna and the first polarized signal of the second horn antenna is cross polarized with the opposite direction of the second polarized signal of the second horn antenna. Moreover, the first polarized signal of the first horn antenna is polarized in the same direction as the first polarized signal of the second horn antenna and the second polarized signal of the first horn antenna is polarized in the same direction as the second polarized signal of the second horn antenna.

Turning to FIGS. 1A, 1B, 1C, and 1D, various views of an example of an implementation of an AAS 100 are shown in accordance with the present disclosure. In FIG. 1A, a top view of the implementation of an AAS 100 is shown. The AAS 100 may include a feed waveguide 102, plurality of directional couplers (not shown), a plurality of horn antennas including, for example, first horn antenna ("1$^{st}$ HA") 104, second horn antenna ("2$^{nd}$ HA") 106, third horn antenna ("3$^{rd}$ HA") 108, fourth horn antenna ("4$^{th}$ HA") 110, fifth horn antenna ("5$^{th}$ HA") 112, and sixth horn antenna ("6$^{th}$ HA") 114, and a plurality of power amplifiers (not shown). The feed waveguide 102 includes a first feed waveguide input ("1$^{st}$ FWI") 116 at a first end 118 of the feed waveguide 102 and a second feed waveguide input ("2$^{nd}$ FWI") 120 at a second end 122 of the feed waveguide 102, where the second end 122 is at the opposite end of the feed waveguide 102 with respect to the first end 118. The feed waveguide 102 may be a serpentine or meandering waveguide that includes a plurality of turns (i.e., bends) including, for example, first bend ("1$^{st}$ bend") 124, second bend ("2$^{nd}$ bend") 126, third bend ("3$^{rd}$ bend") 128, fourth bend ("4$^{th}$ bend") 130, and fifth bend ("5$^{th}$ bend") 132. In this example, the physical layout of the feed waveguide 102 may be described by three-dimensional Cartesian coordinates with coordinate axes X 134, Y 136, and Z 138, where the feed waveguide 102 is located in an XY-plane 139 defined by the X 134 and Y 136 coordinate axes. Additionally, the 1$^{st}$ HA 104, 2$^{nd}$ HA 106, 3$^{rd}$ HA 108, 4$^{th}$ HA 110, 5$^{th}$ 112, and 6$^{th}$ 114 are shown extending perpendicular from the X-Y plane 139 along the Z 138 coordinate axis.

It is appreciated by those of ordinary skill in the art, that while only six horn antennas (e.g., 1$^{st}$ HA 104, 2$^{nd}$ HA 106, 3$^{rd}$ HA 108, 4$^{th}$ HA 110, 5$^{th}$ 112, and 6$^{th}$ 114) and five turns (e.g., 1$^{st}$ bend 124, 2$^{nd}$ bend 126, 3$^{rd}$ bend 128, 4$^{th}$ bend 130, and 5$^{th}$ bend 132) in the feed waveguide 102 are shown, this is for illustration purposes only and the AAS 100 may include any even number of directional couplers (not shown), horn antennas, and power amplifiers (not shown) with a corresponding number of turns needed to feed the directional couplers. As another example, the AAS 100 may include 60 directional couplers and horn antennas, and 59 turns in the feed waveguide. It is appreciated that the number of horn antennas determines the numbers directional couplers, and turns in the feed waveguide 102. Each horn antenna of the plurality of horn antennas (e.g., 1$^{st}$ HA 104, 2$^{nd}$ HA 106, 3$^{rd}$ HA 108, 4$^{th}$ HA 110, 5$^{th}$ 112, and 6$^{th}$ 114) acts as an individual radiating element of the AAS 100. In operation, each horn antenna's individual radiation pattern typically varies in amplitude and phase from each other horn antenna's radiation pattern. The amplitude of the radiation pattern for each horn antenna is controlled by a power amplifier (not shown) that controls the amplitude of the excitation current of the horn antenna. Similarly, the phase of the radiation pattern of each horn antenna is determined by the corresponding delayed phase caused by the feed waveguide 102 in feeding the directional coupler that corresponds to the horn antenna. An optional plurality of phase-shifters may be also included to help control and/or correct the delayed phase.

Figure 1B:
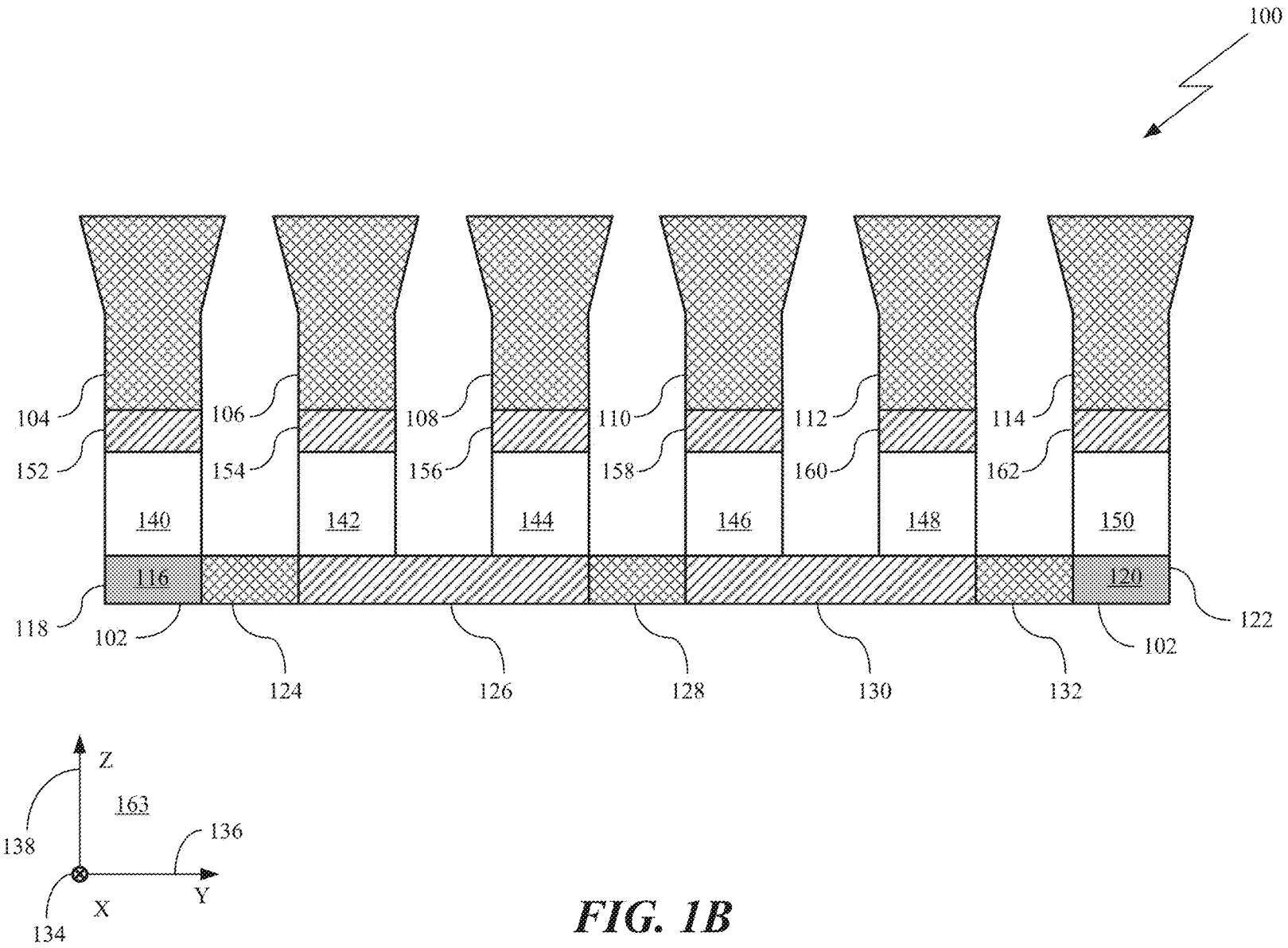
FIG. 1B is a front view of the example of the implementation of the AAS shown in FIG. 1A.

In FIG. 1B, a front view of the example of the implementation of the AAS 100 is shown. In this front view, a plurality of directional couplers (for example, first directional coupler ("1$^{st}$ DC") 140, second directional coupler ("2$^{nd}$ DC") 142, third directional coupler ("3$^{rd}$ DC") 144, fourth directional coupler ("4$^{th}$ DC") 146, fifth directional coupler ("5$^{th}$ DC") 148, and sixth directional coupler ("6$^{th}$ DC") 150 are shown in signal communication with the both the feed waveguide 102 and a plurality of power amplifiers, for example, first power amplifier ("1$^{st}$ PA") 152, second power amplifier PA") 154, third power amplifier PA") 156, fourth power ("2$^{nd}$ (" 3$^{rd}$ amplifier ("4$^{th}$ PA") 158, fifth power amplifier ("5$^{th}$ PA") 160, and sixth power amplifier ("6$^{th}$ PA") 162. The plurality of power amplifiers (e.g., 1$^{st}$ PA 152, 2$^{nd}$ PA 154, 3$^{rd}$ PA 156, 4$^{th}$ PA 158, 5$^{th}$ PA 160, and 6$^{th}$ PA 162) are shown in signal communication with the plurality of horn antennas (e.g., 1$^{st}$ HA 104, 2$^{nd}$ HA 106, 3$^{rd}$ HA 108, 4$^{th}$ HA 110, 5$^{th}$ 112, and 6$^{th}$ 114), respectively. In this example, the feed waveguide 102 and 1$^{st}$ DC 140, 2$^{nd}$ DC 142, 3$^{rd}$ DC 144, 4$^{th}$ DC 146, 5$^{th}$ DC 148, and 6$^{th}$ DC 150 are shown to be rectangular waveguides. For reference, the physical layout of the AAS 100 in this front view is shown within a YZ-plane 163 defined by the Y 136 and Z 138 coordinate axes with the X 134 coordinate axis directed in a direction that is both perpendicular and into the YZ-plane 163.

Figure 1C:
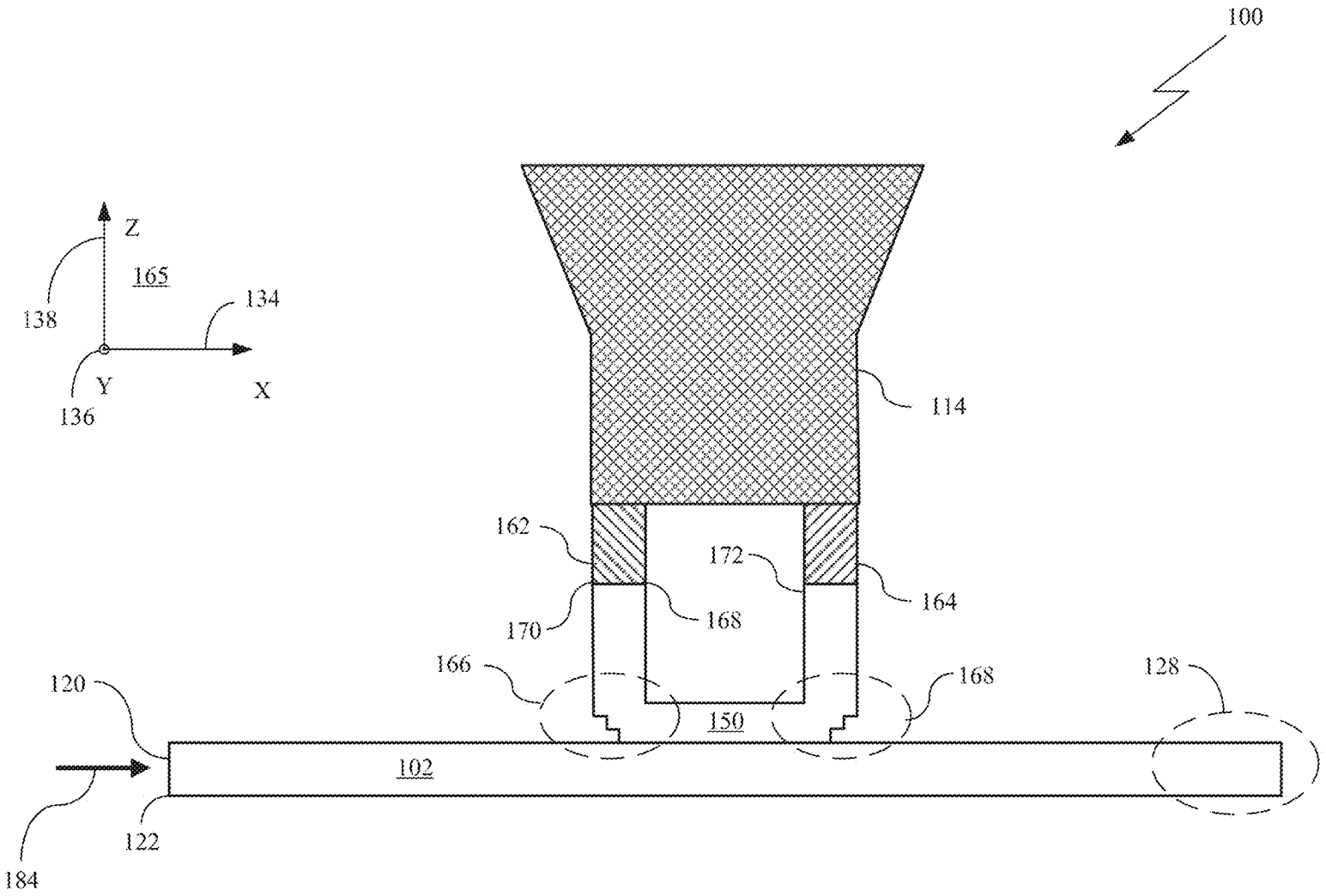
FIG. 1C is a side view of the example of the implementation of the AAS shown if FIGS. 1A and 1B.

In FIG. 1C, a side view of the example of the implementation of the AAS 100 is shown. For reference, the physical layout of the AAS 100 in this side view is shown within a XZ-plane 165 defined by the X 134 and Z 138 coordinate axes with the Y 136 coordinate axis directed in a direction that is both perpendicular and out of the XZ-plane 165. In this side view, another power amplifier (i.e., a seventh power amplifier ("7$^{th}$ PA") 164) is shown in signal communication with the 6$^{th}$ HA 114 and the 6$^{th}$ DC 150. In this example, the 6$^{th}$ DC 150 is shown to be a "U" shaped waveguide structure that is located adjacent the feed waveguide 102 having two bends. The first bend 166 is located close to the 6$^{th}$ PA 162 and the second bend 168 is located in the opposite direction along the 6$^{th}$ DC 150 close to the 7$^{th}$ PA 164. Specifically, the 6$^{th}$ DC 150 is in signal communication with the both the 6$^{th}$ PA 162 and the 7$^{th}$ PA 164 at a first end 170 and second end 172 of the 6$^{th}$ DC 150, respectively.

The bent waveguide structure of the 6$^{th}$ DC 150 is known as an "E-bend" because it distorts the electric field, unlike the turns/bends (i.e., 1$^{st}$ bend 124, 2$^{nd}$ bend 126, 3$^{rd}$ bend 128, 4$^{th}$ bend 130, and 5$^{th}$ bend 132) in the feed waveguide 102 that are known as "H-bends" because they distort the magnetic field. Generally, an E-bend waveguide may be constructed utilizing a gradual bend or by utilizing a number of step transitions (as shown in FIG. 1C) that are designed to minimize reflections in the waveguide. Similarly, an H-bend waveguide may also be constructed utilizing a gradual bend (as shown in FIG. 1A) or by utilizing a number of step transitions (shown in FIGS. 9A, 9B, and 10) that are designed to minimize reflections in the waveguide. The design of these types of H-bend and E-bend waveguides are well known in the art.

The reason for utilizing a bent waveguide structure for the 6$^{th}$ DC 150 is to allow the 6$^{th}$ HA to radiate in a normal (i.e., perpendicular) direction away from the XY-plane 139 that defines the physical layout structure of the feed waveguide 102. It is appreciated by those of ordinary skill in the art that the 6$^{th}$DC 150 may also be non-bent if the 6$^{th}$DC 150 is designed to radiate in a direction parallel to the XY-plane 139.

It is appreciated by those of ordinary skill in the art that while only one combination of 6$^{th}$ DC 150, 6$^{th}$ HA, 6$^{th}$ PA 162, 7$^{th}$ PA 164, and 3$^{rd}$ bend 128 of the feed waveguide 102 is shown, this combination is also representative of the other directional couplers (i.e., 1$^{st}$ DC 140, 2$^{nd}$ DC 142, 3$^{rd}$ DC 144, 4$^{th}$ DC 146, 5$^{th}$ DC 148, and 6$^{th}$ DC 150), plurality of power amplifiers (i.e., 1$^{st}$ PA 152, 2$^{nd}$ PA 154, 3$^{rd}$ PA 156, 4$^{th}$ PA 158, 5$^{th}$ PA 160, 6$^{th}$ PA 162, and 7$^{th}$ PA 164), horn antennas (i.e., 1$^{st}$ HA 104, 2$^{nd}$ HA 106, 3$^{rd}$ HA 108, 4$^{th}$ HA 110, 5$^{th}$ HA 112, and 6$^{th}$ HA 114), and the turns (i.e., 1$^{st}$ bend 124, and 2$^{nd}$ bend 126) of the feed waveguide 102. It is noted that the 4$^{th}$ bend 130, and 5$^{th}$ bend 132 of the feed waveguide 102 are not visible in this side view because they are blocked by the second end 122 of the feed waveguide 102.

Figure 1D:
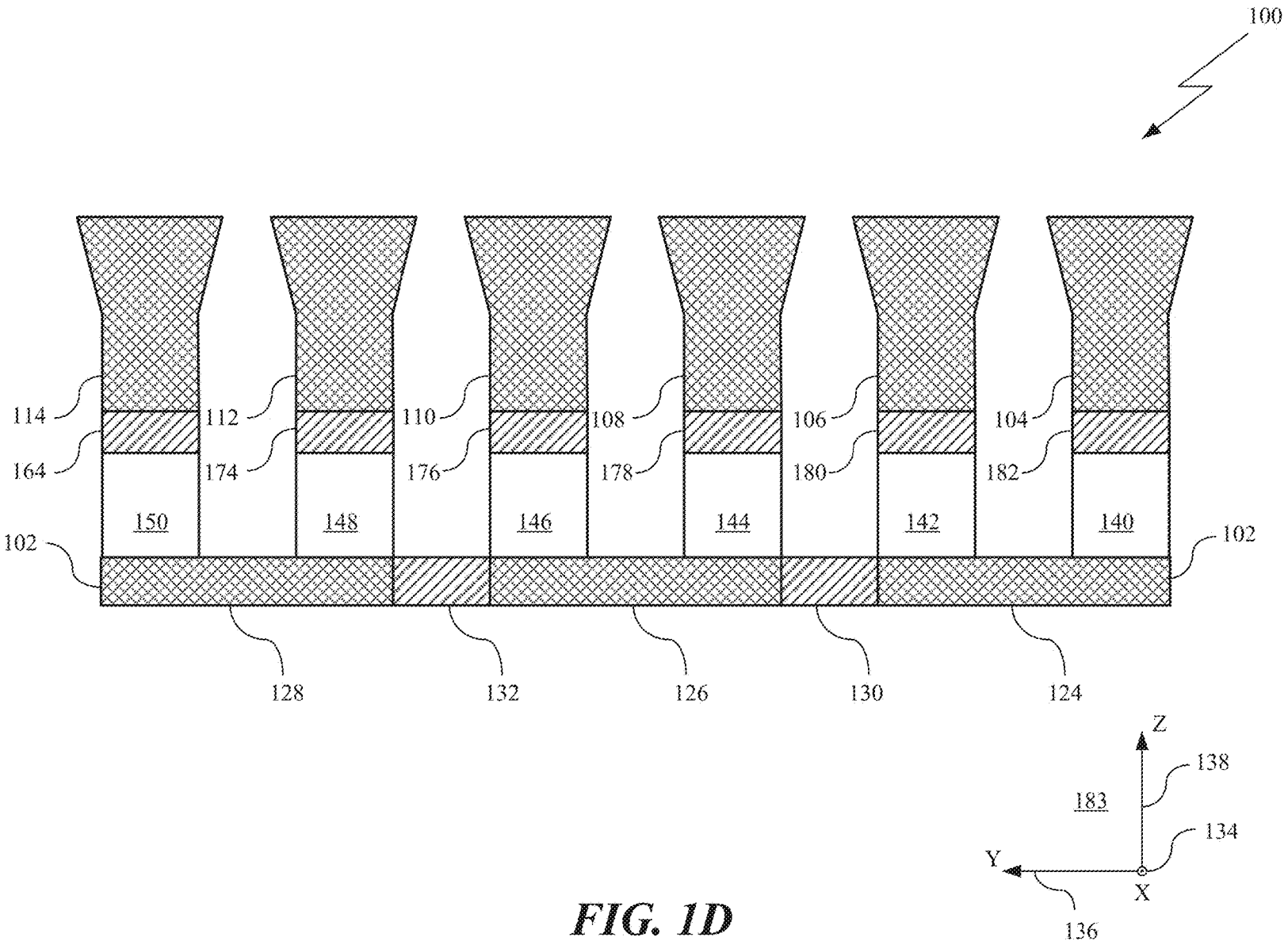
FIG. 1D is a back view of the example of the implementation of the AAS shown in FIGS. 1A, 1B, and 1C.

Turning to FIG. 1D, a back view of the example of the implementation of the AAS 100 is shown. In this back view, the plurality of directional couplers (i.e., 1$^{st}$ DC 140, 2$^{nd}$ DC 142, 3$^{rd}$ DC 144, 4$^{th}$ DC 146, 5$^{th}$ DC 148, and 6$^{th}$ DC 150) are shown in signal communication with the both the feed waveguide 102 and an additional plurality of power amplifiers (e.g., a seventh power amplifier ("7$^{th}$ PA") 164, an eighth power amplifier ("8$^{th}$ PA") 174, a ninth power amplifier ("9$^{th}$ PA") 176, a tenth power amplifier ("10$^{th}$ PA") 178, an eleventh power amplifier ("11$^{th}$ PA") 180, and a twelfth power amplifier ("12$^{th}$ PA") 182). The plurality of power amplifiers (i.e., 7$^{th}$ PA 164, 8$^{th}$ PA 174, 9$^{th}$ PA 176, 10$^{th}$ PA 178, 11$^{th}$ PA 180, and 12$^{th}$ PA 182) are shown in signal communication with the plurality of horn antennas (i.e., 6$^{th}$ HA 114, 5$^{th}$ HA 112, 4$^{th}$ HA 110, 3$^{rd}$ HA 108, 2$^{nd}$ HA 106, and 1$^{st}$ HA 104), respectively. For reference, the physical layout of the AAS 100 in this back view is shown within an YZ-plane 183 defined by the Y 136 and Z 138 coordinate axes with the X 134 coordinate axis directed in a direction that is both perpendicular and extending out of the YZ-plane 183.

In this example, both the feed waveguide 102 and the 1$^{st}$ DC 140, 2$^{nd}$ DC 142, 3$^{rd}$ DC 144, 4$^{th}$ DC 146, 5$^{th}$ DC 148, and 6$^{th}$ DC 150 are shown to be rectangular waveguides having broad-walls (as seen in FIG. 1A for the feed waveguide 102 and in FIGS. 1B and 1D for the 1$^{st}$ DC 140, 2$^{nd}$ DC 142, 3$^{rd}$ DC 144, 4$^{th}$ DC 146, 5$^{th}$ DC 148, and 6$^{th}$ DC 150) and narrow-walls (as seen in FIGS. 1B and 1D for the feed waveguide 102 and in FIG. 1C for the directional couplers 140, 142, 144, 146, 148, and 150). In operation, each directional coupler (e.g., 1$^{st}$ DC 140, 2$^{nd}$ DC 142, 3$^{rd}$ DC 144, 4$^{th}$ DC 146, 5$^{th}$ DC 148, and 6$^{th}$ DC 150) utilizes a pair of planar coupling slots (not shown) located and cut into the broad-wall of the directional coupler (e.g., 1$^{st}$ DC 140, 2$^{nd}$ DC 142, 3$^{rd}$ DC 144, 4$^{th}$ DC 146, 5$^{th}$ DC 148, and 6$^{th}$ DC 150) and the corresponding portion of the broad-wall of the feed waveguide 102 that is adjacent to the broad-wall of the respective directional coupler (i.e., 1$^{st}$ DC 140, 2$^{nd}$ DC 142, 3$^{rd}$ DC 144, 4$^{th}$ DC 146, 5$^{th}$ DC 148, and 6$^{th}$ DC 150).

In an example of operation, the feed waveguide 102 acts as a traveling wave meandering-line array feeding the plurality of directional couplers (i.e., 1$^{st}$ DC 140, 2$^{nd}$ DC 142, 3$^{rd}$ DC 144, 4$^{th}$ DC 146, 5$^{th}$ DC 148, and 6$^{th}$ DC 150). The AAS 100 receives a first input signal 184 and a second input signal 186. Both the first input signal 184 and second input signal 186 may be $TE_{10}$, or $TE_{01}$, mode propagated signals. The first input signal 184 is input into the first feed waveguide input 116 at the first end 118 of the feed waveguide 102 and the second input signal 186 is input into the second feed waveguide input 120 at the second end 122 of the feed waveguide 102. In this example, both the first input signal 184 and the second input signal 186 propagate along the direction of the X 134 coordinate axis into the opposite ends of the feed waveguide 102.

Once in the feed waveguide 102, the first input signal 184 and the second input signal 186 propagate along the feed waveguide 102 in opposite directions coupling parts of their respective energies into the different directional couplers (i.e., $1^{st}$ DC 140, $2^{nd}$ DC 142, $3^{rd}$ DC 144, $4^{th}$ DC 146, $5^{th}$ DC 148, and $6^{th}$ DC 150). Since the first input signal 184 and the second input signal 186 are traveling wave signals that are travelling in opposite directions along a length (i.e., waveguide length 188) of the feed waveguide 102, they will have a phase delay of about 180 degrees relative to each other at any given point within the feed waveguide 102. In general, the waveguide length 188 of the feed waveguide 102 is several wavelengths long, of the operating wavelength of the first input signal 184 and second input signal 186, so as to be long enough to create a length (not shown) between the pairs of planar coupling slots (not shown) that is also multiple wavelengths of the operating wavelengths of the first input signal 184 and second input signal 186. The reason for this length between pairs of planar coupling slots (not shown) is to create a phase increment needed for beam steering an antenna beam (not shown) of the AAS 100 as a function of frequency. As an example, the length between the pairs of planar coupling slots may be between five (5) to seven (7) wavelengths long.

In this example, as the first input signal 184 travels from the first end 118 to the second end 122 along the feed waveguide 102, the first input signal 184 successively couples a portion of its energy to each direction coupler (i.e., $1^{st}$ DC 140, $2^{nd}$ DC 142, $3^{rd}$ DC 144, $4^{th}$ DC 146, $5^{th}$ DC 148, and $6^{th}$ DC 150) until the a first remaining signal ("$1^{st}$ RS") 190 of the remaining energy (if any) is outputted from the second end 122 of the feed waveguide 102. Similarly, as the second input signal 186 travels in the opposite direction from the second end 122 to the first end 118 of the feed waveguide 102, the second input signal 186 successively couples a portion of its energy to each direction coupler (i.e., $6^{th}$ DC 150, $5^{th}$ DC 148, $4^{th}$ DC 146, $3^{rd}$ DC 144, $2^{nd}$ DC 142, and $1^{st}$ DC 140) until a second remaining signal 192 of the remaining energy (if any) of the second input signal 186 is outputted from the first end 118 of the feed waveguide 102. It is appreciated that by optimizing the design of the $1^{st}$ DC 140, $2^{nd}$ DC 142, $3^{rd}$ DC 144, $4^{th}$ DC 146, $5^{th}$ DC 148, and $6^{th}$ DC 150, both the first remaining signal 190 and second remaining signal 192 may be reduced to close to zero.

In this example, when the first input signal 184 travels along the feed waveguide 102, it will couple a first portion of it energy to the $1^{st}$ DC 140, which will pass this first coupled output signal to the $1^{st}$ HA. The remaining portion of the first input signal 184 will then travel along the feed waveguide 102 to the $2^{nd}$ DC 142 where it will couple another portion of its energy to the $2^{nd}$ DC 142, which will pass this second coupled output signal to the $2^{nd}$ HA. This process will continue such that another portion of the first input signal 184 will be coupled to the $3^{rd}$ DC 144, $4^{th}$ DC 146, $5^{th}$ DC 148, and $6^{th}$ DC 150 and passed to the $3^{rd}$ HA 108, $4^{th}$ HA 110, $5^{th}$ HA 112, and $6^{th}$ HA 114, respectively. The remaining portion of the first input signal 184 will then be output from the second end 122 of the feed waveguide 102 as the first remaining signal 190. Similarly, when the second input signal 186 travels along the feed waveguide 102, it will couple a first portion of it energy to the $6^{th}$ DC, which will pass this first coupled output signal to the $6^{th}$ HA. The remaining portion of the second input signal 186 will then travel along the feed waveguide 102 to the $5^{th}$ DC where it will couple another portion of it energy to the $5^{th}$ DC, which will pass this second coupled output signal to the $5^{th}$ HA. This process will continue such that another portion of the second input signal 186 will be coupled to the $4^{th}$ DC 146, $3^{rd}$ DC 144, $2^{nd}$ DC 142, and $1^{st}$ DC 140 and passed to the $4^{th}$ HA 110, $3^{rd}$ HA 108, $2^{nd}$ HA 106, and $1^{st}$ HA 104, respectively. The remaining portion of the second input signal 186 will then be output from the first end 118 of the feed waveguide 102 as the second remaining signal 192.

As a result, the first input signal 184 and second input signal 186 will cause the excitation of the $1^{st}$ HA 104, $2^{nd}$ HA 106, $3^{rd}$ HA 108, $4^{th}$ HA 110, $5^{th}$ HA 112, and $6^{th}$ HA 114. The $1^{st}$ HA 104, $2^{nd}$ HA 106, $3^{rd}$ HA 108, $4^{th}$ HA 110, $5^{th}$ HA 112, and $6^{th}$ HA 114 may be configured to produce RHCP and LHCP signals when excited by the coupled portions of the first input signal 184 and second input signal 186, respectively. Alternatively, the $1^{st}$ HA 104, $2^{nd}$ HA 106, $3^{rd}$ HA 108, $4^{th}$ HA 110, $5^{th}$ HA 112, and $6^{th}$ HA 114 may be configured to produce horizontal polarization and vertical polarization signals when excited by the coupled portions of the first input signal 184 and second input signal 186, respectively.

It is appreciated that a first circulator, or other isolation device, (not shown) may be connected to the first end 118 to isolate the first input signal 184 from the outputted second remaining signal 192 and a second circulator, or other isolation device, (not shown) may be connected to the second end 122 to isolate the second input signal 186 from the outputted first remaining signal 190. It is appreciated by those skilled in the art that the amount of coupled energy from the feed waveguide 102 to the respective $1^{st}$ DC 140, $2^{nd}$ DC 142, $3^{rd}$ DC 144, $4^{th}$ DC 146, $5^{th}$ DC 148, and $6^{th}$ DC 150 is determined by predetermined design choices that will yield the desired radiation antenna pattern of the AAS 100.

It is appreciated by those skilled in the art that the circuits, components, modules, and/or devices of, or associated with, the AAS 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

Figure 2:
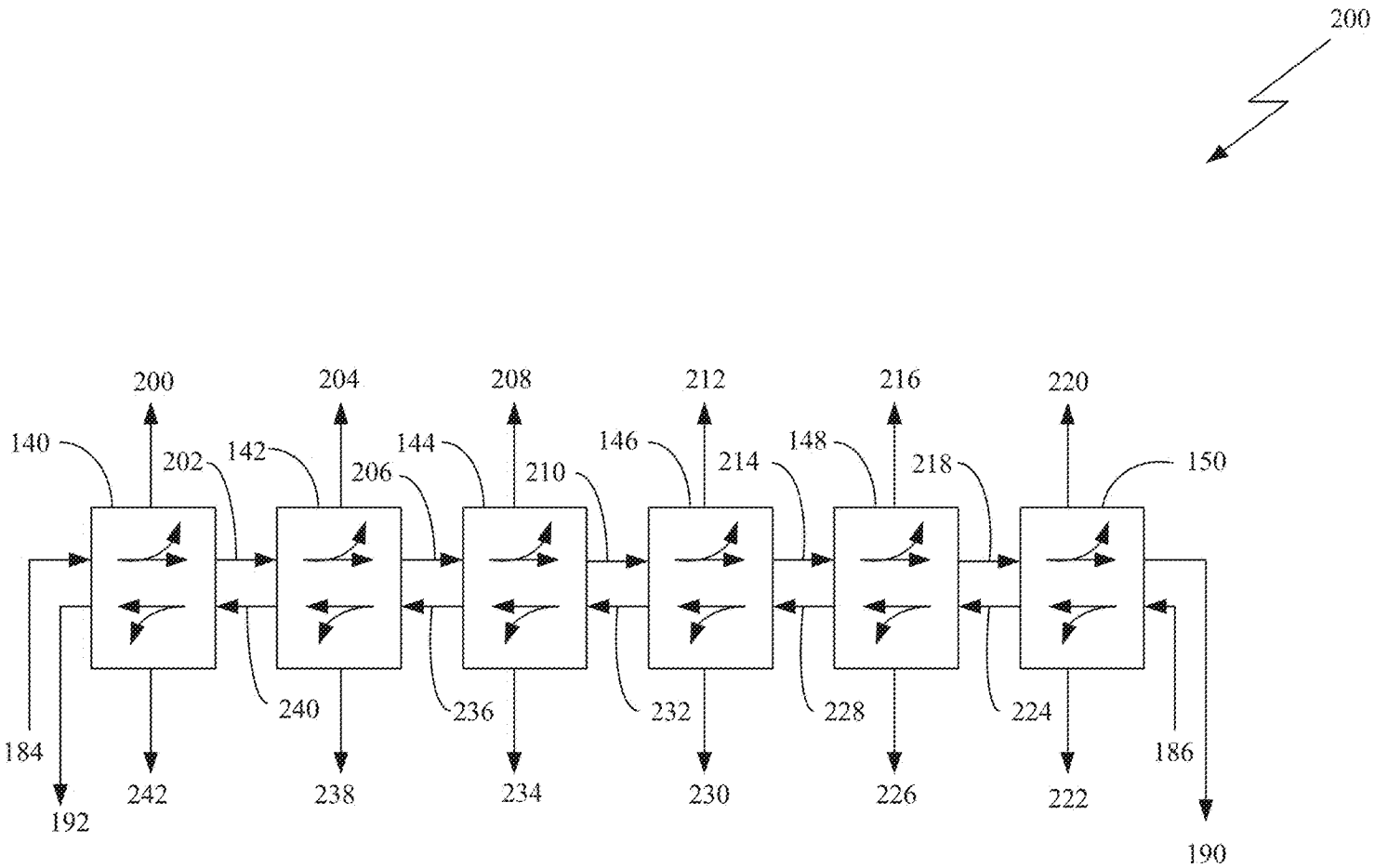
FIG. 2 is a block diagram of an example of operation of the directional couplers and the feed waveguide shown in FIGS. 1A, 1B, 1C, and 1D.

FIG. 2 is a block diagram of the example of operation of the directional couplers and the feed waveguide shown in FIGS. 1A, 1B, 1C, and 1D. As described earlier, a first input signal 184 is in injected into the feed waveguide 102. The feed waveguide 102 then passes the first input signal 184 to the 1st DC 140, which produces a first forward coupled ("1st FC") signal 200 and passes it to the 1st HA 104. A first remaining first input ("1st RFI") signal 202 is then passed to the 2nd DC 142, which produces a second forward coupled ("2nd FC") signal 204 and passes it to the 2nd HA 106. A second remaining first input ("2nd RFI") signal 206 is then passed to the 3rd DC 144, which produces a third forward coupled ("3rd FC") signal 208 and passes it to the 3rd HA 108. A third remaining first input ("3rd RFI") signal 210 is then passed to the 4th DC 146, which produces a fourth forward coupled ("4th FC") signal 212 and passes it to the 4th HA 110. A fourth remaining first input ("4th RFI") signal 214 is then passed to the 5th DC 148, which produces a fifth forward coupled ("5th FC") signal 216 and passes it to the 5th HA 112. Finally, a fifth remaining first input ("5th FC") signal 218 is then passed to the 6th DC 150, which produces a sixth forward coupled ("6th FC") signal 220 and passes it to the 6th HA 114. The sixth remaining first input signal is the first remaining signal 190 that is then outputted from the feed waveguide 102. Similarly, the second input signal 186 is injected into the feed waveguide 102. The feed waveguide 102 then passes the second input signal 186 to the 6th DC 150, which produces a first reverse coupled signal ("1st RC") 222 and passes it to the 6th HA 114. A first remaining second input signal ("1st RSI") 224 is then passed to the 5th DC 148, which produces a second reverse coupled ("2nd RC") signal 226 and passes it to the 5th HA 112. A second remaining second input ("2nd RSI") signal 228 is then passed to the 4th DC 146, which produces the third reverse coupled ("3rd RC") signal 230 and passes it to the 4th HA 110. A third remaining second input ("3rd RSI") signal 232 is then passed to the 3rd DC 144, which produces the fourth reverse coupled ("4th RC") signal 234 and passes it to the 3rd HA 108. A fourth remaining second input ("4th RSI") signal 236 is then passed to the 2nd DC 142, which produces fifth reverse coupled ("5th RC") signal 238 and passes it to the 2nd HA 106. Finally, the fifth remaining second input ("5th RSI") signal 240 is then passed to the 1st DC 140, which produces sixth reverse coupled ("6th RC") signal 242 and passes it to the 1st HA 104. The sixth remaining second input signal is the second remaining signal 192 that is then outputted from the feed waveguide 102.

Figure 3:
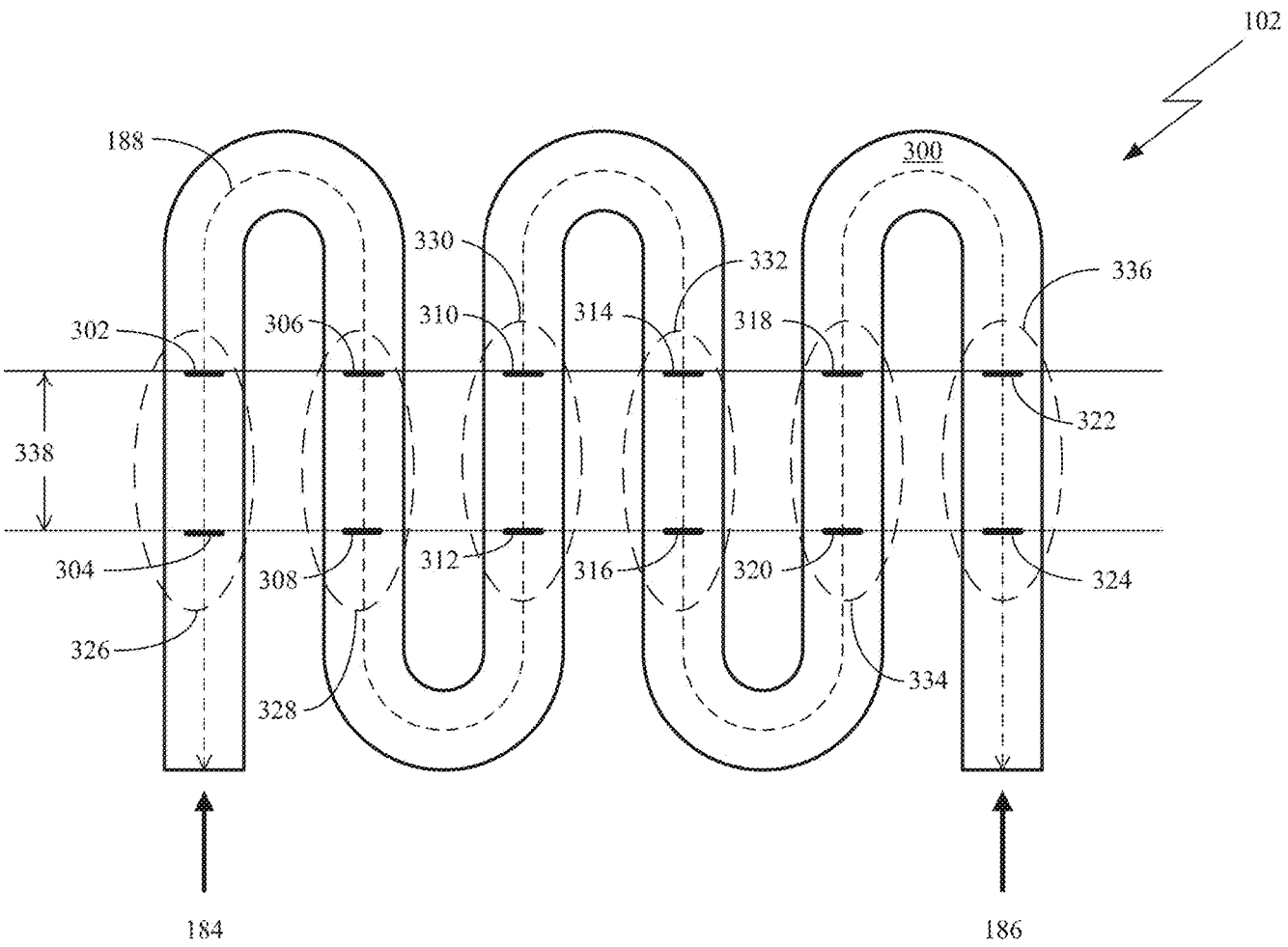
FIG. 3 is a top view of an example of an implementation of the feed waveguide (shown in FIGS. 1A, 1B, 1C, and 1D) in accordance with the present disclosure.

Turning to FIG. 3, a top view of an example of an implementation of the feed waveguide 102 is shown in accordance with the present disclosure. The feed waveguide 102 includes a broad-wall 300 and a plurality of planar coupling slots 302, 304, 306, 308, 310, 312, 314, 316, 318, 320, 322, and 324 that are organized into pairs of planar coupling slots 326, 328, 330, 332, 334, and 336, respectively. In this example, the planar coupling slots 302, 304, 306, 308, 310, 312, 314, 316, 318, 320, 322, and 324 are cut into the broad-wall 300 of the feed waveguide 102 and each pair of planar coupling slots 326, 328, 330, 332, 334, and 336 have a pair of planar coupling slots (i.e., 326, 328, 330, 332, 334, and 336) that are spaced 338 approximately a quarter-wavelength apart. In this example, the planar coupling slots are radiating slots that radiate energy out from the feed waveguide 102. It is appreciated that the feed waveguide 102 is constructed of a conductive material such as metal and defines a rectangular tube that that has an internal cavity running the waveguide length 188 of the feed waveguide 102 that may be filled with air, dielectric material, or both.

In an example of operation, when the first input signal 184 and second input signals 186 are injected (i.e., inputted) into the feed waveguide 102 they excite both magnetic and electric fields within the feed waveguide 102. This gives rise to induced currents in the walls (i.e., the broad-wall 300 and narrow wall (not shown)) of the feed waveguide 102 that are at right angles to the magnetic field. As an example, in FIG. 4A, a perspective-side view of a portion 400 of the feed waveguide 102 (of FIG. 3) is shown. In this example, the first input signal 186 is injected into the cavity 402 of the feed waveguide 102 at the 1st FWI 116 (at the first end 118 of the feed waveguide 102). If the first input signal 184 is a $TE_{10}$ mode signal, it will induce an electric field 404 that is directed along the vertical direction of the narrow-wall 406 of the feed waveguide 102 and a magnetic field 408 that is perpendicular to the electric field 404 and forms loops along the direction of propagation 410, which are parallel to the broad-wall 300 (both at the top broad-wall 300 and at bottom broad-wall 412) and tangential to the sidewalls (i.e., narrow-wall 406). It is appreciated by those of ordinary skill in the art that for the $TE_{10}$ mode, the electric field 404 varies in a sinusoidal fashion as a function of distance along the direction of propagation 410. In FIG. 4B, a perspective-side view of the portion 400 of the feed waveguide 102 is shown with the resulting induced currents 414 in the $TE_{10}$ mode along the broad-wall 300 and narrow-wall 406 that produced by the first input signal 184.

Figure 4A:
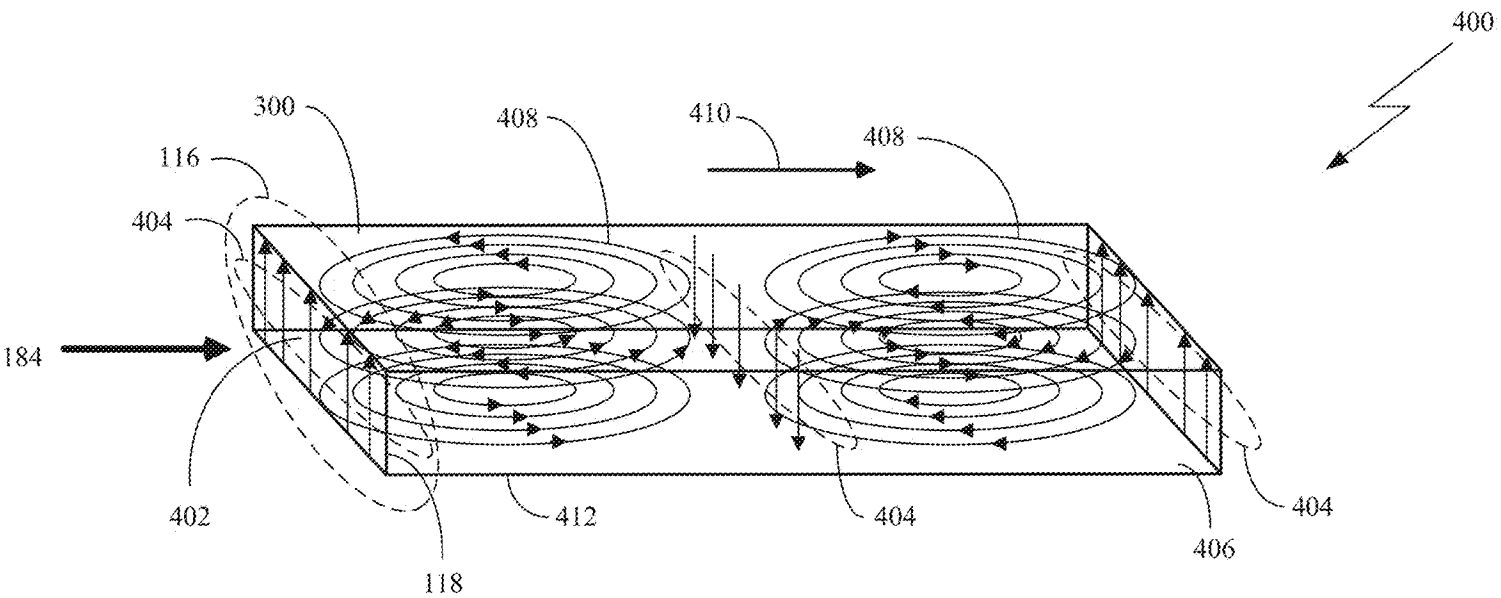
FIG. 4A is a perspective-side view of a portion of the feed waveguide shown in FIG. 3 showing the $TE_{10}$ mode excited electric and magnetic fields.
Figure 4B:
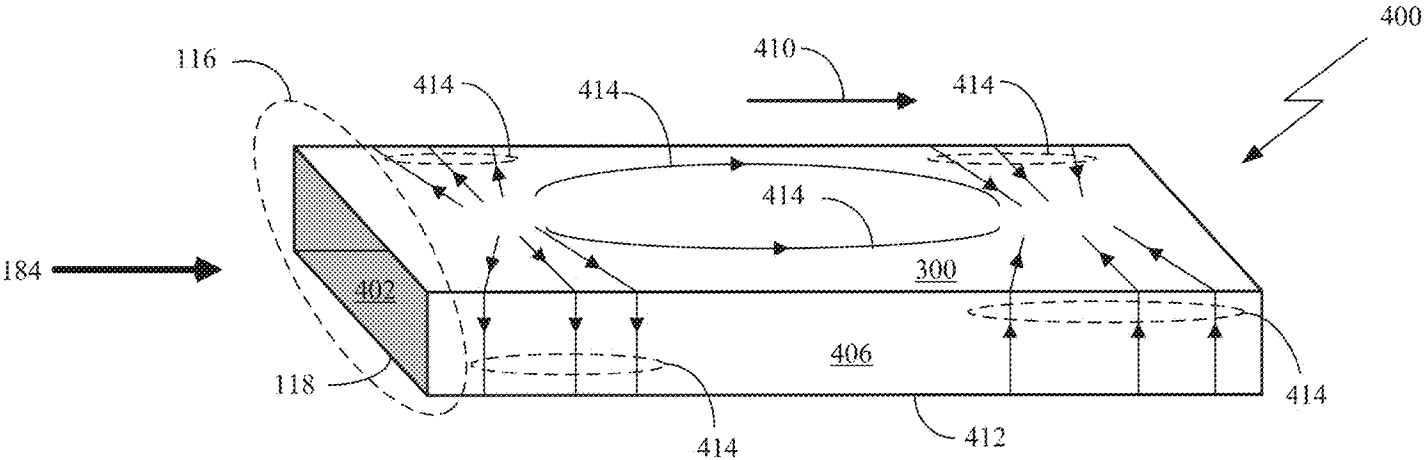
FIG. 4B is a perspective-side view of a portion of the feed waveguide shown in FIG. 3 showing the resulting induced currents in the $TE_{10}$ mode along the broad-wall and narrow-wall corresponding to the excited electric and magnetic fields shown in FIG. 4A.
Figure 5:
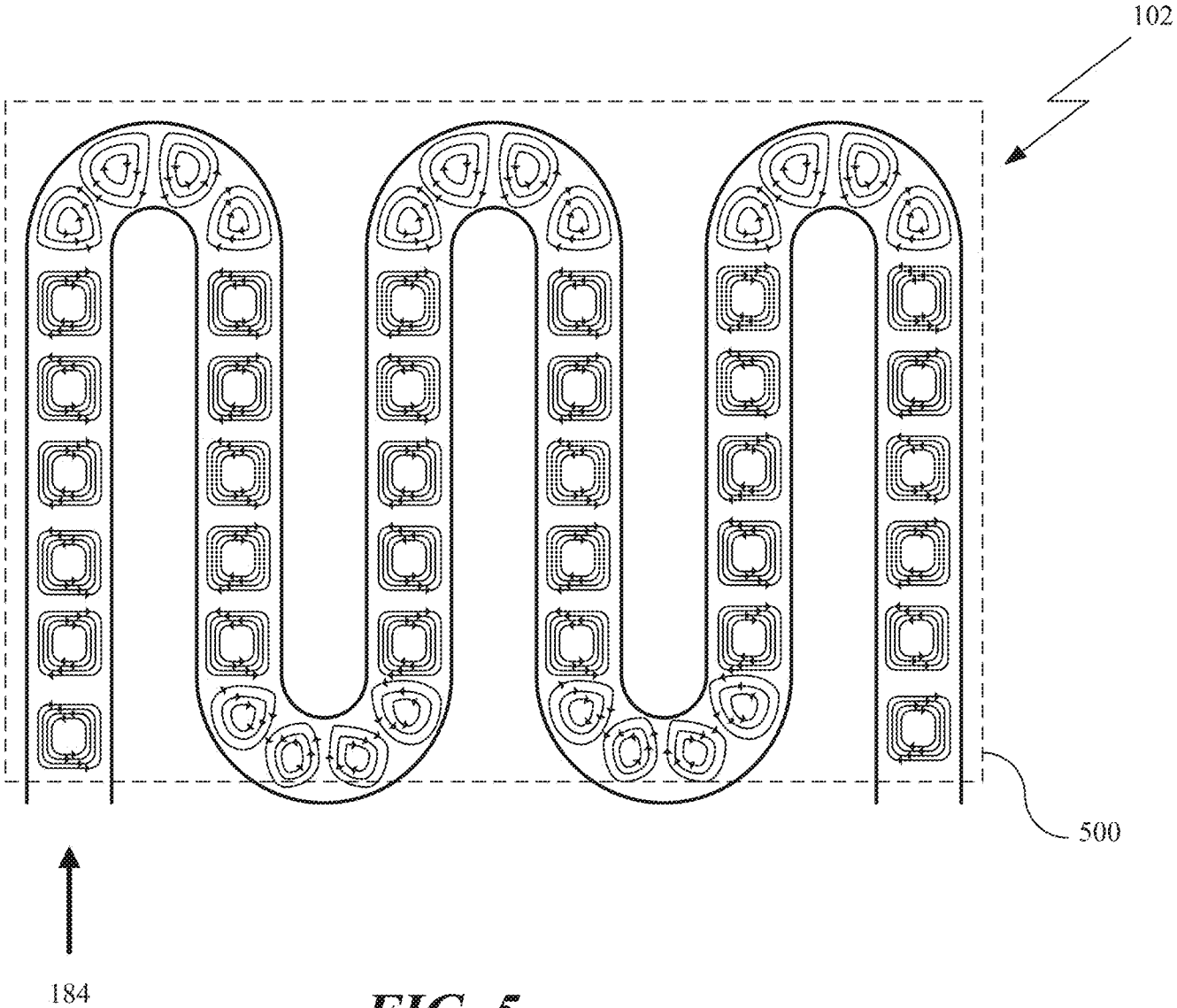
FIG. 5 is a top view of the feed waveguide shown if FIG. 3 with a plurality of excited magnetic field loops along the length of the feed waveguide.

Expanding on this concept, in FIG. 5, a top view of the feed waveguide 102 is shown with a plurality of excited magnetic field loops 500 along the waveguide length 188 of the feed waveguide 102. The magnetic field loops are caused by the propagation of the first input signal 184 along the length of the feed waveguide 102. It is noted that in FIGS. 4A, 4B, and 5 the examples were described in relation to the first input signal 184; however, it is appreciated that by reciprocity the same examples hold true for describing the electric and magnetic fields and the induced currents along the feed waveguide 102 for the second input signal 186. The only difference is that the polarities will be opposite because of the opposite direction of propagation of the second input signal 186 in relation to the first input signal 184.

Turning back to FIG. 3 (with reference to FIGS. 4A and 4B), each planar coupling slot 302, 304, 306, 308, 310, 312, 314, 316, 318, 320, 322, and 324 is designed to interrupt the current flow of the induced currents 414 in the broad-wall 300 of the feed waveguide 102 and as a result produce a disturbance of the internal electric field 404 and magnetic field 408 that results in energy being radiated from the cavity 402 of the feed waveguide 102 to the external environment of the feed waveguide 102, i.e., coupling energy from the feed waveguide 102 to the external environment. Turning back to FIGS. 1A through 1D and FIG. 2, these pairs of planar coupling slots 326, 330, 332, 334, and 336, couple energy from the feed waveguide 102 to the respective directional couplers (i.e., 1st DC 140, 2nd DC 142, 3rd DC 144, 4th DC 146, 5th DC 148, and 6th DC 150) shown in FIGS. 1A through 1D and FIG. 2.

It is appreciated by those of ordinary skill in the art that FIGS. 4A, 4B, and 5 describe the input signals as being $TE_{10}$ mode signals; however, the signals may instead be $TE_{01}$ mode signals which are also well known to those of ordinary skill in the art. In the case of $TE_{10}$ mode signals, the induced currents 414 and electric fields 404 within the feed waveguide 102 will be different and each planar coupling slot will be different than the slots for the $TE_{10}$ mode example described above. However, the design theory is similar in that each planar coupling slot is still designed to interrupt the current flow of induced currents 414 in the broad-wall 300 of the feed waveguide 102. In this example, the AAS 100 may be utilized to steer an antenna beam by frequency utilizing a single input (either the first input signal 184 or the second input signal 186) or by utilizing a given frequency by feeding both ends with the first input signal 184 and the second input signal 186.

Figure 6:
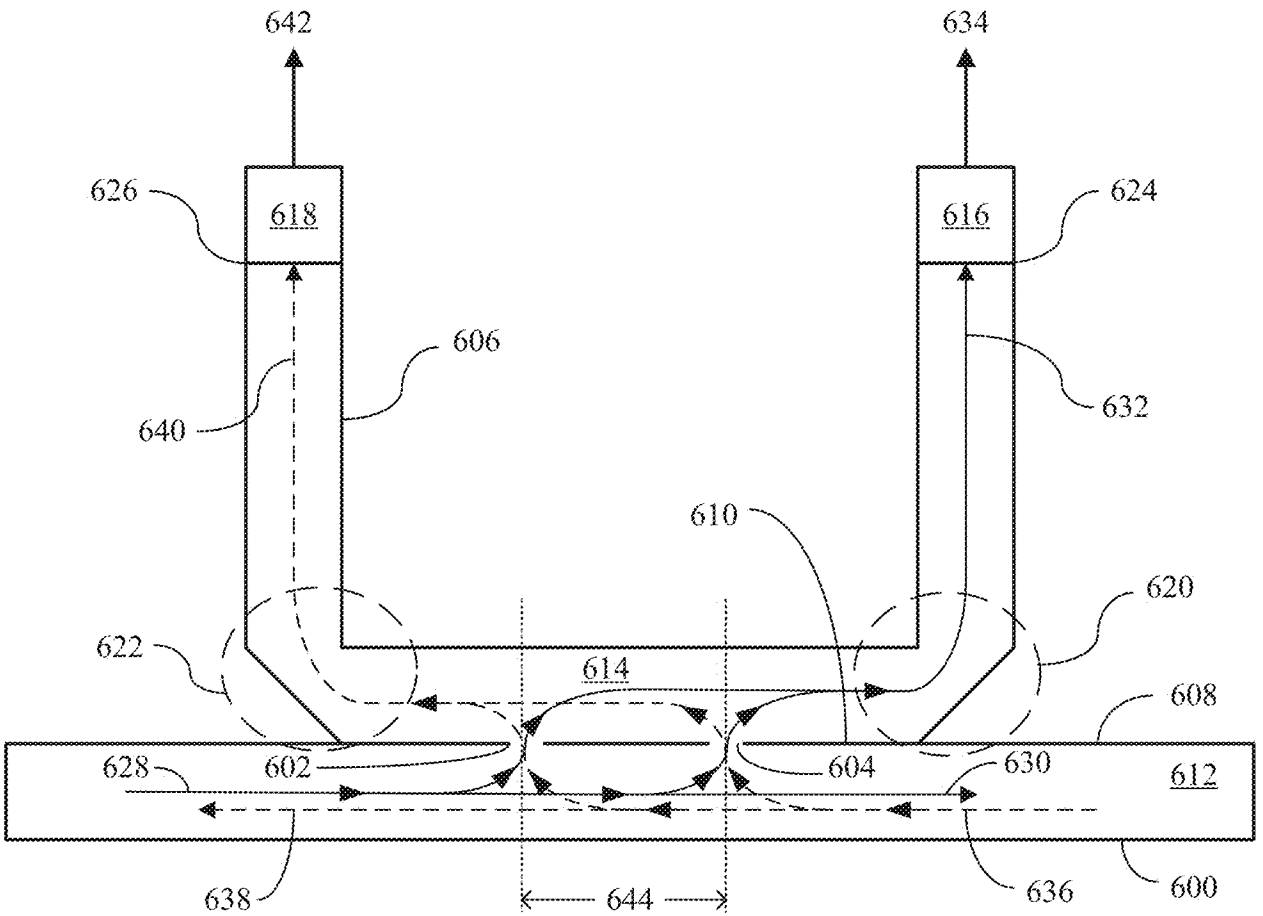
FIG. 6 is a side-cut view of an example of implementation of the feed waveguide, pair of planar coupling slots, and directional coupler in accordance with the present disclosure.

Turning to FIG. 6, in FIG. 6 a side-cut view of an example of an implementation of a feed waveguide 600, a pair of planar coupling slots 602 and 604, and a directional coupler 606 is shown in accordance with the present disclosure. The directional coupler 606 is coupled to the feed waveguide 600 via the pair of planar coupling slots 602 and 604, which couple energy from the feed waveguide 600 to the directional coupler 606. In this example, it is appreciated that the feed waveguide 600 has a pair of planar coupling slots cut into the top broad-wall 608 of the feed waveguide 600 and that the directional coupler 606 has a corresponding pair of planar coupling slots cut into the bottom broad-wall 610 of the directional coupler 606. The pair of planar coupling slots from the feed waveguide 600 and the pair of planar coupling slots from the directional coupler 606 are placed on top of each other to form the combined pair of planar coupling slots 602 and 604 that allow energy to be coupled from a cavity 612 inside the feed waveguide 600 to a cavity 614 inside the directional coupler 606.

The directional coupler 606 is in signal communication with a first power amplifier 616 and a second power amplifier 618. Similar to the $6^{th}$ DC 150 (shown in FIG. 1C), the directional coupler 606 is shown to have a "U" shaped waveguide structure that is located adjacent to the feed waveguide 600 and has two bends 620 and 622. The first bend 620 is located close to the first power amplifier 616 and the second bend 622 is located in the opposite direction along the directional coupler 606 close to the second power amplifier 618. Specifically, the directional coupler 606 is in signal communication with both power amplifiers 616 and 618 at a directional coupler first end 624 and a directional coupler second end 626, respectively. In this example, the first bend 620 and second bend 622 are shown to be non-step transition bends, unlike the first bend 166 and second bend 168 shown in FIG. 1C. As discussed earlier, there are various types of known E-bends that may be utilized in the directional coupler 606 based on the design goals of the AAS 100.

In an example of operation, a first signal 628 (corresponding to the first input signal 184) propagates along the feed waveguide 600. When the first signal 628 reaches the pair of planar coupling slots 602 and 604, most of the power will continue to propagate along the feed waveguide 600 as shown by a remaining first input signal 630; however, a small part of the first signal 628 will be coupled from the feed waveguide 600 to the directional coupler 606 via the pair of planar coupling slots 602 and 604. This coupled energy is shown as a forward coupled signal 632. The forward coupled signal 632 is then passed to the first power amplifier 616, which amplifies the amplitude of the forward coupled signal 632 and passes an amplified first coupled signal 634 to an input feed of a horn antenna (not shown).

Similarly, a second signal 636 (corresponding to the second input signal 186) is propagating along the feed waveguide 600 in the opposite direction of the first signal 628. When the second signal 636 reaches the pair of planar coupling slots 602 and 604, most of the power will continue to propagate along the feed waveguide 600 as shown by the remaining second input signal 638; however, a small part of the second signal 636 will be coupled from the feed waveguide 600 to the directional coupler 606 via the pair of planar coupling slots 602 and 604. This coupled energy is shown as a reverse coupled signal 640. The reverse coupled signal 640 is then passed to the second power amplifier 618, which amplifies the amplitude of the reverse coupled signal 640 and passes the amplified second coupled signal 642 to another input feed of the horn antenna. The horn antenna may then utilize the amplified first coupled signal 634 to produce and radiate a RHCP signal and the amplified second coupled signal 642 to produce and radiate a LHCP signal. Alternatively, the horn antenna may utilize the amplified first coupled signal 634 to produce and radiate a horizontal polarized signal and the amplified second coupled signal 642 to produce and radiate a vertical polarized signal.

In this example, the pair of planar coupling slots 602 and 604 are spaced apart by a spacing 644 that is approximately a quarter-wavelength. The reason for a quarter-wavelength spacing is well known in the art for directional couplers but may be generally stated as causing the first signal 628 to couple energy from the feed waveguide 600 to the directional coupler 606 in one direction while causing the second signal 636 to couple energy from the feed waveguide 600 to the directional coupler 606 in the opposite direction. The reason for this is that in general coupled signal propagate in both directions, however, the phase delay caused by the planar coupling slots 602 and 604 will cause one of the coupled signals to destructively cancel in one direction while constructively adding phases in another. Specifically, when the first signal 628 reaches the first planar coupling slot 602, part of the energy (i.e., a coupled signal) from the first signal 628 will couple into the directional coupler 606 via the first planar coupling slot 602. When the remaining first signal reaches the second planar coupling slot 604, another part of the energy from the remaining first signal will couple into the directional coupler 606 via the second planar coupling slot 604. Since these two coupled signals are propagating in the same direction (i.e., towards the first power amplifier 616), they are in-phase and constructively add in phase to produce the forward coupled signal 632. However, any energy coupled in the opposite direction (i.e., towards the second power amplifier 618) will destructively cancel out because the coupled signal (produced by the first planar coupling slot 602) from the first signal 628 traveling towards the second power amplifier 618 will lead the coupled signal (produced by the second planar coupling slot 604) from the remaining first signal by approximately 180 degrees in phase. This results because (taking the first planar coupling slot 602 as a reference) the coupled signal going to the second planar coupling slot 604 has to travel a further quarter-wavelength in the feed waveguide 600, and then quarter-wavelength back again in the directional coupler 606. Hence the two coupled signals in the direction of the second power amplifier 618 cancel each other. It is appreciated by those of ordinary skill in the art that in practice a small amount of power (i.e., energy) will reach the second power amplifier 618 because of the imperfections in designing the directional coupler 606. However, this may be minimized by proper design techniques that are known to those of ordinary skill in the art. It is appreciated that the same coupling process is applicable to the second signal 636 such that the reverse coupled signal 640 is a result of constructive addition, while coupled signals from the second signal 636 in the direction of the first power amplifier 616 are cancelled.

Figure 7A:
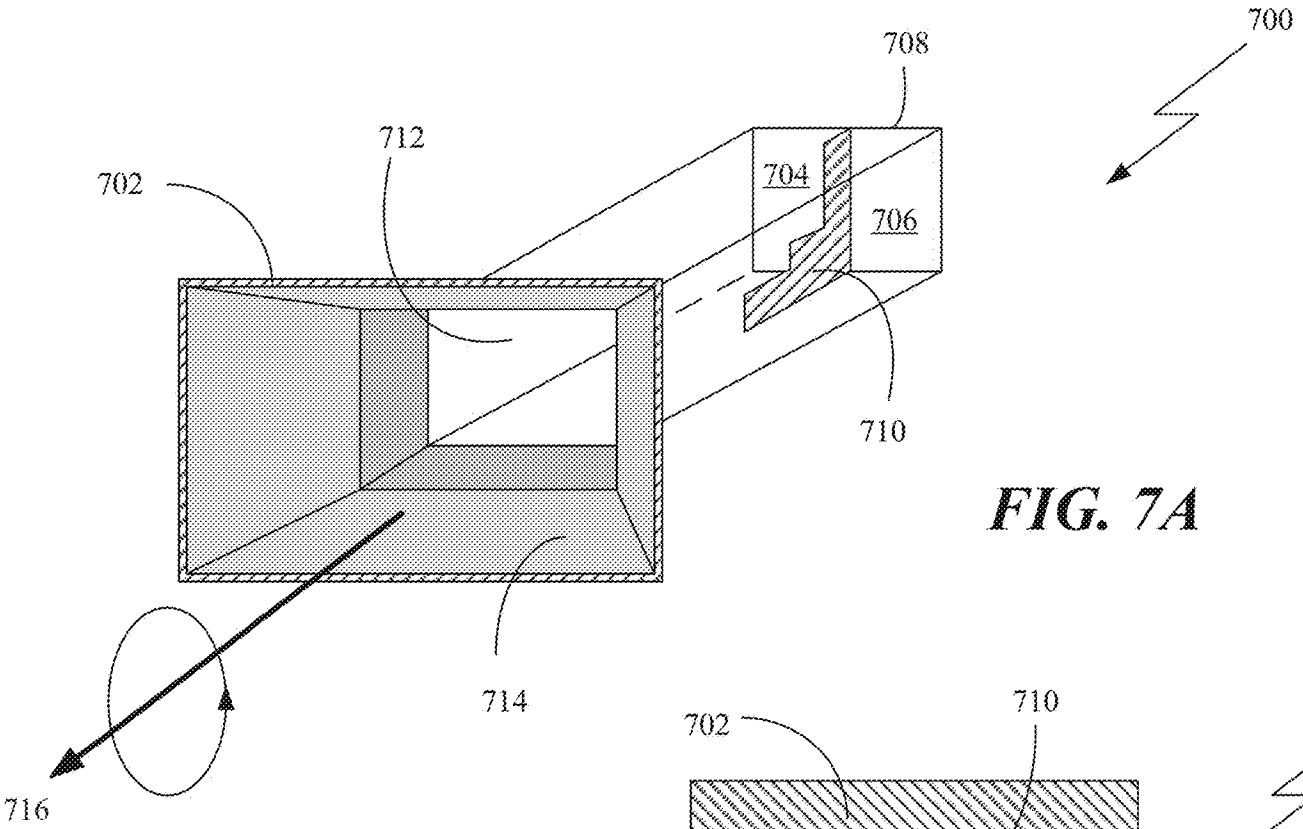
FIG. 7A is a front-perspective view of an example of an implementation of a horn antenna for use with the AAS in accordance with the present disclosure.
Figure 7B:
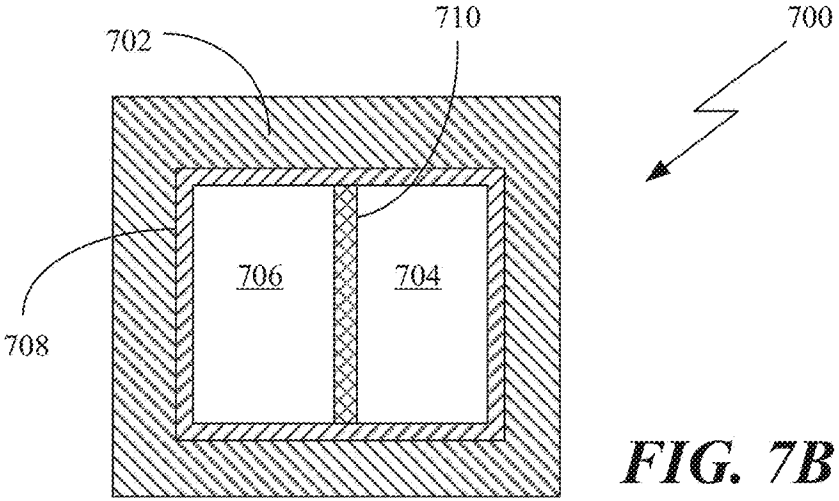
FIG. 7B is a back view of the horn antenna (shown in FIG. 7A) showing a first horn input, a second horn input, and a septum polarizer.

In FIG. 7A, a front-perspective view of an example of an implementation of a horn antenna 700 for use with the AAS 100 is shown in accordance with the present disclosure. In general, the horn antenna 700 is an antenna that consists of a flaring metal waveguide 702 shaped like a horn to direct radio waves in a beam. In this example, the horn antenna 700 includes a first horn input 704 and a second horn input 706 at the feed input 708 of the horn antenna 700. In this example, the horn antenna 700 includes a septum polarizer 710. It is appreciated by those of ordinary skill in the art that a septum polarizer 710 is a waveguide device that is configured to transform a linearly polarized signal at the first horn input 704 and second horn input 706 into a circularly polarized signal at the output 712 of the waveguide into a horn antenna aperture 714. The horn antenna 700 then radiates a circularly polarized signal 716 into free space. FIG. 7B is a back view of the horn antenna 700 showing the first horn input 704, second horn input 706, and the septum polarizer 710. In this example, the horn antenna 700 is shown to be a septum horn but the horn antenna 700 may also be another type of horn antenna based on the required design parameters of the AAS 100. Examples of other types of horn antennas that may be utilized as a horn antenna 700 include, for example, a pyramidal horn, conical horn, exponential horn, and ridged horn.

In an example of operation, linear signals feed into the first horn input 704 may be transformed into RHCP signals at the output 712 of the waveguide, while linear signals feed into the second horn input 706 may be transformed into LHCP signals at the output 712 of the waveguide or vis-versa. The RHCP or LHCP signals may then be transmitted as the circularly polarized signal 716 into free space.

Alternatively, a different horn antenna design may be utilized that produces linear polarization signals, instead of circularly polarized signals, from the linear signals feed into the first horn input (not shown) and the second horn input (not shown). Vertical and horizontal polarized signals, instead of RHCP and LHCP signals, may then be transmitted into free space. In this example an orthomode transducer ("OMT") may be utilized at each element rather than a septum polarizer. An alternative to utilizing a horn antenna with the septum polarizer 710 is to adjust the relative phase between the first input signal 184 and second input signal 186 in such a way that each directional coupler output runs to a single mode horn antenna (not a septum polarizer fed horn as shown in FIGS. 7A and 7B). In this example, there would be two arrays of horn antennas instead of one (as shown in FIGS. 1A through 1D). In this example, a first array of horn antennas excited by the first input signal 184 may run parallel to a second array of horn antennas excited by the second input signal 186.

Figure 8:
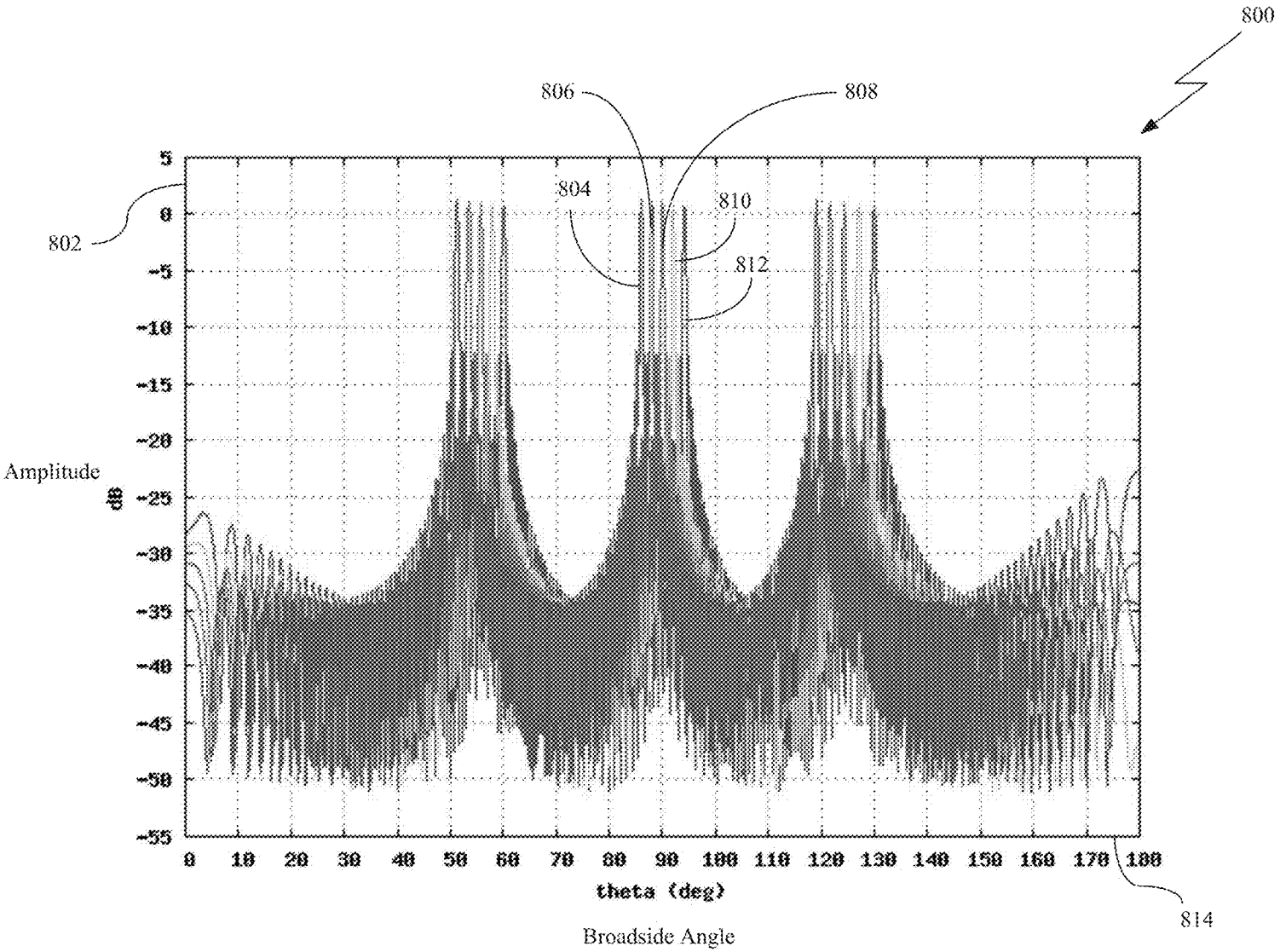
FIG. 8 is a plot of the amplitude, in decibels, of five example antenna radiation patterns versus broadside angle in degrees.

In FIG. 8, a plot 800 of the amplitude in decibels ("dB") 802 of five example antenna radiation patterns 804, 806, 808, 810, and 812 versus broadside angle in degrees 814. The antenna radiation patterns 804, 806, 808, 810, and 812 are for an example 60 element AAS versus frequency. As an example, the plot of the first antenna radiation pattern 804 is an antenna beam pattern at 19.7 GHz, the plot of the second antenna radiation pattern 806 is an antenna beam pattern at 19.825 GHz, the plot of the third antenna radiation pattern 808 is an antenna beam pattern at 19.95 GHz, the plot of the fourth antenna radiation pattern 810 is an antenna beam pattern at 20.075 GHz, and the plot of the fifth antenna radiation pattern 812 is an antenna beam pattern at 20.2 GHz.

Figure 9:
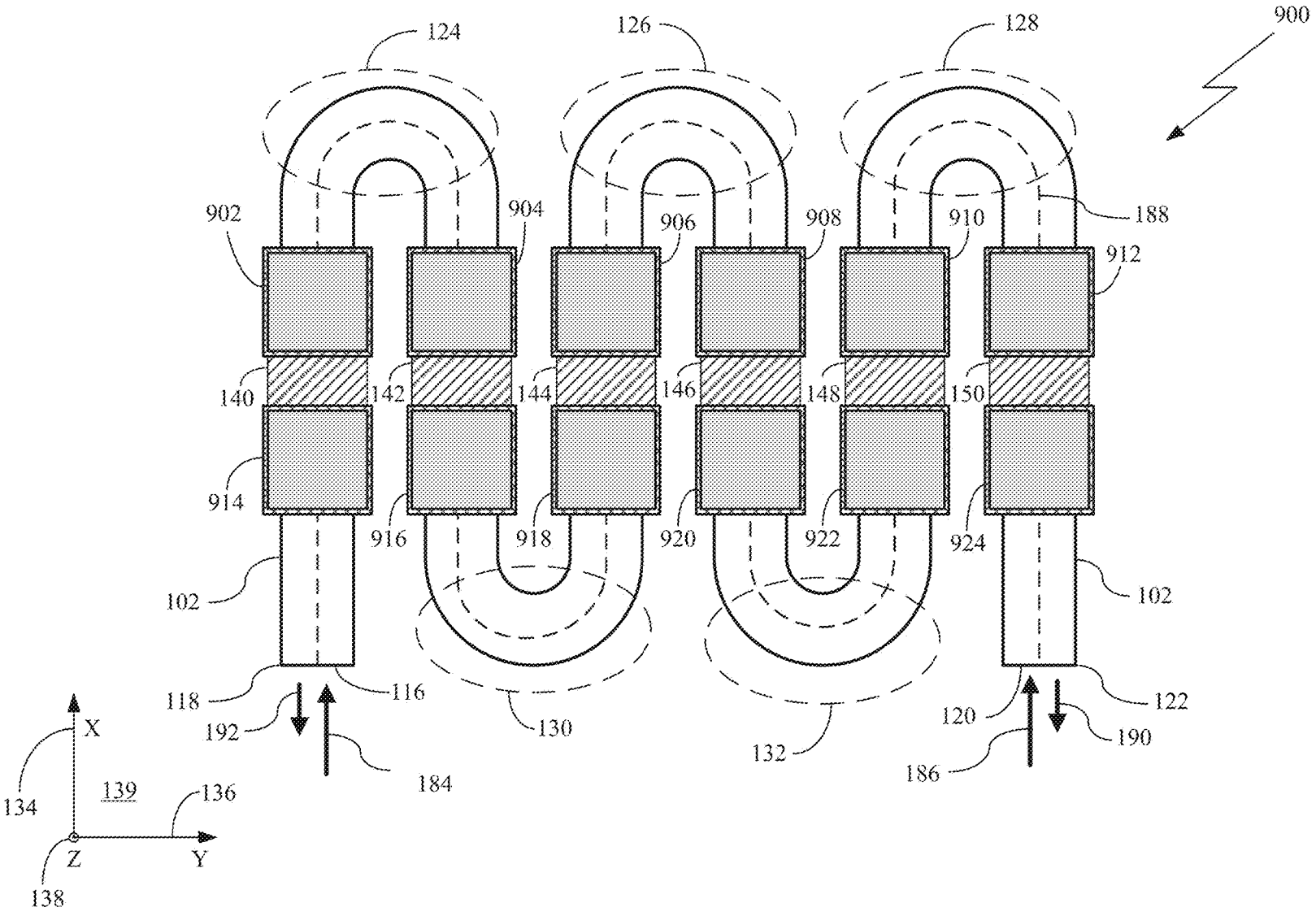
FIG. 9 is a top view of an example of an implementation of another AAS in accordance with the present disclosure.

In FIG. 9, a top view of an example of another implementation of an AAS 900 is shown. As described earlier, in this example, the AAS 900 utilizes a plurality of single mode horn antennas instead of a plurality of horn antennas having a septum as described in the examples shown in FIGS. 7A and 7B. In this example, the plurality of single mode horn antennas include two arrays of horn antennas (i.e., a first sub-plurality of horn antennas and a second sub-plurality of horn antennas) that include a first single mode horn antenna of the first array ("$1^{st}$ SMHAFA") 902, a second single mode horn antenna of the first array ("$2^{nd}$ SMHAFA") 904, a third single mode horn antenna of the first array ("$3^{rd}$ SMHAFA") 906, a fourth single mode horn antenna of the first array ("$4^{th}$ SMHAFA") 908, a fifth single mode horn antenna of the first array ("$5^{th}$ SMHAFA") 910, a sixth single mode horn antenna of the first array ("$6^{th}$ SMHAFA") 912, a first single mode horn antenna of the second array ("$1^{st}$ SMHASA") 914, a second single mode horn antenna of the second array ("$2^{nd}$ SMHASA") 916, a third single mode horn antenna of the first array ("$3^{rd}$ SMHASA") 918, a fourth single mode horn antenna of the second array ("$4^{th}$ SMHASA") 920, a fifth single mode horn antenna of the second array ("$5^{th}$ SMHASA") 922, and a sixth single mode horn antenna of the second array ("$6^{th}$ SMHASA") 924. Furthermore, in this example, the $1^{st}$ SMHAFA 902 and $1^{st}$ SMHASA 914 is in signal communication with the $1^{st}$ DC 140, $2^{nd}$ SMHAFA 904 and $2^{nd}$ SMHASA 916 is in signal communication with the $2^{nd}$ DC 142, $3^{rd}$ SMHAFA 906 and $3^{rd}$ SMHASA 918 is in signal communication with the $3^{rd}$ DC 144, $4^{th}$ SMHAFA 908 and $4^{th}$ SMHASA 920 is in signal communication with the $4^{th}$ DC 146, $5^{th}$ SMHAFA 910 and $5^{th}$ SMHASA 922 is in signal communication with the $5^{th}$ DC 148, $6^{th}$ SMHAFA 912 and $6^{th}$ SMHASA 924 is in signal communication with the $6^{th}$ DC 150. The first array of horn antennas (i.e., $1^{st}$ SMHAFA 902, $2^{nd}$ SMHAFA 904, $3^{rd}$ SMHAFA 906, $4^{th}$ SMHAFA 908, $5^{th}$ SMHAFA 910, and $6^{th}$ SMHAFA 912) are excited by the first input signal 184 and the second array of horn antennas (i.e., $1^{st}$ SMHASA 914, $2^{nd}$ SMHASA 916, $3^{rd}$ SMHASA 918, $4^{th}$ SMHASA 920, $5^{th}$ SMHASA 922, and $6^{th}$ SMHASA 924) are excited by the second input signal 186.

Figure 10A:
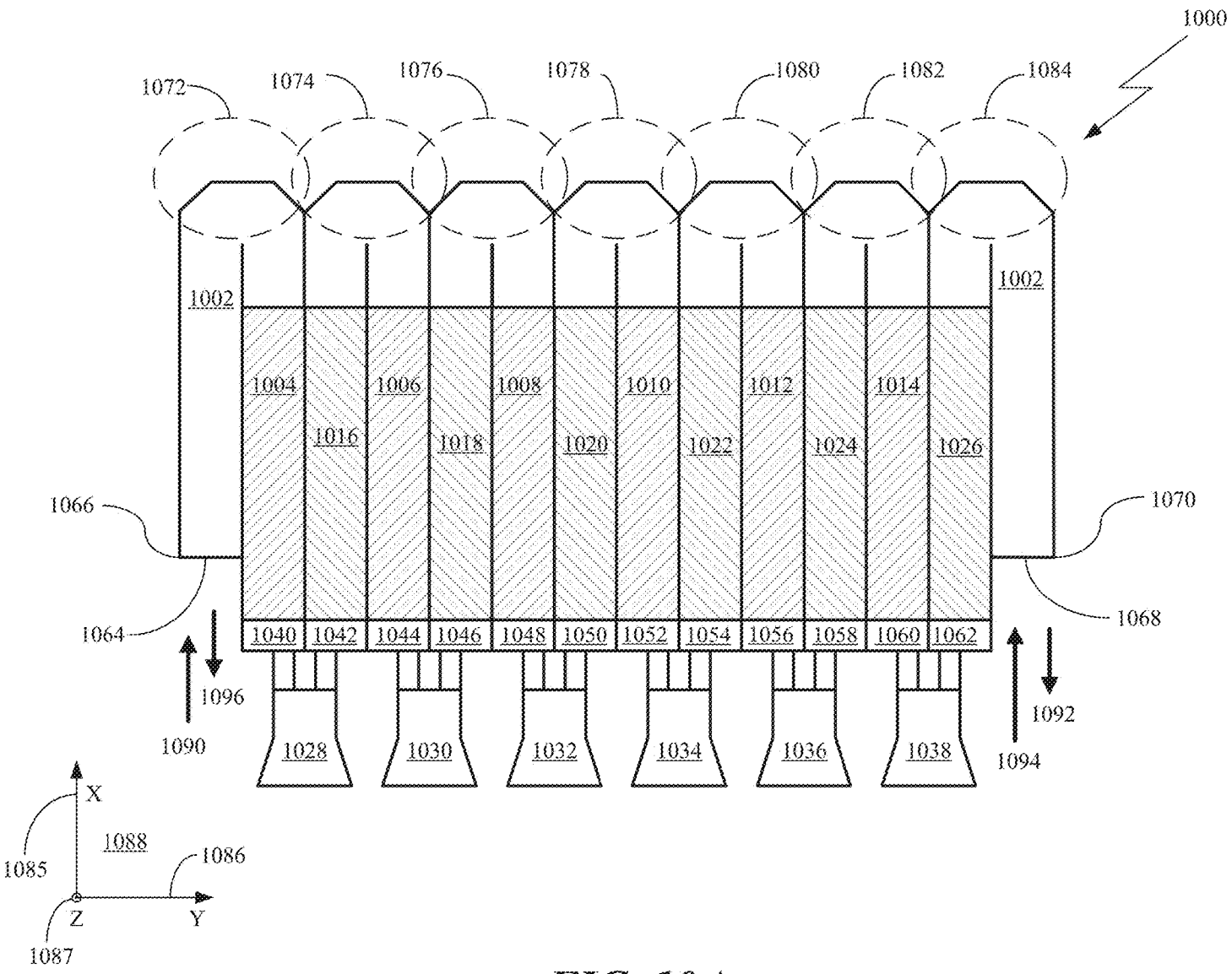
FIG. 10A is a top view of an example of an implementation of yet another AAS in accordance with the present disclosure.
Figure 10B:
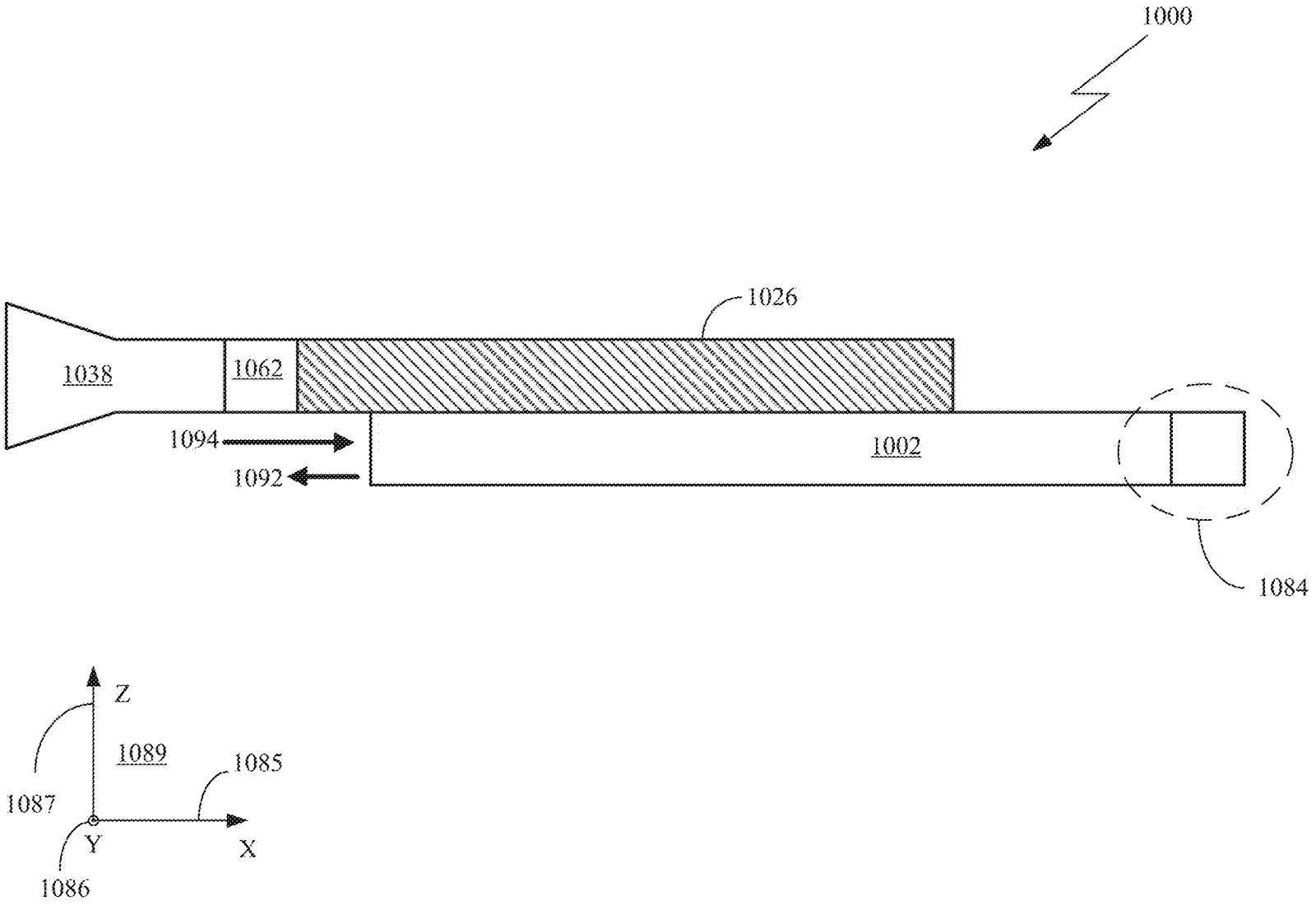
FIG. 10B is a side view of the example of the implementation of the AAS shown in FIG. 10A.

Turning to FIGS. 10A and 10B, various views of an example of another implementation of an AAS 1000 are shown in accordance with the present disclosure. In FIG. 10A, a top view of the example of the implementation of another AAS 1000 is shown. Similar to the previous examples, the AAS 1000 may include a feed waveguide 1002, a plurality of forward directional couplers, a plurality of reverse directional couplers, and a plurality of power amplifiers. As an example, the plurality of forward directional couplers may include a first forward directional coupler ("$1^{st}$ FDC") 1004, a second forward directional coupler ("$2^{nd}$ FDC") 1006, a third forward directional coupler ("$3^{rd}$ FDC") 1008, a fourth forward directional coupler ("$4^{th}$ FDC") 1010, a fifth forward directional coupler ("$5^{th}$ FDC") 1012, and a sixth forward directional coupler ("$6^{th}$ FDC") 1014. Similarly, the plurality of reverse directional couplers may include a first reverse directional coupler ("$1^{st}$ RDC") 1016, a second reverse directional coupler ("$2^{nd}$ RDC") 1018, a third reverse directional coupler ("$3^{rd}$ RDC") 1020, a fourth reverse directional coupler ("$4^{th}$ RDC") 1022, a fifth reverse directional coupler ("$5^{th}$ RDC") 1024, and a sixth reverse directional coupler ("$6^{th}$ RDC") 1026. Additionally, the plurality of horn antennas may include a first horn antenna ("$1^{st}$ HAT") 1028, a second horn antenna ("$2^{nd}$ HA2") 1030, a third horn antenna ("$3^{rd}$ HA2") 1032, a fourth horn antenna ("$4^{th}$ HA2") 1034, a fifth horn antenna ("$5^{th}$ HA2") 1036, and a sixth horn antenna ("$6^{th}$ HA2") 1038. Moreover, the plurality of power amplifiers may include a first power amplifier ("$1^{st}$ PA2") 1040, a second power amplifier ("$2^{nd}$ PA2") 1042, a third power amplifier ("$3^{rd}$ PA2") 1044, a fourth power amplifier ("$4^{th}$ PA2") 1046, a fifth power amplifier ("$5^{th}$ PA2") 1048, a sixth power amplifier ("$6^{th}$ PA2") 1050, a seventh power amplifier ("$7^{th}$ PA2") 1052, an eighth power amplifier ("$8^{th}$ PA2") 1054, a ninth power amplifier ("$9^{th}$ PA2") 1056, a tenth power amplifier ("10$^{th}$ PA2") 1058, an eleventh power amplifier ("11$^{th}$ PA2") 1060, and a twelfth power amplifier ("12$^{th}$ PA2") 1062.

In this example, the feed waveguide 1002 is in signal communication with both the 1$^{st}$ FDC 1004, 2$^{nd}$ FDC 1006, 3$^{rd}$ FDC 1008, 4$^{th}$ FDC 1010, 5$^{th}$ FDC 1012, and 6$^{th}$ FDC 1014 and the 1$^{st}$ RDC 1016, 2$^{nd}$ RDC 1018, 3$^{rd}$ RDC 1020, 4$^{th}$ RDC 1022, 5$^{th}$ RDC 1024, and 6$^{th}$ RDC 1026. The forward directional couplers 1$^{st}$ FDC 1004, 2$^{nd}$ FDC 1006, 3$^{rd}$ FDC 1008, 4$^{th}$ FDC 1010, 5$^{th}$ FDC 1012, and 6$^{th}$ FDC 1014 are respectively in signal communication with the power amplifiers 1$^{st}$ PA2 1040, 3$^{rd}$ PA2 1044, 5$^{th}$ PA2 1048, 7$^{th}$ PA2 1052, 9$^{th}$ PA2 1056, and 11$^{th}$ PA2 1060. Similarly, the reverse directional couplers 1$^{st}$ RDC 1016, 2$^{nd}$ RDC 1018, 3$^{rd}$ RDC 1020, 4$^{th}$ RDC 1022, 5$^{th}$ RDC 1024, and 6$^{th}$ RDC 1026 are respectively in signal communication with the power amplifiers 2$^{nd}$ PA2 1042, 4$^{th}$ PA2 1046, 6$^{th}$ PA2 1050, 8$^{th}$ PA2 1054, 10$^{th}$ PA2 1058, and 12$^{th}$ PA2 1062. The 1$^{st}$ HA2 1028 is in signal communication with the two power amplifiers 1$^{st}$ PA2 1040 and 2$^{nd}$ PA2 1042. The 2$^{nd}$ HA2 1030 is in signal communication with the 3$^{rd}$ PA2 1044 and 4$^{th}$ PA2 1046. The 3$^{rd}$ HA2 1032 is in signal communication with the 5$^{th}$ PA2 1048 and 6$^{th}$ PA2 1050. The 4$^{th}$ HA2 1034 is in signal communication with the 7$^{th}$ PA2 1052 and 8$^{th}$ PA2 1054. The 5$^{th}$ HA2 1036 is in signal communication with the 9$^{th}$ PA2 1056 and 10$^{th}$ PA2 1058. Finally, the 6$^{th}$ HA2 1038 is in signal communication with the 11$^{th}$ PA2 1060 and 12$^{th}$ PA2 1062.

The feed waveguide 1002 includes a first feed waveguide input 1064 at a first end 1066 of the feed waveguide 1002 and a second feed waveguide input 1068 at a second end 1070 of the feed waveguide 1002, where the second end 1070 is at the opposite end of the feed waveguide 1002 with respect to the first end 1066. The feed waveguide 1002 may be a serpentine or meandering waveguide that includes a plurality of turns (i.e., bends) 1072, 1074, 1076, 1078, 1080, 1082, and 1084. In this example, the physical layout of the feed waveguide 1002 may be described by a three-dimensional Cartesian coordinate system with coordinate axes X 1085, Y 1086, and Z 1087, where the feed waveguide 1002 is located in a XY-plane 1088 defined by the X 1085 and Y 1086 coordinate axes. Additionally, in this example, the plurality of horn antennas 1$^{st}$ HA2 1028, 2$^{nd}$ HA2 1030, 3$^{rd}$ HA2 1032, 4$^{th}$ HA2 1034, 5$^{th}$ HA2 1036, and 6$^{th}$ HA2 1038 are also shown extending in the XY-plane 1088.

Again, it is appreciated by those of ordinary skill in the art, that while only six horn antennas (i.e., 1$^{st}$ HA2 1028, 2$^{nd}$ HA2 1030, 3$^{rd}$ HA2 1032, 4$^{th}$ HA2 1034, 5$^{th}$ HA2 1036, and 6$^{th}$ HA2 1038), seven visible turns (i.e., bends 1072, 1074, 1076, 1078, 1080, 1082, and 1084), and six non-visible turns (i.e., bends that are covered by the plurality of directional couplers) in the feed waveguide 1002 are shown, this is for illustration purposes only and AAS 1000 may include any even number of directional couplers, horn antennas, and power amplifiers with a corresponding number of turns needed to feed the plurality of directional couplers. As another example, the AAS 1000 may include 120 directional couplers and 60 horn antennas, and 121 turns in the feed waveguide 1002. It is again appreciated by those of ordinary skill in the art that the number of horn antennas determines the numbers directional couplers, and turns in the feed waveguide 102. Again, each horn antenna of the plurality of horn antennas (i.e., 1$^{st}$ HA2 1028, 2$^{nd}$ HA2 1030, 3$^{rd}$ HA2 1032, 4$^{th}$ HA2 1034, 5$^{th}$ HA2 1036, and 6$^{th}$ HA21038) act as an individual radiating element of the AAS 1000. In operation, each horn antenna's individual radiation pattern typically varies in amplitude and phase from each other horn antenna's radiation pattern. The amplitude of the radiation pattern for each horn antenna is controlled by a power amplifier that controls the amplitude of the excitation current of the horn antenna. Similarly, the phase of the radiation pattern of each horn antenna is determined by the corresponding delayed phase caused by the feed waveguide 1002 in feeding the directional couplers that correspond to the horn antenna.

In FIG. 10B, a side view of the implementation of an AAS 1000 is shown. For reference, the physical layout of the AAS 1000 in this side view is shown within a XZ-plane 1089 defined by the X 1085 and Z 1087 coordinate axes with the Y 1086 coordinate axis directed in a direction that is both perpendicular and out of the XZ-plane 1089. In this side view, the reverse directional coupler (i.e., 6$^{th}$ RDC 1026) is shown to be a rectangular waveguide structure that is located adjacent to the feed waveguide 1002. Specifically, the 6$^{th}$ RDC 1026 is in signal communication with the 6$^{th}$ HA2 1038 through the 12$^{th}$ PA2 1062.

In an example of operation, when a first input signal 1090 in injected into the first feed waveguide input 1064, the first input signal 1090 will travel along the feed waveguide 1002 and couple a first portion of its energy to the 1$^{st}$ FDC, which will pass this first coupled output signal to the 1$^{st}$ HA2 via the 1$^{st}$ PA2. The remaining portion of the first input signal 1090 will then travel along the feed waveguide 1002 to the 1$^{st}$ RDC 1016 where it will not couple any energy because the 1$^{st}$ RDC 1016 is designed to only couple signals that are traveling in the opposite direction. As such, the remaining portion of the first input signal 1090 will continue to travel along the feed waveguide 1002 to the 2$^{nd}$ FDC 1006 and couple a second portion of its energy to the 2$^{nd}$ FDC 1006, which will pass this second coupled output signal to the 2$^{nd}$ HA2 1030 via the 3$^{rd}$ PA2 1044. The remaining portion of the first input signal 1090 will then travel along the feed waveguide 1002 to the 2$^{nd}$ RDC 1018 where it will not couple any energy because the 2$^{nd}$ RDC 1018 is designed to only couple signals that are traveling in the opposite direction. As such, the remaining portion of the first input signal 1090 will continue to travel along the feed waveguide 1002 to the 3$^{rd}$ FDC 1008 and couple a third portion of its energy to the 3$^{rd}$ FDC 1008, which will pass this third coupled output signal to the 3$^{rd}$ HA2 1032 via the 5$^{th}$ PA2 1048. The remaining portion of the first input signal 1090 will then travel along the feed waveguide 1002 to the 3$^{rd}$ RDC 1020 where it will not couple any energy because the 3$^{rd}$ RDC 1020 is designed to only couple signals that are traveling in the opposite direction. As such, the remaining portion of the first input signal 1090 will continue to travel along the feed waveguide 1002 to the forward directional coupler 1010 and couple a fourth portion of its energy to the 4$^{th}$ FDC 1010, which will pass this fourth coupled output signal to the 4$^{th}$ HA2 1034 via the 7$^{th}$ PA2 1052. The remaining portion of the first input signal 1090 will then travel along the feed waveguide 1002 to the 4$^{th}$ RDC 1022 where it will not couple any energy because the 4$^{th}$ RDC 1022 is designed to only couple signals that are traveling in the opposite direction. As such, the remaining portion of the first input signal 1090 will continue to travel along the feed waveguide 1002 to the 5$^{th}$ FDC 1012 and couple a fifth portion of its energy to the 5$^{th}$ FDC 1012, which will pass this fifth coupled output signal to the 5$^{th}$ HA2 1036 via the 9$^{th}$ PA2 1056. The remaining portion of the first input signal 1090 will then travel along the feed waveguide 1002 to the 5$^{th}$ RDC 1024 where it will not couple any energy because the 5$^{th}$ RDC 1024 is designed to only couple signals that are traveling in the opposite direction. As such, the remaining portion of the first input signal 1090 will continue to travel along the feed waveguide 1002 to the $6^{th}$ FDC 1014 and couple a sixth portion of its energy to the $6^{th}$ FDC 1014, which will pass this sixth coupled output signal to the $6^{th}$ HA2 1038 via the $11^{th}$ PA2 1060. The remaining portion of the first input signal 1090 will then travel along the feed waveguide 1002 to the $6^{th}$ RDC 1026 where it will not couple any energy because the $6^{th}$ RDC 1026 is designed to only couple signals that are traveling in the opposite direction. As such, the remaining portion of the first input signal 1090 will continue to travel along the feed waveguide 1002 and output, as the first remaining signal 1092, via the second feed waveguide input 1068. It is appreciated that by optimizing the design of forward directional couplers (i.e., $1^{st}$ FDC 1004, $2^{nd}$ FDC 1006, $3^{rd}$ FDC 1008, $4^{th}$ FDC 1010, $5^{th}$ FDC 1012, and $6^{th}$ FDC 1014), the first remaining signal 1092 may be reduced to close to or approximately zero.

Similarly, when a second input signal 1094 is in injected into the second feed waveguide input 1068, the second input signal 1094 will travel along the feed waveguide 1002 (in the opposite direction of the first input signal 1090) and couple a first portion of its energy to the $6^{th}$ RDC 1026, which will pass this first coupled output signal to the $6^{th}$ HA2 1038 via the $12^{th}$ PA2 1062. The remaining portion of the second input signal 1094 will then travel along the feed waveguide 1002 to the $6^{th}$ FDC 1014 where it will not couple any energy because the $6^{th}$ FDC 1014 is designed to only couple signals that are traveling in the opposite direction (i.e., the direction of the first input signal 1090). As such, the remaining portion of the second input signal 1094 will continue to travel along the feed waveguide 1002 to the $5^{th}$ RDC 1024 and couple a second portion of its energy to the $5^{th}$ RDC 1024, which will pass this second coupled output signal to the $5^{th}$ HA2 1036 via the $10^{th}$ PA2 1058. The remaining portion of the second input signal 1094 will then travel along the feed waveguide 1002 to the $5^{th}$ FDC 1012 where it will not couple any energy because the $5^{th}$ FDC 1012 is designed to only couple signals that are traveling in the opposite direction. As such, the remaining portion of the second input signal 1094 will continue to travel along the feed waveguide 1002 to the $4^{th}$ RDC 1022 and couple a third portion of its energy to the $4^{th}$ RDC 1022, which will pass this third coupled output signal to the $4^{th}$ HA2 1034 via the $8^{th}$ PA2 1054. The remaining portion of the second input signal 1094 will then travel along the feed waveguide 1002 to the $4^{th}$ FDC 1010 where it will not couple any energy because the $4^{th}$ FDC 1010 is designed to only couple signals that are traveling in the opposite direction. As such, the remaining portion of the second input signal 1094 will continue to travel along the feed waveguide 1002 to the $3^{rd}$ RDC 1020 and couple a fourth portion of its energy to $3^{rd}$ RDC 1020, which will pass this fourth coupled output signal to the $3^{rd}$ HA2 1032 via the $6^{th}$ PA2 1050. The remaining portion of the second input signal 1094 will then travel along the feed waveguide 1002 to the $3^{rd}$ FDC 1008 where it will not couple any energy because the $3^{rd}$ FDC 1008 is designed to only couple signals that are traveling in the opposite direction. As such, the remaining portion of the second input signal 1094 will continue to travel along the feed waveguide 1002 to the $2^{nd}$ RDC 1018 and couple a fifth portion of its energy to the $2^{nd}$ RDC 1018, which will pass this fifth coupled output signal to the $5^{th}$ HA2 1036 via the $4^{th}$ PA2 1046. The remaining portion of the second input signal 1094 will then travel along the feed waveguide 1002 to the $2^{nd}$ FDC 1006 where it will not couple any energy because the $2^{nd}$ FDC 1006 is designed to only couple signals that are traveling in the opposite direction. As such, the remaining portion of the second input signal 1094 will continue to travel along the feed waveguide 1002 to the $1^{st}$ RDC 1016 and couple a sixth portion of its energy to the $1^{st}$ RDC 1016, which will pass this sixth coupled output signal to the $1^{st}$ HA2 1028 via the $2^{nd}$ PA2 1042. The remaining portion of the second input signal 1094 will then travel along the feed waveguide 1002 to the $1^{st}$ FDC 1004 where it will not couple any energy because the $1^{st}$ FDC 1004 is designed to only couple signals that are traveling in the opposite direction. As such, the remaining portion of the second input signal 1094 will continue to travel along the feed waveguide 1002 and output, as the second remaining signal 1096, via the first feed waveguide input 1064.

Again, it is appreciated by those of ordinary skill in the art that by optimizing the design of reverse directional couplers (i.e., $1^{st}$ RDC 1016, $2^{nd}$ RDC 1018, $3^{rd}$ RDC 1020, $4^{th}$ RDC 1022, $5^{th}$ RDC 1024, and $6^{th}$ RDC 1026), the second remaining signal 1096 may be reduced to close to or approximately zero. It is also appreciated by those of ordinary skill in the art that a first circulator, or other isolation device, (not shown) may be connected to the first end 1066 to isolate the first input signal 1090 from the outputted second remaining signal 1096 and a second circulator, or other isolation device, (not shown) may be connected to the second end 1070 to isolate the second input signal 1094 from the outputted first remaining signal 1092. It is also appreciated by those of ordinary skill in the art that the amount of coupled energy from the feed waveguide 1002 to the respective directional couplers (i.e., $1^{st}$ FDC 1004, $2^{nd}$ FDC 1006, $3^{rd}$ FDC 1008, $4^{th}$ FDC 1010, $5^{th}$ FDC 1012, $6^{th}$ FDC 1014, $1^{st}$ RDC 1016, $2^{nd}$ RDC 1018, $3^{rd}$ RDC 1020, $4^{th}$ RDC 1022, $5^{th}$ RDC 1024, and $6^{th}$ RDC 1026) is determined by predetermined design choices that will yield the desired radiation antenna pattern of the AAS 1000.

Figure 11:
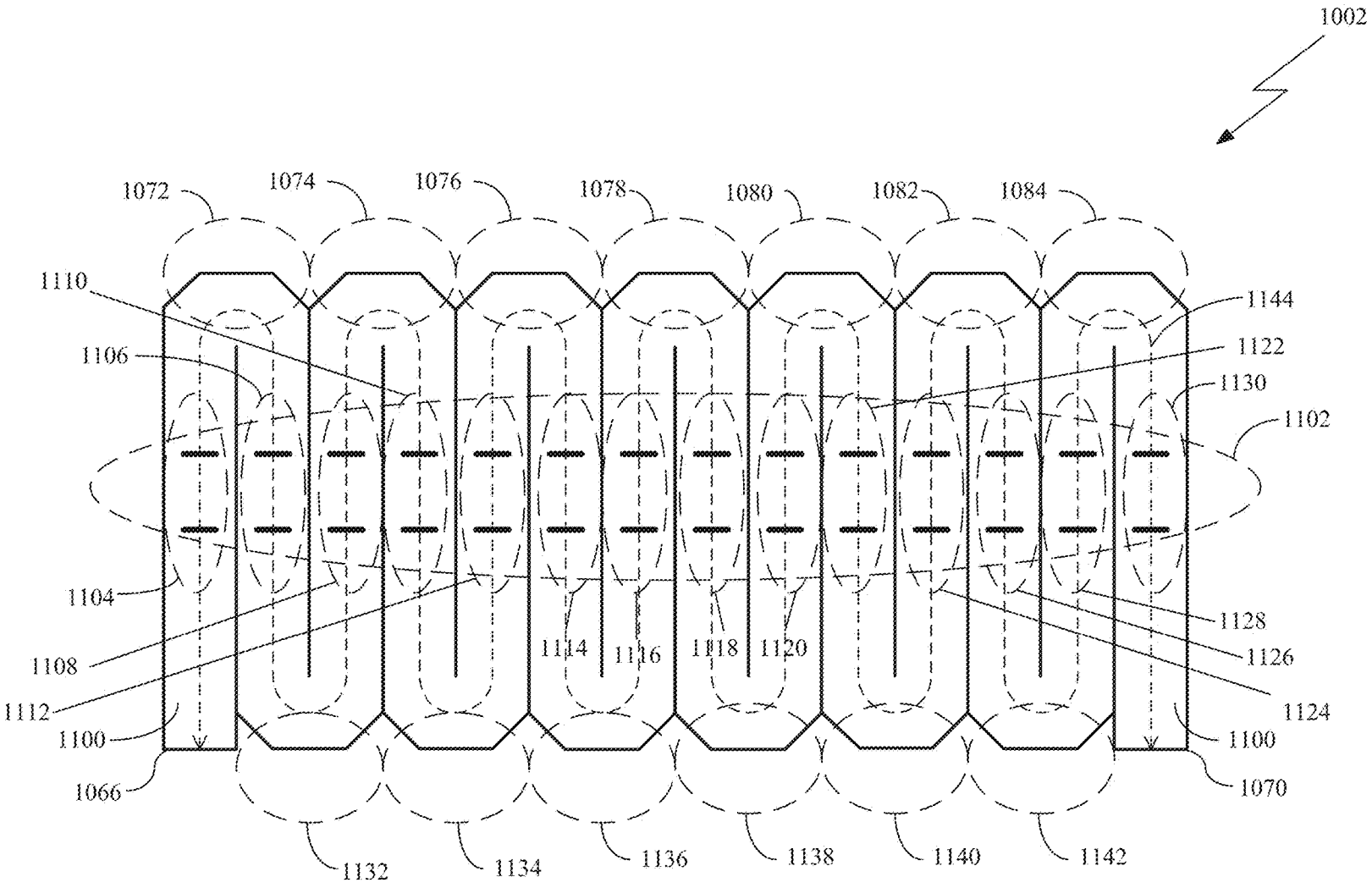
FIG. 11 is a top view of an example of an implementation of the feed waveguide (shown if FIGS. 10A and 10B) in accordance with the present disclosure.

Turning to FIG. 11, a top view of an example of an implementation of the feed waveguide 1002 (of FIGS. 10A and 10B) is shown in accordance with the present disclosure. The feed waveguide 1002 includes a broad-wall 1100 and a plurality of planar coupling slots 1102 that are organized into pairs of planar coupling slots 1104, 1106, 1108, 1110, 1112, 1114, 1116, 1118, 1120, 1122, 1124, 1126, 1128, and 1130, respectively.

In this example, the planar coupling slots are cut into the broad-wall 1100 of the feed waveguide 1002 and each pair of planar coupling slots 1104, 1106, 1108, 1110, 1112, 1114, 1116, 1118, 1120, 1122, 1124, 1126, 1128, and 1130 have a spacing between pairs of planar coupling slots that is approximately equal to a quarter-wavelength of the operating wavelength of the AAS 1000. Also in this example, the feed waveguide 1002 may include thirteen (13) H-bends (i.e., bends 1072, 1074, 1076, 1078, 1080, 1082, 1084, and bends 1132, 1134, 1136, 1138, 1140, and 1142). Again, the feed waveguide 1002 may be constructed of a conductive material such as metal and defines a rectangular tube that that has an internal cavity running the length 1144 of the feed waveguide 1002 that may be filled with air, dielectric material, or both. It is noted that unlike the feed waveguide 102 (shown in FIGS. 1A, 3, 5, and 9), the feed waveguide 1002 has non-continuous turns (i.e., bends 1072, 1074, 1076, 1078, 1080, 1082, 1084, 1132, 1134, 1136, 1138, 1140, and 1142 and twelve (12) common narrow-walls between the straight paths of the feed waveguide 1002; however, it is appreciated by those of ordinary skill in the art that the feed waveguide 1002 may be designed to couple energy to the directional couplers (i.e., $1^{st}$ FDC 1004, $2^{nd}$ FDC 1006, $3^{rd}$ FDC 1008, $4^{th}$ FDC 1010, $5^{th}$ FDC 1012, $6^{th}$ FDC 1014, $1^{st}$ RDC 1016, $2^{nd}$ RDC 1018, $3^{rd}$ RDC 1020, $4^{th}$ RDC 1022, $5^{th}$ RDC 1024, and $6^{th}$ RDC 1026) in substantially the same way that the feed waveguide 102 may be designed to couple energy to the directional couplers (i.e., 1st DC 140, 2nd DC 142, 3rd DC 144, 4th DC 146, 5th DC 148, and 5th DC 150) utilizing the principles described previously.

The difference between the first implementation of the AAS 100 and AAS 900 (shown in FIGS. 1-6 and 9) and the second implementation of the AAS 1000 is that the second implementation of the AAS 1000 has twice as many directional couplers. In this example of the second implementation, the directional couplers (i.e., 1st FDC 1004, 2nd FDC 1006, 3rd FDC 1008, 4th FDC 1010, 5th FDC 1012, 6th FDC 1014, 1st RDC 1016, 2nd RDC 1018, 3rd RDC 1020, 4th RDC 1022, 5th RDC 1024, and 6th RDC 1026) can only pass coupled signals to the horn antennas (i.e., 1st HA2 1028, 2nd HA2 1030, 3rd HA2 1032, 4th HA2 1034, 5th HA2 1036, and 6th HA2 1038) if the traveling input signal in the feed waveguide 1002 is traveling in the correct direction. As such, the directional couplers (i.e., 1st FDC 1004, 2nd FDC 1006, 3rd FDC 1008, 4th FDC 1010, 5th FDC 1012, 6th FDC 1014) that are configured to pass the first input signal 1090 to the horn antennas (i.e., 1st HA2 1028, 2nd HA2 1030, 3rd HA2 1032, 4th HA2 1034, 5th HA2 1036, and 6th HA2 1038) are referred to as "forward directional couplers," while the directional couplers (i.e., 1st RDC 1016, 2nd RDC 1018, 3rd RDC 1020, 4th RDC 1022, 5th RDC 1024, and 6th RDC 1026) that are configured to pass the second input signal 1094 to the horn antennas (i.e., 1st HA2 1028, 2nd HA2 1030, 3rd HA2 1032, 4th HA2 1034, 5th HA2 1036, and 6th HA2 1038) are referred to as "reverse directional couplers."

In the first implementation, each directional coupler (i.e., 1st DC 140, 2nd DC 142, 3rd DC 144, 4th DC 146, 5th DC 148, and 5th DC 150) is designed to couple signals from both the first input signal 184 and second input signal 186 irrespective of the direction of travel. Both coupled signals are passed to the respective horn antenna (i.e., 1st HA 104, 2nd HA 106, 3rd HA 108, 4th HA 110, 5th HA 112, and 6th HA 114) via different feeds paths from the directional coupler to the horn antenna.

It is appreciated by those of ordinary skill in the art that the meandering waveguide shown (i.e., feed waveguide 102 or feed waveguide 1002) in FIGS. 1-6, 9, 10A, 10B, and 11 may be operated in a dual mode fashion themselves where the ends of the meandering waveguides may be fed by feeder OMTs in order to launch a vertically or horizontally polarized waves into the meandering waveguide itself. These vertically and horizontally polarized waves may then be coupled by the respective directional couplers into the different horns to produce the designed polarizations outputs at the horns.

Figure 12A:
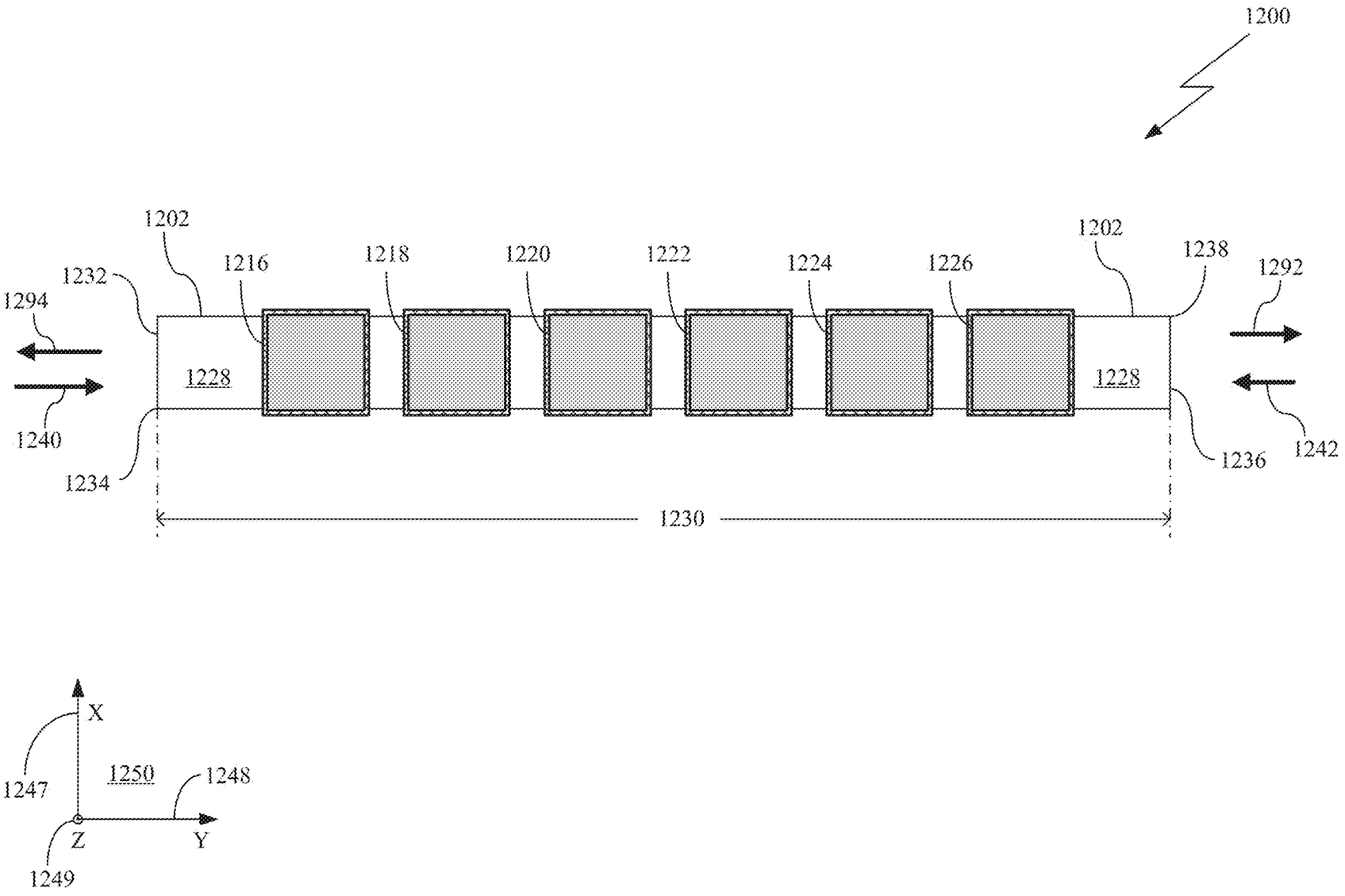
FIG. 12A is a top view of an example of yet another implementation of AAS in accordance with the present disclosure.
Figure 12B:
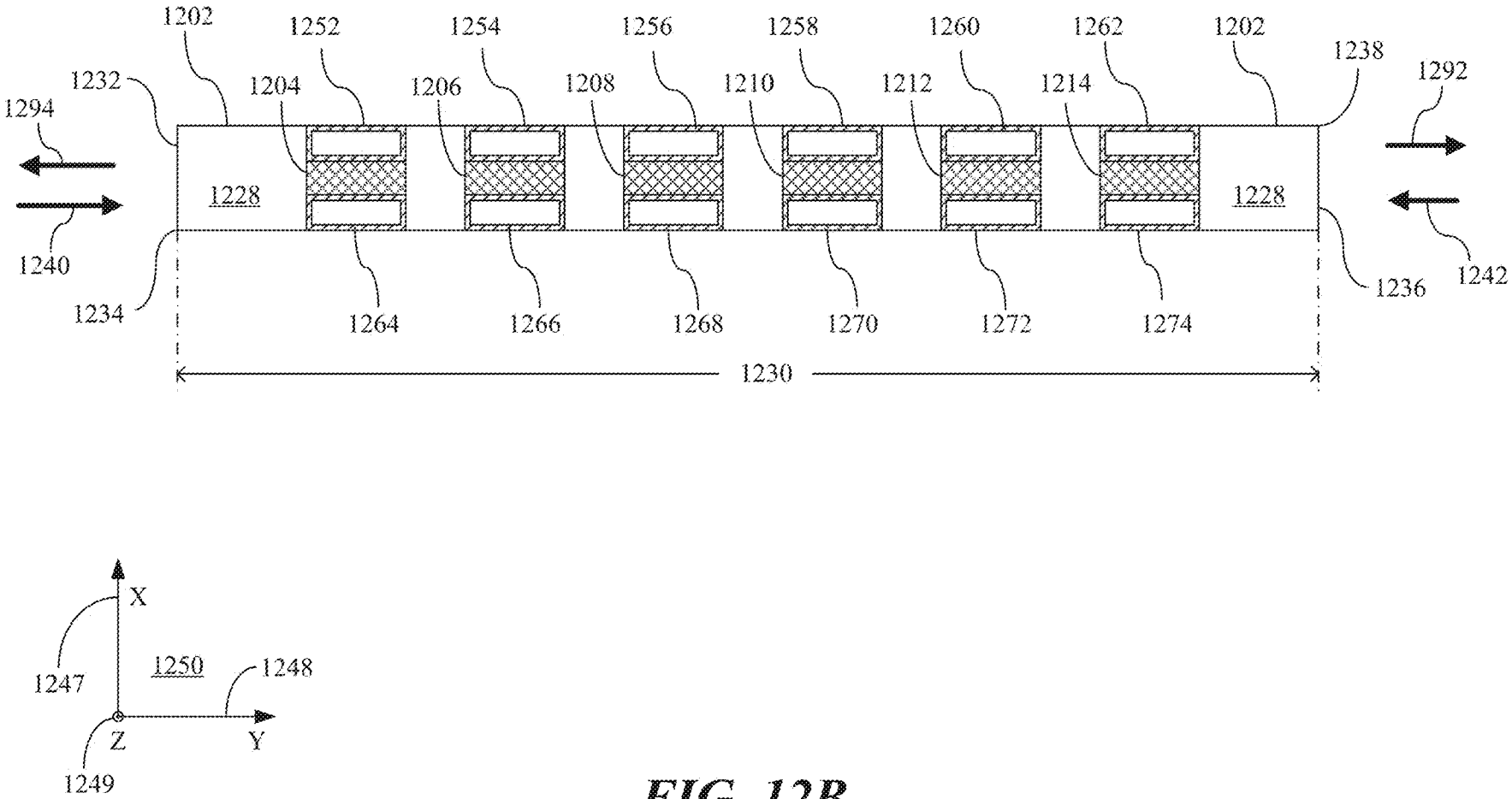
FIG. 12B is an exploded top view of the example of the implementation of the AAS shown in FIG. 12A in accordance with the present disclosure.
Figure 12C:
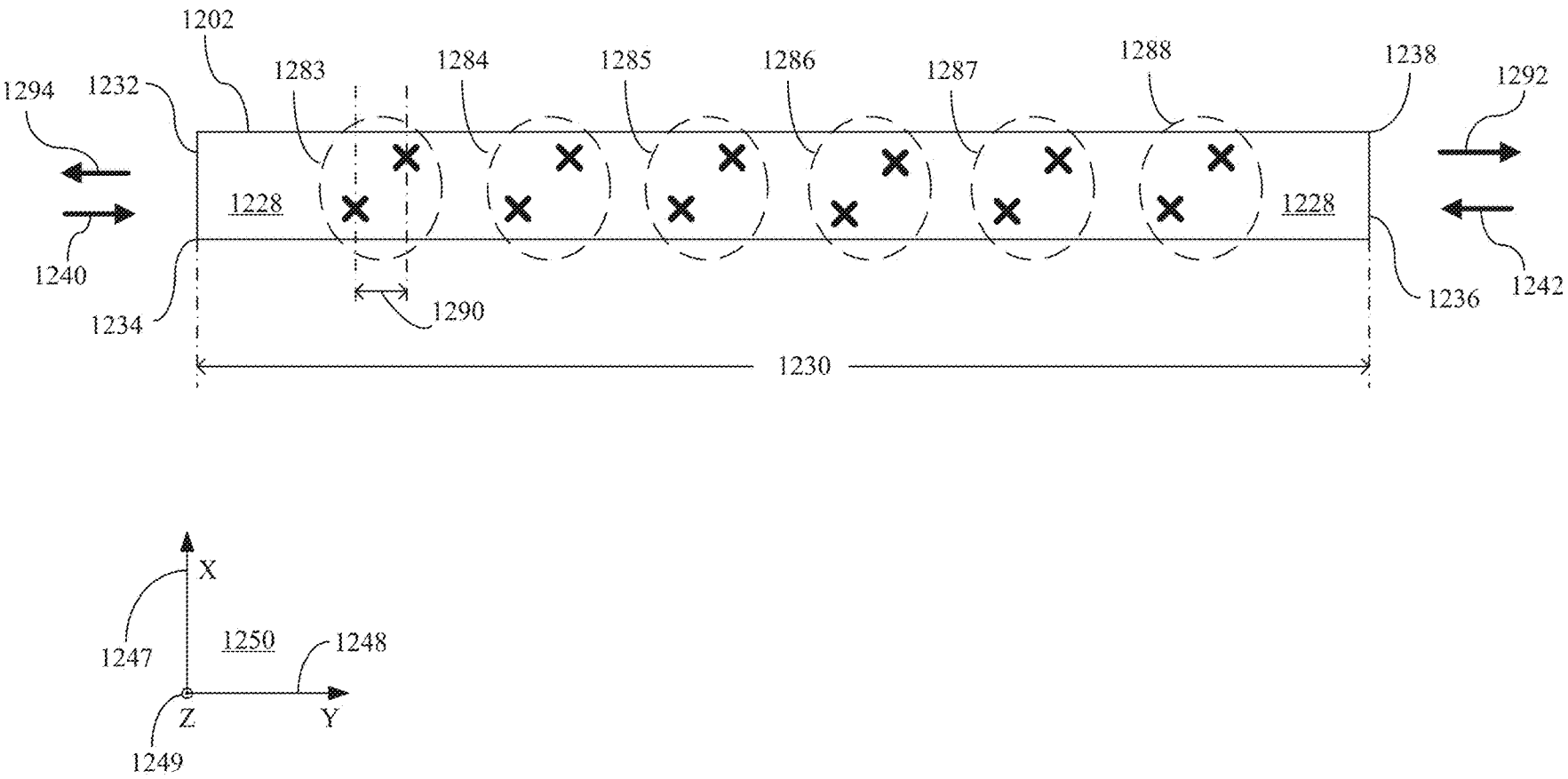
FIG. 12C is another exploded top view of the example of the implementation of the AAS shown in FIGS. 12A and 12B in accordance with the present disclosure.
Figure 12D:
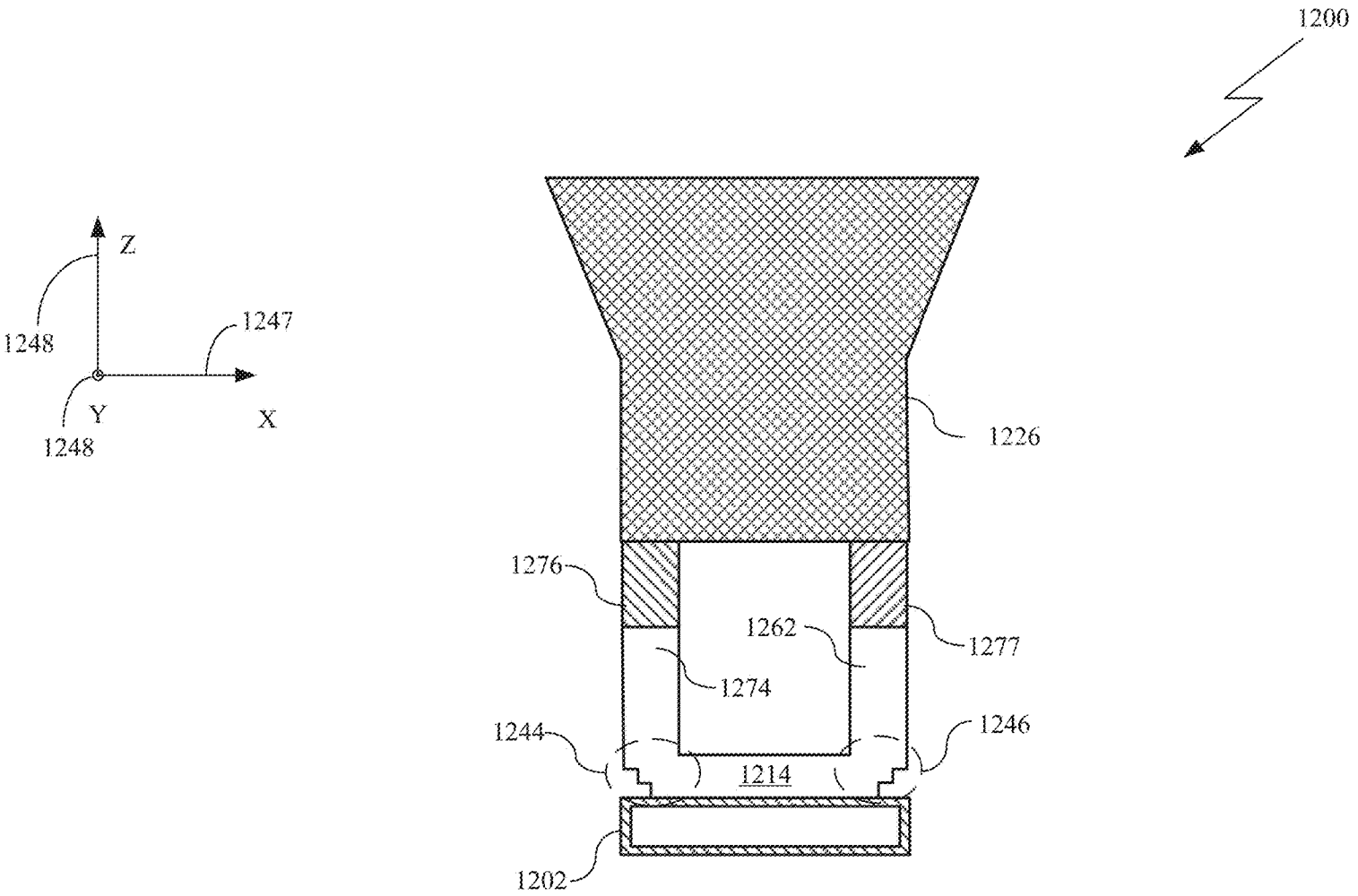
FIG. 12D is a side view of the example of the implementation of the AAS shown in FIGS. 12A, 12B, and 12C in accordance with the present disclosure.
Figure 12E:
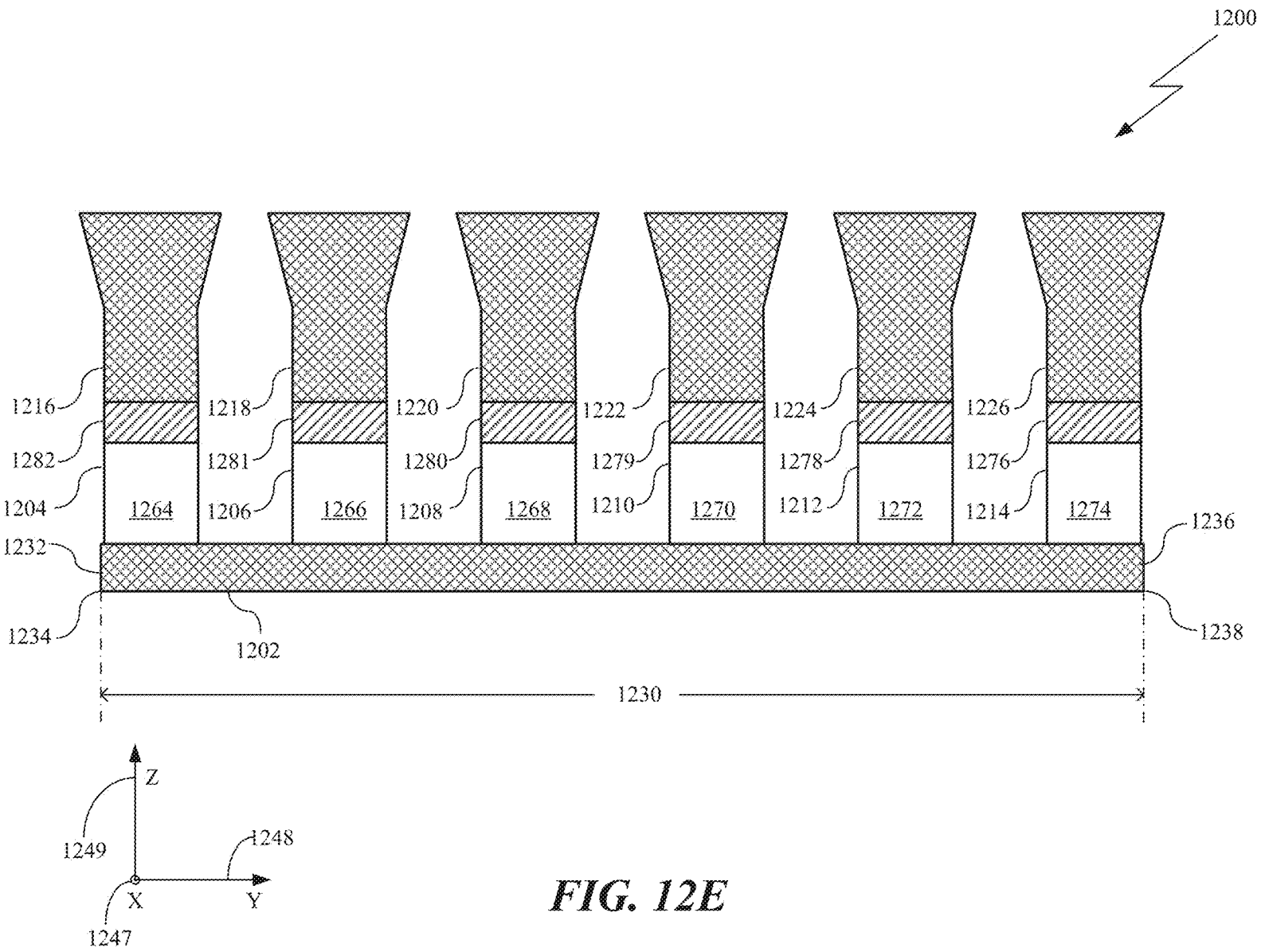
FIG. 12E is a front view of the example of the implementation of the AAS shown in FIGS. 12A through 12D in accordance with the present disclosure.

Turning to FIG. 12A, a top view is shown of an example of another implementation of the AAS 1200 in accordance with the present disclosure. FIG. 12B is an exploded top view of the example of the implementation of the AAS 1200 shown in FIG. 12A in accordance with the present disclosure. FIG. 12C is another exploded top view of the example of the implementation of the AAS 1200 shown in FIGS. 12A and 12B in accordance with the present disclosure. In FIG. 12D, a side view of the example of the implementation of the AAS 1200 shown if FIGS. 12A, 12B, and 12C in accordance with the present disclosure. FIG. 12E is a front view of the example of the implementation of the AAS 1200 shown in FIGS. 12A through 12D in accordance with the present disclosure. In this example, the AAS 1200 does not utilize a meandering feed waveguide (as described in FIGS. 1 through 11) but instead a straight feed waveguide 1202, a plurality of cross-couplers that include, for example, first cross-coupler ("1st CC") 1204, second cross-coupler ("2nd CC") 1206, third cross-coupler ("3rd CC") 1208, fourth cross-coupler ("4th CC") 1210, fifth cross-coupler ("5th CC") 1112, and sixth cross-coupler ("6th CC") 1214, and plurality of horn antennas that include, for example, first horn antenna ("1st HA3") 1216, second horn antenna ("2nd HA3") 1218, third horn antenna ("3rd HA3") 1220, fourth horn antenna ("4th HA3") 1222, fifth horn antenna ("5th HA3") 1224, and sixth horn antenna ("6th HA3") 1226. The straight feed waveguide 1202 has a feed waveguide wall 1228, feed waveguide length 1230, a first feed waveguide input 1232 at a first end 1234 of the straight feed waveguide 1202, and a second feed waveguide input 1236 at a second end 1238 of the straight feed waveguide 1202. The plurality of cross-couplers (i.e., 1st CC 1204, 2nd CC 1206, 3rd CC 1208, 4th CC 1210, 5th CC 1112, and 6th CC 1214) are in signal communication with the straight feed waveguide 1202 and the plurality of horn antennas (i.e., 1st HA3 1216, 2nd HA3 1218, 3rd HA3 1220, 4th HA3 1222, 5th HA3 1224, and 6th HA3 1226) are in signal communication with the 1st CC 1204, 2nd CC 1206, 3rd CC 1208, 4th CC 1210, 5th CC 1112, and 6th CC 1214, where each horn antenna (i.e., 1st HA3 1216, 2nd HA3 1218, 3rd HA3 1220, 4th HA3 1222, 5th HA3 1224, and 6th HA3 1226) is in signal communication with a corresponding cross-coupler of the plurality of cross-couplers (i.e., 1st CC 1204, 2nd CC 1206, 3rd CC 1208, 4th CC 1210, 5th CC 1212, and 6th CC 1214). Similar to the example shown in FIGS. 1A through 1D, the straight feed waveguide 1202 is configured to receive a first input signal 1240 at the first feed waveguide input 1232 and a second input signal 1242 at the second feed waveguide input 1236. Each horn antenna (i.e., 1st HA3 1216, 2nd HA3 1218, 3rd HA3 1220, 4th HA3 1222, 5th HA3 1224, and 6th HA3 1226) is configured to produce a first polarized signal from the received first input signal 1240 and a second polarized signal from the received second input signal 1242; and the first polarized signal is cross polarized with the second polarized signal.

In FIG. 12B, a top view of the 1st CC 1204, 2nd CC 1206, 3rd CC 1208, 4th CC 1210, 5th CC 1112, and 6th CC 1214 illustrates that each cross-coupler may again be a "U" shaped waveguide structure that is located adjacent to the straight feed waveguide 1202 and has two bends (such as, bends 1244 and 1246 on 1st CC 1204). Similar to the previous examples, in this example, the physical layout of the feed waveguide 1202 may be described by three-dimensional Cartesian coordinates with coordinate axes X 1247, Y 1248, and Z 1249, where the feed waveguide 1202 is located in an XY-plane 1250 defined by the X 1247 and Y 1248 coordinate axes. Unlike the directional couplers shown in the examples of FIGS. 1 through 11, the cross-couplers (i.e., 1st CC 1204, 2nd CC 1206, 3rd CC 1208, 4th CC 1210, 5th CC 1212, and 6th CC 1214) are directional couples that are physically perpendicular (i.e., along the X-axis 1247) to the feed waveguide length 1230 that is along the Y-axis 1248. In general, the cross-couplers (i.e., 1st CC 1204, 2nd CC 1206, 3rd CC 1208, 4th CC 1210, 5th CC 1212, and 6th CC 1214), also known as "cross-guide couplers," may be constructed to include two rectangular-section waveguides disposed at right angles with their broad walls juxtaposed to provide one common wall through which one or more apertures couple electromagnetic energy between the waveguides of the straight feed waveguide 1202 and the cross-couplers. These apertures (herein generally referred to as "planar coupling slots") may be spaced along a diagonal to the common wall, in diagonally opposite quadrants of the common wall, and may take the form of slots, crossed slots, circular orifices or other form. In these types of cross-couplers the electromagnetic wave travelling along the straight feed waveguide 1202 (i.e., either the first input signal 1240 or received second input signal 1242) is coupled through the common wall apertures into only one waveguide arm of the cross-coupled waveguide, so that there is an electromagnetic wave induced into the coupled waveguide arm but not into the other waveguide arm, generally known as the isolated waveguide arm. This generally describes the directivity of the cross-coupler which is well known to those of ordinary skill in the art. It is noted that the cross-coupler do not have perfect isolation so some small amount of energy may be leaked into the isolated waveguide arm. However, it is appreciated by of ordinary skill in the art that the cross-couplers may be designed such that the amount of isolation at the isolated waveguide arms is acceptable for a particular use.

In this example, each cross-coupler includes a first end and second end such that the cross-couplers ($1^{st}$ CC 1204, $2^{nd}$ CC 1206, $3^{rd}$ CC 1208, $4^{th}$ CC 1210, $5^{th}$ CC 1212, and $6^{th}$ CC 1214) include a first end 1252 of the $1^{st}$ CC 1204, a first end 1254 of the $2^{nd}$ CC 1206, a first end 1256 of the $3^{rd}$ CC 1208, a first end 1258 of the $4^{th}$ CC 1210, a first end 1260 of the $5^{th}$ CC 1212, and a first end 1262 of the $6^{th}$ CC 1214, respectively, and a second end 1264 of the $1^{st}$ CC 1204, a second end 1266 of the $2^{nd}$ CC 1206, a second end 1268 of the $3^{rd}$ CC 1208, a second end 1270 of the $4^{th}$ CC 1210, a second end 1272 of the $5^{th}$ CC 1212, and a second end 1274 of the $6^{th}$ CC 1214, respectively. The first ends 1252, 1254, 1256, 1258, 1260, and 1262 and second ends 1264, 1266, 1268, 1270, 1272, and 1274 of the cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) are directed in a direction that is along the Z 1249 axis. Again, the bent waveguide structure of the first bend 1244 and second bend 1246 of the $6^{th}$ CC 1214 is an E-bend that is generally designed to minimize reflections in the waveguide of the cross-coupler 1104. The reason for utilizing a bent waveguide structure for the $6^{th}$ CC 1214 is to allow the $6^{th}$ HA3 1226 to radiate in a normal (i.e., perpendicular) direction along the Z-axis 1248 away from the XY-plane 1250 that defines the physical layout structure of the straight feed waveguide 1202. It is appreciated by those of ordinary skill in the art that the $6^{th}$ CC 1214 may also be non-bent if the $6^{th}$ HA3 1226 is designed to radiate in a direction parallel to the XY-plane 1250.

In this example, the AAS 1200 also includes a plurality of power amplifiers in signal communication with the plurality of cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) and horn antennas (i.e., $1^{st}$ HA3 1216, $2^{nd}$ HA3 1218, $3^{rd}$ HA3 1220, $4^{th}$ HA3 1222, $5^{th}$ HA3 1224, and $6^{th}$ HA3 1226). In this example, the plurality of power amplifiers includes a first power amplifier ("$1^{st}$ PA3") 1276, a second power amplifier ("$2^{nd}$ PA3") 1277, a third power amplifier ("$3^{rd}$ PA3") 1278, a fourth power amplifier ("$4^{th}$ PA3") 1279, a fifth power amplifier ("$5^{th}$ PA3") 1280, a sixth power amplifier ("$6^{th}$ PA3") 1281, and a seventh power amplifier ("$7^{th}$ PA3") 1282. In this example, the $1^{st}$ PA3 1276 is in signal communication with the second end 1274 of the $6^{th}$ CC 1214 and the $6^{th}$ HA3 1226 and the $2^{nd}$ PA3 1277 is in signal communication with the first end 1262 of the $6^{th}$ CC 1214 and the $6^{th}$ HA3 1226. In this example there are a total of twelve (12) power amplifiers but because of the example views shown, only the $1^{st}$ PA3 1276, $2^{nd}$ PA3 1277, $3^{rd}$ PA3 1278, $4^{th}$ PA3 1279, $5^{th}$ PA3 1280, $6^{th}$ PA3 1281, and the $7^{th}$ PA3 1282 are shown visible in FIGS. 12D and 12E as a result of the remaining power amplifiers being visually blocked. It is appreciated by those of ordinary skill in the art that while only one combination of $6^{th}$ CC 1214, $6^{th}$ HA3 1226, $1^{st}$ PA3 1276, $2^{nd}$ PA3 1277, and straight feed waveguide 1202 is shown, this combination is also representative of the other cross-couplers, plurality of power amplifiers, and horn antennas.

Turning to FIG. 12C, a plurality of pairs of planar coupling slots 1283, 1284, 1285, 1286, 1287, and 1288 are shown feed cut into the waveguide wall 1228 along the length 1230 of the straight feed waveguide 1202. In this example, the planar coupling slots are cut into the feed waveguide wall 1228 of the straight feed waveguide 1202 and each pair of planar coupling slots (of the plurality of pairs of planar coupling slots 1283, 1284, 1285, 1286, 1287, and 1288) have a pair of planar coupling slots that are spaced 1290 approximately a quarter-wavelength apart. The planar coupling slots are radiating slots that radiate energy out from the straight feed waveguide 1202. In this example, while FIG. 11C shows each planar coupling slots of the plurality of pairs of planar coupling slots 1283, 1284, 1285, 1286, 1287, and 1288 as crossed slots, it is appreciated by those of ordinary skill in the art that each planar coupling slot may have a geometry that is chosen as a slot, crossed-slot, circular orifices, or other type of aperture capable of electromagnetically coupling energy from the straight feed waveguide 1202 to the plurality of pairs of planar coupling slots 1283, 1284, 1285, 1286, 1287, and 1288.

Similar to the previous examples, each cross-coupler (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) utilizes a pair of planar coupling slots from the plurality of pair of planar coupling slots 1283, 1284, 1285, 1286, 1287, and 1288 located and cut into the broad-wall of the cross-couplers (i.e., $1^{st}$ CC 1204, $2^{nd}$ CC 1206, $3^{rd}$ CC 1208, $4^{th}$ CC 1210, $5^{th}$ CC 1212, and $6^{t1}$ CC 1214) and the corresponding portion of the broad-wall (i.e., the feed waveguide wall 1228) of the straight feed waveguide 1202 that is adjacent to the broad-wall of the respective the $1^{st}$ CC 1204, $2^{nd}$ CC 1206, $3^{rd}$ CC 1208, $4^{th}$ CC 1210, $5^{th}$ CC 1212, and $6^{th}$ CC 1214.

In an example of operation, the feed waveguide 1202 acts as traveling wave straight line array feeding the $1^{st}$ CC 1204, $2^{nd}$ CC 1206, $3^{rd}$ CC 1208, $4^{th}$ CC 1210, $5^{th}$ CC 1212, and $6^{th}$ CC 1214. The AAS 1200 receives the first input signal 1240 and the second input signal 1242. Both the first input signal 1240 and second input signal 1242 may be $TE_{10}$, or $TE_{01}$, mode propagated signals. The first input signal 1240 is input into the first feed waveguide input 1232 at the first end 1234 of the straight feed waveguide 1202 and the second input signal 1242 is input into the second feed waveguide input 1236 at the second end 1238 of the straight feed waveguide 1202. In this example, both the first input signal 1240 and second input signal 1242 propagate along the direction of the Y 1248 coordinate axis into opposite ends of the straight feed waveguide 1202.

Once in the straight feed waveguide 1202, the first input signal 1240 and second input signal 1242 propagate along the straight feed waveguide 1202 in opposite directions coupling parts of their respective energies into the different cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214). Since the first input signal 1240 and second input signal 1242 are traveling wave signals that are travelling in opposite directions along the feed waveguide length 1230 of the straight feed waveguide 1202, they will have a phase delay of about 180 degrees relative to each other at any given point within the straight feed waveguide 1202. In general, the feed waveguide length 1230 of the straight feed waveguide 1202 is several wavelengths long (of the operating wavelength of the first input signal 1240 and second input signal 1242) so as to be long enough to create a length (not shown) between the pairs of planar coupling slots 1283, 1284, 1285, 1286, 1287, and 1288 that is also multiple wavelengths of the operating wavelengths of the first input signal 1240 and second input signal 1242. The reason for this length between pairs of planar coupling slots 1283, 1284, 1285, 1286, 1287, and 1288 is to create a phase increment needed for beam steering the antenna beam (not shown) of the AAS 1200 as a function of frequency. As an example, the length between the pairs of planar coupling slots 1283, 1284, 1285, 1286, 1287, and 1288 may be between 5 to 7 wavelengths long. It is appreciated by those or ordinary skill in the art that in this example, the operation frequency of the first input signal 1240 and second input signal 1242 may be much higher than the operating frequencies described with relation to the examples shown in FIGS. 1 through 11. For example, the operating frequency of the first input signal 1240 and second input signal 1242 may be within the Q-band range of frequencies (i.e., between approximately 33 to 50 Ghz).

Similar to the previous examples, in this example, as the first input signal 1240 travels from the first end 1234 to the second end 1238 of the straight feed waveguide 1202, the first input signal 1240 successively couples a portion of its energy to each cross-coupler (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) until the a first remaining signal 1292 of the remaining energy (if any) is outputted from the second end 1238 of the straight feed waveguide 1202. Similarly, as the second input signal 1242 travels in the opposite direction from the second end 1238 to the first end 1234 of the straight feed waveguide 1202, the second input signal 1242 successively couples a portion of its energy to each cross-coupler (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) until a second remaining signal 1294 of the remaining energy (if any) of the second input signal 1242 is outputted from the first end 1234 of the straight feed waveguide 1202. It is appreciated by those of ordinary skill in the art that by optimizing the design of the cross-coupler i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214), the first remaining signal 1292 and second remaining signal 1294 both may be reduced to close to or approximately zero.

Specifically, in this example, when the first input signal 1240 travels along the straight feed waveguide 1202, it will couple a first portion of it energy to the $1^{st}$ CC 1204, which will pass this first coupled output signal to the $1^{st}$ HA3 1216. The remaining portion of the first input signal 1240 will then travel along the straight feed waveguide 1202 to the $2^{nd}$ CC 1206 where it will couple another portion of it energy to the $2^{nd}$ CC 1206, which will pass this second coupled output signal to the $2^{nd}$ HA3 1218. This process will continue such that another portion of the first input signal 1240 will be coupled to the $3^{rd}$ CC 1208, $4^{th}$ CC 1210, $5^{th}$ CC 1212, and $6^{th}$ CC 1214 and passed to the $3^{rd}$ HA3 1220, $4^{th}$ HA3 1222, $5^{th}$ HA3 1224, and $6^{th}$ HA3 1226, respectively. The remaining portion of the first input signal 1240 will then be output from the second end 1238 of the straight feed waveguide 1202 as the first remaining signal 1292. Similarly, when the second input signal 1242 travels along the straight feed waveguide 1202, it will couple a first portion of it energy to the $6^{th}$ CC 1214, which will pass this first coupled output signal to the $6^{th}$ HA3 1226. The remaining portion of second input signal 1242 will then travel along the straight feed waveguide 1202 to the $5^{th}$ CC 1212 where it will couple another portion of its energy to the $5^{th}$ CC 1212, which will pass this second coupled output signal to the $5^{th}$ HA3 1224. This process will continue such that another portion of the second input signal 1242 will be coupled to cross-couplers $4^{th}$ CC 1210, $3^{rd}$ CC 1208, $2^{nd}$ CC 1206, and $1^{st}$ CC 1204 and passed to the $4^{th}$ HA3 1222, $3^{rd}$ HA3 1220, $2^{nd}$ HA3 1218, and $1^{st}$ HA3 1216, respectively. The remaining portion of the second input signal 1242 will then be output from the first end 1234 of the straight feed waveguide 1202 as the second remaining signal 1294.

Again, it is appreciated by those of ordinary skill in the art that a first circulator, or other isolation device, (not shown) may be connected to the first end 1234 to isolate the first input signal 1240 from the outputted second remaining signal 1294 and a second circulator, or other isolation device, (not shown) may be connected to the second end 1238 to isolate the second input signal 1242 from the outputted first remaining signal 1292. It is also appreciated that the amount of coupled energy from the straight feed waveguide 1202 to the respective the $1^{st}$ CC 1204, $2^{nd}$ CC 1206, $3^{rd}$ CC 1208, $4^{th}$ CC 1210, $5^{th}$ CC 1212, and $6^{th}$ CC 1214 is determined by predetermined design choices that will yield the desired radiation antenna pattern of the AAS 1200. It is further appreciated that the feed waveguide 1202 is constructed of a conductive material such as metal and defines a rectangular tube that that has an internal cavity running the feed waveguide length 1230 of the straight feed waveguide 1202 that may be filled with air, dielectric material, or both.

In summary, in this example, an AAS 1200 for directing and steering an antenna beam is disclosed. The AAS 1200 includes: a straight feed waveguide 1202 having a feed waveguide wall 1228, a feed waveguide length 1230, a first feed waveguide input 1232 at a first end 1234 of the straight feed waveguide 1202, and a second feed waveguide input 1236 at a second end 1238 of the straight feed waveguide 1202; a plurality of cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214) in signal communication with the straight feed waveguide 1202; and a plurality of horn antennas (i.e., $1^{st}$ HA3 1216, $2^{nd}$ HA3 1218, $3^{rd}$ HA3 1220, $4^{th}$ HA3 1222, $5^{th}$ HA3 1224, and $6^{th}$ HA3 1226) in signal communication with the plurality of cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214). The straight feed waveguide 1202 is configured to receive a first input signal 1240 at the first feed waveguide input 1232 and a second input signal 1242 at the second feed waveguide input 1236. Each horn antenna is in signal communication with a corresponding cross-coupler and each horn antenna is configured to produce a first polarized signal from the received first input signal 1240 and a second polarized signal from the received second input signal 1242. In this example, the first polarized signal is cross polarized with the second polarized signal.

The AAS 1200 further includes a plurality of pairs of planar coupling slots 1283, 1284, 1285, 1286, 1287, and 1288 along the straight feed waveguide length 1230, where a first pair of planar coupling slots, of the plurality of pairs of planar coupling slots 1283, 1284, 1285, 1286, 1287, and 1288, corresponds to a first cross-coupler, of the plurality of cross-couplers (i.e., $1^{st}$ CC 1204, $2^{nd}$ CC 1206, $3^{rd}$ CC 1208, $4^{th}$ CC 1210, $5^{th}$ CC 1212, and $6^{th}$ CC 1214), and a second pair of planar coupling slots corresponds to a second cross-coupler.

The first pair of planar coupling slots are cut into the feed waveguide wall 1228 of the straight feed waveguide 1202 and an adjacent bottom wall of the first cross-coupler and the second pair of planar coupling slots are cut into the feed waveguide wall 1228 of the straight feed waveguide 1202 and an adjacent bottom wall of the second cross-coupler. A first planar coupling slot and a second planar coupling slot, of the first pair of planar coupling slots, are positioned approximately a quarter-wavelength apart and a first planar coupling slot and a second planar coupling slot, of the second pair of planar coupling slots, are positioned approximately a quarter-wavelength apart. The first planar coupling slot and the second planar coupling slot have a geometry that may be chosen from the group consisting of a slot, crossed-slot, and circular orifices. The straight feed waveguide may be a rectangular waveguide having a broad-wall and a narrow-wall.

The AAS 1200 may further include the plurality of power amplifiers (that include $1^{st}$ PA3 1276, $2^{nd}$ PA3 1277, $3^{rd}$ PA3 1278, $4^{th}$ PA3 1279, $5^{th}$ PA3 1280, $6^{th}$ PA3 1281, and a $7^{th}$ PA3 1282), where: a first power amplifier, of the plurality of power amplifiers, is in signal communication with the first cross-coupler and the first horn antenna and is configured to amplify the first coupled signal from the first cross-coupler; a second power amplifier, of the plurality of power amplifiers, is in signal communication with the first cross-coupler and the first horn antenna and is configured to amplify the second coupled signal from the first directional coupler; a third power amplifier, of the plurality of power amplifiers, is in signal communication with the second cross-coupler and the second horn antenna and is configured to amplify the first coupled signal from the second cross-coupler; and a fourth power amplifier, of the plurality of power amplifiers, is in signal communication with the second cross-coupler and the second horn antenna and is configured to amplify the second coupled signal from the second cross-coupler.

The AAS 1200 may further include a first septum polarizer (similar to 710 in FIG. 7) in the first horn antenna and a second septum polarizer in the second horn antenna. The first horn antenna is configured to produce a first polarized signal from the received first coupled signal and a second polarized signal from the received second coupled signal and the second horn antenna is configured to produce a first polarized signal from the received first coupled signal and a second polarized signal from the received second coupled signal. The first polarized signal of the first horn antenna is a first circularly polarized signal of the first horn antenna and the second polarized signal of the first horn antenna is a second circularly polarized signal of the first horn antenna. The first polarized signal of the second horn antenna is a first circularly polarized signal of the second horn antenna and the second polarized signal of the second horn antenna is a second circularly polarized signal of the second horn antenna. The first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna. Moreover, the first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

The AAS 1200 may further include a first circulator (not shown) and a second circulator (not shown), wherein the first circulator is in signal communication with the first feed waveguide input 1232 and the second circulator is signal communication with the second feed waveguide input 1236. Furthermore, the AAS 1200 may further include a reflector in signal communication with the even plurality of horn antennas.

In an example of operation, the AAS 1200 performs a method for directing and steering an antenna beam. The method includes receiving the first input signal 1240 at the first feed waveguide input 1232 and the second input signal 1242 at the second feed waveguide input 1236, where the second input signal 1242 is propagating in the opposite direction of the first input signal 1240 along the straight feed waveguide 1202. The AAS 1200 then couples the first input signal 1240 to a first cross-coupler, of the at least two cross-couplers (of the plurality of cross-couplers—$1^{st}$ CC 1204, $2^{nd}$ CC 1206, $3^{rd}$ CC 1208, $4^{th}$ CC 1210, $5^{th}$ CC 1212, and $6^{th}$ CC 1214), where the first cross-coupler produces a first coupled output signal of the first cross-coupler, and couples the first input signal 1240 to a second cross-coupler, of the at least two cross-couplers, where the second cross-coupler produces a first coupled output signal of the second cross-coupler. The AAS 1200 also couples the second input signal 1242 to the second cross-coupler, where the second cross-coupler produces a second coupled output signal of the second cross-coupler, and couples the second input signal 1242 to the first cross-coupler, where the first cross-coupler produces a second coupled output signal of the first cross-coupler. The AAS 1200 then radiates a first polarized signal from a first horn antenna, of the at least two horn antennas (of the plurality of horn antennas), in response to the first horn antenna receiving the first coupled output signal of the first cross-coupler and radiates a second polarized signal from the first horn antenna, in response to the first horn antenna receiving the second coupled output signal of the first cross-coupler. The AAS 1200 also radiates a first polarized signal from a second horn antenna, of the at least two horn antennas, in response to the second horn antenna receiving the second coupled output signal of the second cross-coupler and radiates a second polarized signal from the second horn antenna, in response to the second horn antenna receiving the second coupled output signal of the second cross-coupler. As discussed earlier, the first polarized signal of the first horn antenna is cross polarized with the second polarized signal of the first horn antenna and the first polarized signal of the second horn antenna is cross polarized with the second polarized signal of the second horn antenna, and the first polarized signal of the first horn antenna is polarized in the same direction as the first polarized signal of the second horn antenna and second polarized signal of the first horn antenna is polarized in the same direction as the second polarized signal of the second horn antenna.

The method may further include amplifying the first coupled output signals from both the first and second cross-couplers and the second coupled output signals from both the first and second cross-couplers, where the first input signal 1240 and second input signal 1242 may be $TE_{10}$ mode signals propagating in opposite directions through the straight feed waveguide 1202. The method may also further include: amplifying the first coupled output signal of the first cross-coupler with a first power amplifier; amplifying the first coupled output signal of the second cross-coupler with a second power amplifier; amplifying the second coupled output signal of the second cross-coupler with a third power amplifier; and amplifying the second coupled output signal of the first cross-coupler with a fourth power amplifier.

Similar to the examples shown with regards to FIGS. 1 through 11, in this example, the AAS 1200 also may be utilized to steer an antenna beam by frequency utilizing a single input (either first input signal 1240 or second input signal 1242) or by utilizing a given frequency by feeding both ends with first input signal 1240 and second input signal 1242.

Also an alternative to utilizing a horn antenna with the septum polarizer 710 is to adjust the relative phase between the first input signal 1240 and second input signal 1242 in such a way that each directional coupler output runs to a single mode horn antenna (not a septum polarizer fed horn as shown in FIGS. 7A and 7B). In this example, there would be two arrays of horn antennas instead of one (as shown in FIGS. 12A through 12E). In this example, a first array of horn antennas excited by the first input signal 1240 may run parallel to a second array of horn antennas excited by the second input signal 1242.

Figure 12F:
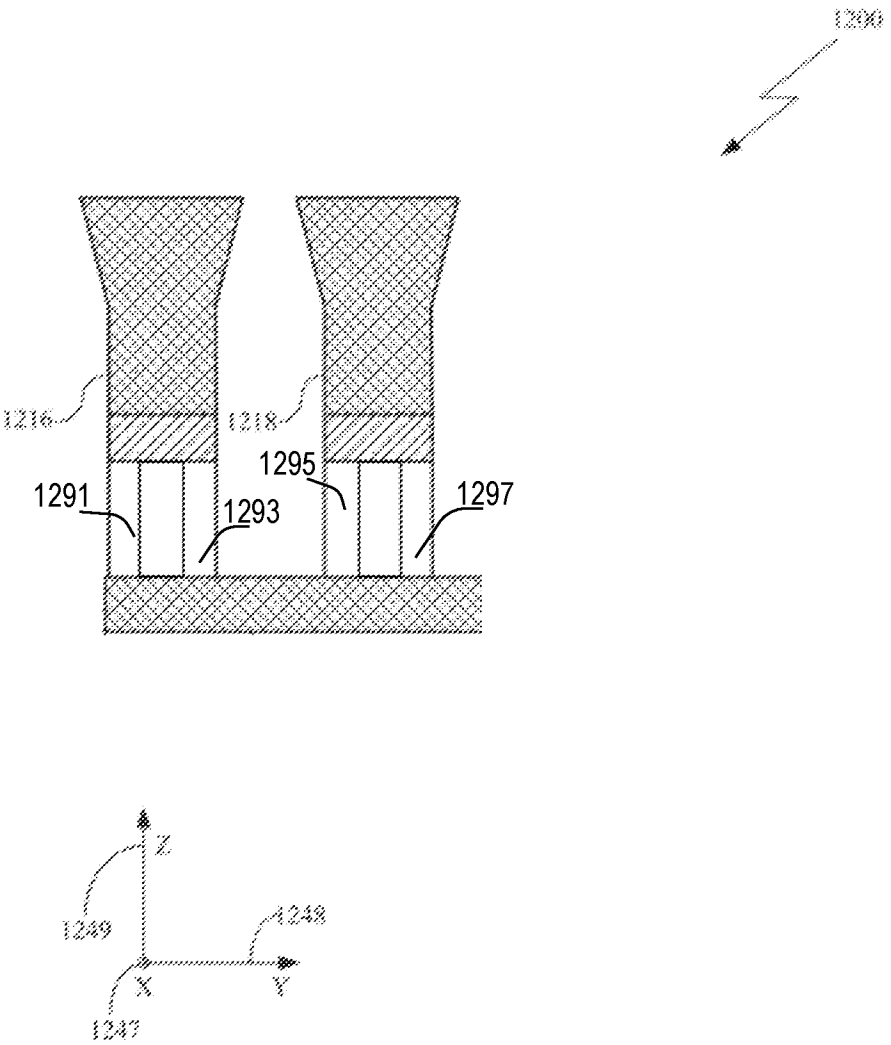
FIG. 12F is a front view of another implementation of the AAS shown in FIGS. 12A through 12E in accordance with the present disclosure.

FIG. 12F shows another implementation of the AAS 1200 in accordance with the present disclosure. In the embodiment of 12F, the first horn antenna 1216 is configured to receive the coupled signal from a first cross-coupler 1291 and the coupled signal from a second cross-coupler 1293. The first horn antenna 1216 is configured to produce a first circularly polarized signal from the received coupled signal from the first cross-coupler 1291 and a second circularly polarized signal from the received coupled signal from the second cross-coupler 1293. The second horn antenna 1218 is in signal communication with a third cross-coupler 1295 and a fourth cross-coupler 1297. The second horn antenna 1218 is configured to produce a first circularly polarized signal from the received coupled signal from the third cross-coupler 1295 and a second circularly polarized signal from the received coupled signal from the fourth cross-coupler 1297. The first cross-coupler corresponds to a first pair of planar coupling slots (e.g., planar coupling slots 1283). The second cross-coupler corresponds to a second pair of planar coupling slots (e.g., planar coupling slots 1284). The third cross-coupler corresponds to a third pair of planar coupling slots (e.g., planar coupling slots 1285). The fourth cross-coupler corresponds to a fourth pair of planar coupling slots (e.g., planar coupling slots 1286). The first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna. The first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

Figure 13:
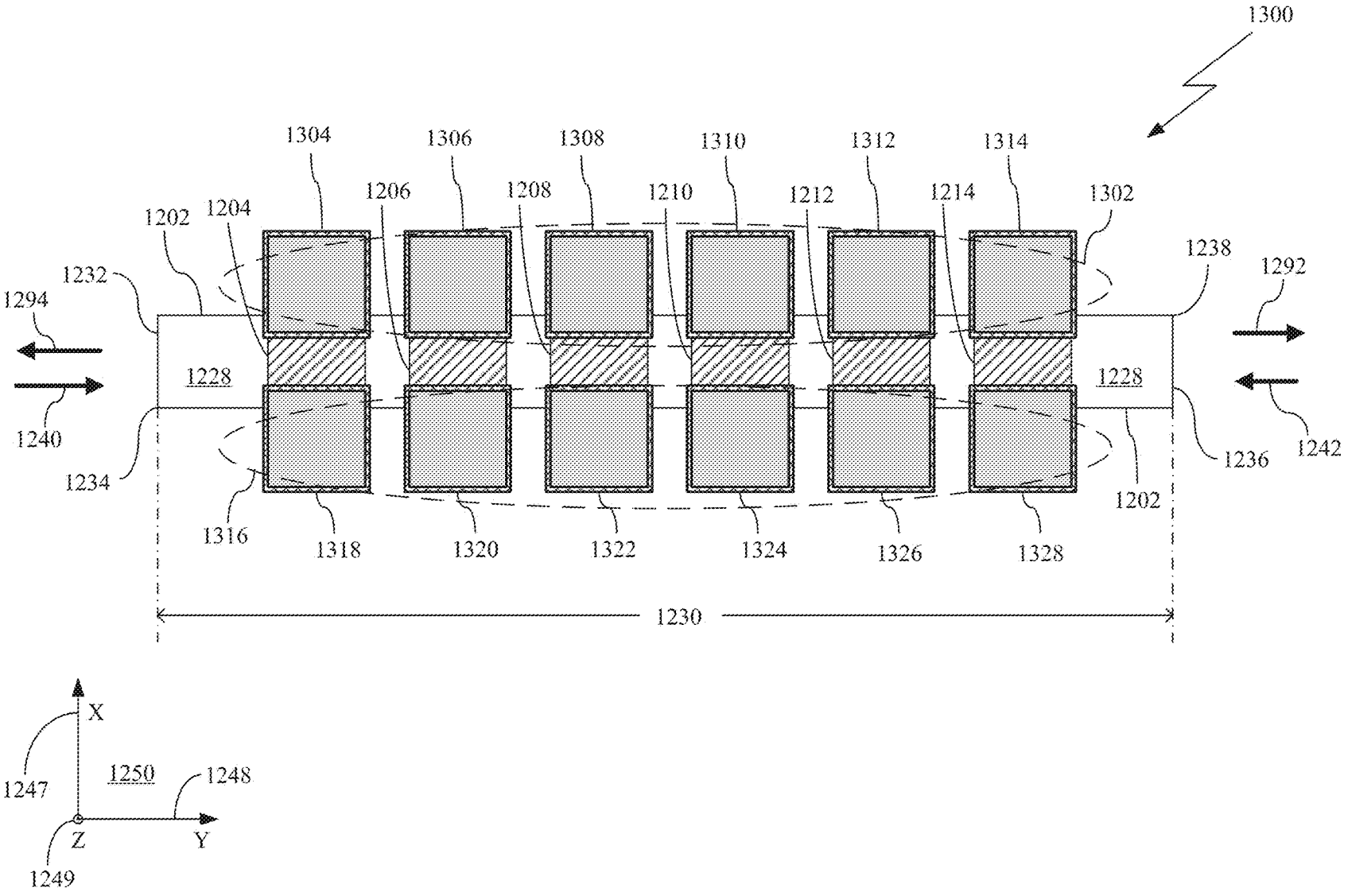
FIG. 13 is a top view of an example of an implementation of yet another AAS in accordance with the present disclosure.

Specifically, turning to FIG. 13, a top view is shown of an example of another implementation of the AAS 1300 in accordance with the present disclosure. In this example, the AAS 1300 includes a first array 1302 of horn antennas (i.e., the first sub-plurality of horn antennas) excited by the first input signal 1240 may run parallel to a second array 1316 of horn antennas (i.e., the second sub-plurality of horn antennas) excited by the second input signal 1242. In this example, the first array 1302 of horn antennas includes a first single mode horn antenna of the first array ("$1^{st}$ SMHAFA2") 1304, a second single mode horn antenna of the first array ("$2^{nd}$ SMHAFA2") 1306, a third single mode horn antenna of the first array ("$3^{rd}$ SMHAFA2") 1308, a fourth single mode horn antenna of the first array ("$4^{th}$ SMHAFA2") 1310, a fifth single mode horn antenna of the first array ("$5^{th}$ SMHAFA2") 1312, and a sixth single mode horn antenna of the first array ("$6^{th}$ SMHAFA2") 1314. Similarly, the second array 1316 of horn antennas includes a first single mode horn antenna of the second array ("$1^{st}$ SMHASA2") 1318, a second single mode horn antenna of the second array ("$2^{nd}$ SMHASA2") 1320, a third single mode horn antenna of the second array ("$3^{rd}$ SMHASA2") 1322, a fourth single mode horn antenna of the second array ("$4^{th}$ SMHASA2") 1324, a fifth single mode horn antenna of the second array ("$5^{th}$ SMHASA2") 1326, and a sixth single mode horn antenna of the second array ("$6^{th}$ SMHASA2") 1328. Furthermore, in this example, the $1^{st}$ SMHAFA 1304 and $1^{st}$ SMHASA 1318 is in signal communication with the $1^{st}$ CC 1204, $2^{nd}$ SMHAFA 1306 and $2^{nd}$ SMHASA 1320 is in signal communication with the $2^{nd}$ CC 1206, $3^{rd}$ SMHAFA 1308 and $3^{rd}$ SMHASA 1322 is in signal communication with the $3^{rd}$ CC 1208, $4^{th}$ SMHAFA 1310 and $4^{th}$ SMHASA 1324 is in signal communication with the $4^{th}$ CC 1210, $5^{th}$ SMHAFA 1312 and $5^{th}$ SMHASA 1326 is in signal communication with the $5^{th}$ CC 1212, $6^{th}$ SMHAFA 1314 and $6^{th}$ SMHASA 1328 is in signal communication with the $6^{th}$ CC 1214. The first array of horn antennas (i.e., $1^{st}$ SMHAFA 1304, $2^{nd}$ SMHAFA 1306, $3^{rd}$ SMHAFA 1308, $4^{th}$ SMHAFA 1310, $5^{th}$ SMHAFA 1312, and $6^{th}$ SMHAFA 1314) are excited by the first input signal 1240 and the second array of horn antennas (i.e., $1^{st}$ SMHASA 1318, $2^{nd}$ SMHASA 1320, $3^{rd}$ SMHASA 1322, $4^{th}$ SMHASA 1324, $5^{th}$ SMHASA 1326, and $6^{th}$ SMHASA 1328) are excited by the second input signal 1242.

Figure 14:
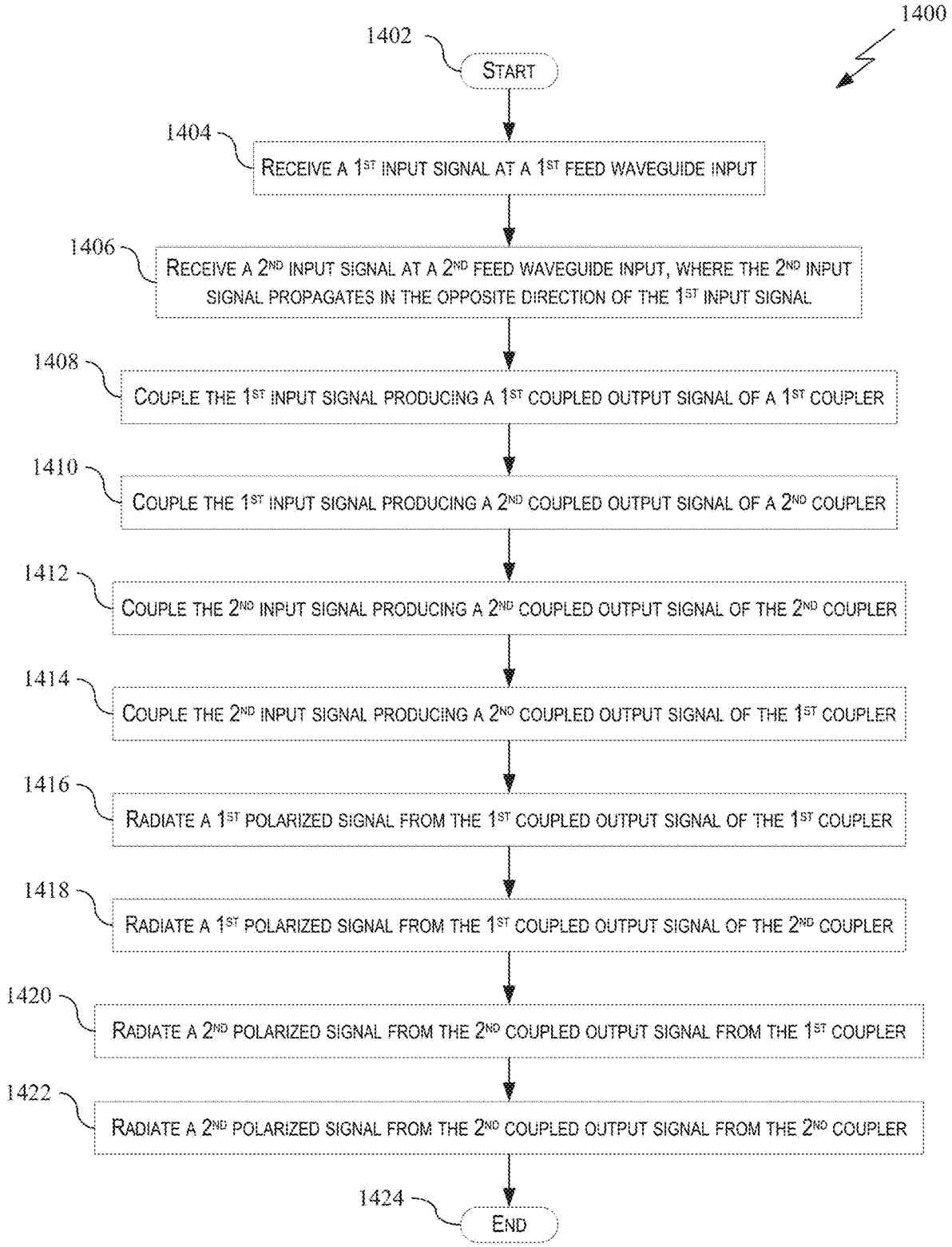
FIG. 14 is flowchart describing an example of an implementation of a method performed by the AAS shown in FIGS. 1-13 in accordance with the present disclosure.

FIG. 14 is flowchart describing an example of an implementation of a method performed by the AAS shown in FIGS. 1-13 in accordance with the present disclosure. In this example, the method 1400 includes receiving 1404 a first input signal at the first feed waveguide input and a second input signal 186 at the second feed waveguide input, wherein the second input signal is propagating in the opposite direction of the first input signal. The AAS then couples 1408 the first input signal to a first cross-coupler, of at least two cross-couplers, wherein the first cross-coupler produces a first coupled output signal of the first cross-coupler, couples 1410 the first input signal to a second cross-coupler, of the at least two cross-couplers, wherein the second cross-coupler produces a first coupled output signal of the second cross-coupler, couples 1412 the second input signal to the second cross-coupler, wherein the second cross-coupler produces a second coupled output signal of the second cross-coupler, and couples 1414 the second input signal to the first cross-coupler, wherein the first cross-coupler produces a second coupled output signal of the first cross-coupler. The AAS then radiates 1416 a first polarized signal from a first horn antenna, of the at least two horn antennas, in response to the first horn antenna receiving the first coupled output signal of the first cross-coupler, radiates 1418 a second polarized signal from the first horn antenna, in response to the first horn antenna receiving the second coupled output signal of the first cross-coupler, radiates 1420 a first polarized signal from a second horn antenna, of the at least two horn antennas, in response to the second horn antenna receiving the second coupled output signal of the second cross-coupler, and radiates 1422 a second polarized signal from the second horn antenna, in response to the second horn antenna receiving the second coupled output signal of the second cross-coupler. In this example, the first polarized signal of the first horn antenna is cross polarized with the second polarized signal of the first horn antenna and the first polarized signal of the second horn antenna is cross polarized with the second polarized signal of the second horn antenna and the first polarized signal of the first horn antenna is polarized in the same direction as the first polarized signal of the second horn antenna and second polarized signal of the first horn antenna is polarized in the same direction as the second polarized signal of the second horn antenna. The method then ends 1424.

In this example, the method may further include amplifying the first coupled output signals from both the first and second cross-couplers and the second coupled output signals from both the first and second cross-couplers. Moreover, the first input signal and second input signal may be $TE_{10}$ mode signals propagating in opposite directions through the straight feed waveguide. The method may further includes amplifying the first coupled output signal of the first cross-coupler with a first power amplifier, amplifying the first coupled output signal of the second cross-coupler with a second power amplifier, amplifying the second coupled output signal of the second cross-coupler with a third power amplifier, and amplifying the second coupled output signal of the first cross-coupler with a fourth power amplifier.

Figure 15:
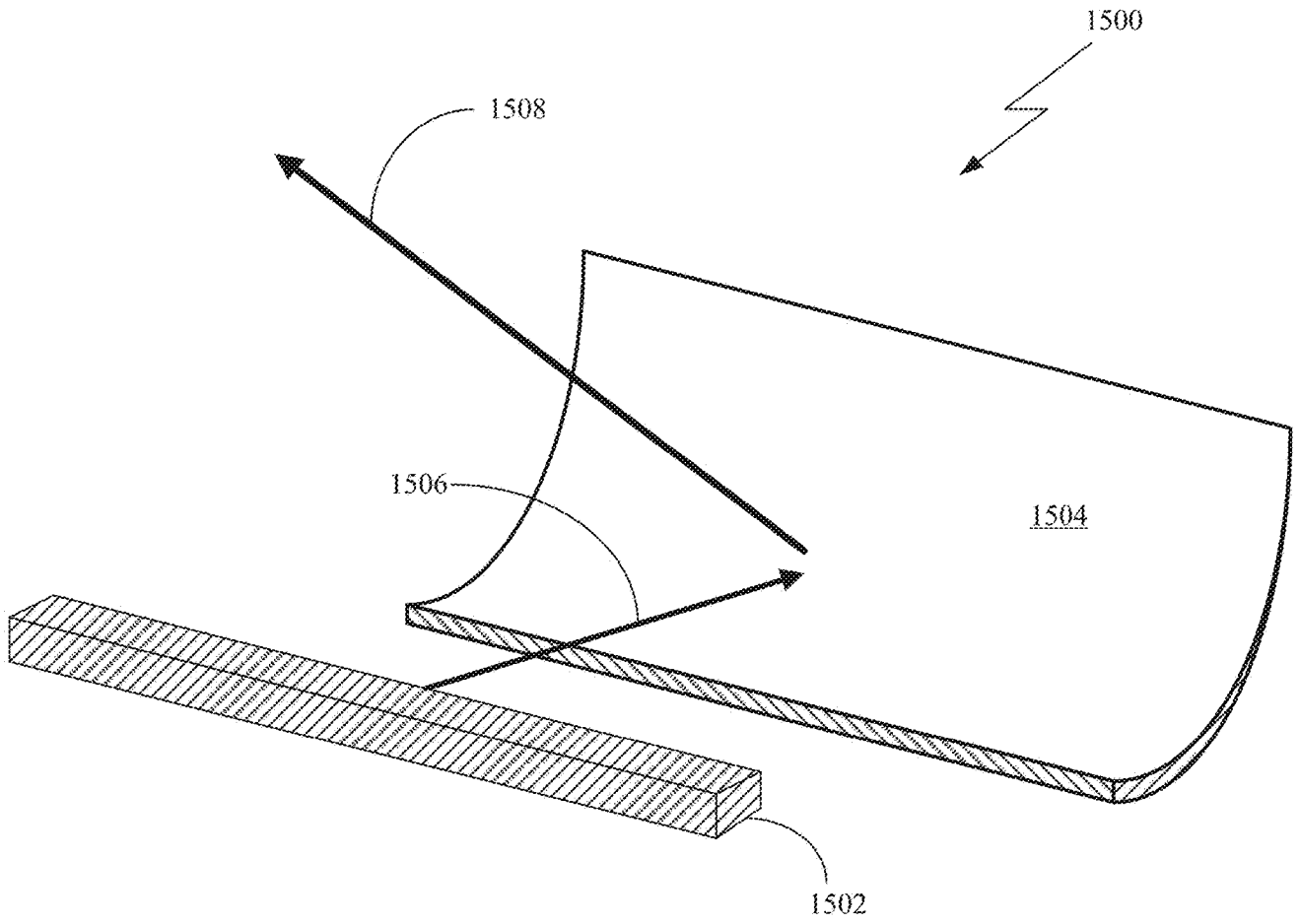
FIG. 15 is a prospective view of an example of an implementation of a reflector antenna system in accordance with the present disclosure.

As a further example of operation, the first, second, and third implementations of the AAS may be utilized as standalone antenna systems (i.e., direct radiation system) or as part of a reflector antenna system. Turning to FIG. 15, a prospective view of an example of an implementation of a reflector antenna system 1500 is shown in accordance with the present disclosure. The reflector antenna system 1500 may include an AAS 1502 and a cylindrical reflector element 1504. The AAS 1502 may be either the first implementation of the AAS 100 (shown in FIGS. 1-6), the second implementation of the AAS 900 (shown in FIG. 9), the third implementation of the AAS 1000 (shown in FIGS. 10A and 10B), the fourth implementation of the AAS 1200 (shown in FIGS. 12A-12E), or the fifth implementation of the AAS 1300 (shown in FIG. 13). In operation, the AAS 1502 acts a feed array for the reflector element 1504 and directs radiation 1506 towards the reflector element 1504 that is in turn reflected into free space to form the antenna beam 1508 of the reflector antenna system 1500. The reflector antenna system 1500 may be used for many different applications. Again, it is appreciated by those skilled in the art that the reflector antenna system 1500 is an optional implementation of the AAS. Another example (not shown), is includes the AAS utilized as a standalone antenna system that is a direct radiation system without a reflector system.

Figure 16:
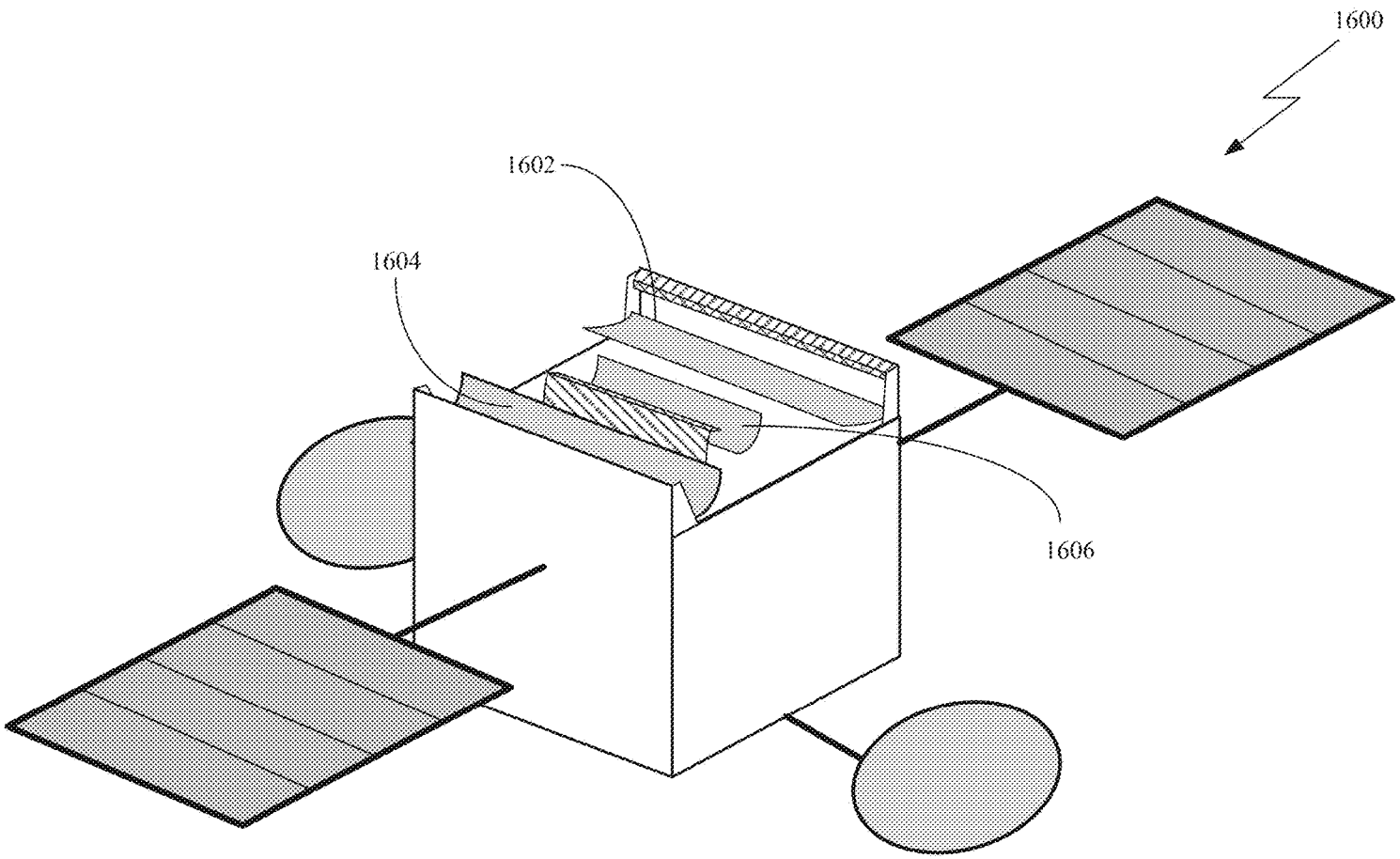
FIG. 16 is a perspective view of a communication satellite utilizing the reflector antenna system shown in FIG. 12.

In FIG. 16, a perspective view of a communication satellite 1600 is shown utilizing the reflector antenna system shown in FIG. 15. In this example, the communication satellite 1600 may include two reflector antenna systems 1602 and 1604 for transmission and a signal reflector antenna system 1606 for reception.

In summary, the AAS 100, 900, 1000, 1200, and 1502 may be utilized to: 1) beam steer a circularly polarized beam by frequency if the AAS 100, 900, 1000, 1200, and 1502 is fed on one end where each directional coupler (including cross-coupler) arm leads to a radiating element such as, for example, the horn antenna shown in FIGS. 7A and 7B; 2) beam steer by frequency a linear beam, if the AAS 100, 900, 1000, 1200, and 1502 is fed on one end (118 and 122, 1066 and 1070, or 1234 and 1238, respectively) where each directional coupler (including cross-coupler) arm leads to a single mode horn antenna; 3) beam steer a circularly polarized beam by relative phase between the first input signal 184 or 1240 and second input signal 186 or 1242, respectively, or by frequency, if the AAS 100, 900, 1000, 1200, and 1502 is fed on both ends, where each directional coupler arm leads to one of two arrays of horn antennas; and 4) beam steer by relative phase difference between the first input signal 184 or 1240 and second input signal 186 or 1242, respectively, or by frequency, if the AAS 100, 900, 1000, 1200, and 1502 is fed feed on both ends, where each directional coupler arm leads to one of two arrays of horn antennas.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. An antenna array system ("AAS") for directing and steering an antenna beam, the AAS comprising:

a straight feed waveguide having a feed waveguide wall, a feed waveguide length, a first feed waveguide input at a first end of the straight feed waveguide, and a second feed waveguide input at a second end of the straight feed waveguide, wherein the straight feed waveguide is configured to receive a first input signal at the first feed waveguide input and to receive a second input signal at the second feed waveguide input;

a plurality of cross-couplers in signal communication with the straight feed waveguide including a first cross-coupler, a second cross-coupler, a third cross-coupler, and a fourth cross-coupler;

a plurality of pairs of planar coupling slots along the feed waveguide length, wherein a first pair of planar coupling slots, of the plurality of pairs of planar coupling slots, corresponds to the first cross-coupler, a second pair of planar coupling slots corresponds to the second cross-coupler, a third pair of planar coupling slots corresponds to the third cross-coupler, and a fourth pair of planar coupling slots corresponds to the fourth cross-coupler; and a plurality of horn antennas in signal communication with the plurality of cross-couplers, wherein a first horn antenna of the plurality of horn antennas is in signal communication with the first cross-coupler and the second cross-coupler, wherein a second horn antenna of the plurality of horn antennas is in signal communication with the third cross-coupler and the fourth cross-coupler, wherein the plurality of horn antennas are configured to produce a first polarized signal from the received first input signal and a second polarized signal from the received second input signal, and wherein the first polarized signal is cross polarized with the second polarized signal.

2. The AAS of claim 1, wherein the straight feed waveguide is a rectangular waveguide having a broad-wall and a narrow-wall.

3. The AAS of claim 1, wherein each horn antenna is configured to produce the first polarized signal from the received first input signal and the second polarized signal from the received second input signal, and wherein the first polarized signal is cross polarized with the second polarized signal.

4. The AAS of claim 3, wherein the first pair of planar coupling slots are cut into the feed waveguide wall of the straight feed waveguide and an adjacent bottom wall of the first cross-coupler and the second pair of planar coupling slots are cut into the feed waveguide wall of the straight feed waveguide and an adjacent bottom wall of the second cross-coupler, and wherein the third pair of planar coupling slots are cut into the feed waveguide wall of the straight feed waveguide and an adjacent bottom wall of the third cross-coupler and the fourth pair of planar coupling slots are cut into the feed waveguide wall of the straight feed waveguide and an adjacent bottom wall of the fourth cross-coupler.

5. The AAS of claim 4, wherein the first horn antenna is configured to receive a first coupled signal from the first cross-coupler and a second coupled signal from the second cross-coupler and the second horn antenna is configured to receive a third coupled signal from the third cross-coupler and a fourth coupled signal from the fourth cross-coupler, the first coupled signal corresponding to the third coupled signal, and the second coupled signal corresponding to the fourth coupled signal, wherein the first horn antenna is configured to produce a first polarized signal of the first horn antenna from the received first coupled signal and a second polarized signal of the first horn antenna from the received second coupled signal and the second horn antenna is configured to produce a first polarized signal of the second horn antenna from the received first coupled signal and a second polarized signal of the second horn antenna from the received second coupled signal, wherein the first polarized signal of the first horn antenna is cross polarized with the second polarized signal of the first horn antenna and the first polarized signal of the second horn antenna is cross polarized with the second polarized signal of the second horn antenna, and wherein the first polarized signal of the first horn antenna is polarized in the same direction as the first polarized signal of the second horn antenna and second polarized signal of the first horn antenna is polarized in the same direction as the second polarized signal of the second horn antenna.

6. The AAS of claim 5, further including a plurality of power amplifiers, wherein a first power amplifier, of the plurality of power amplifiers, is in signal communication with the first cross-coupler and the first horn antenna and is configured to amplify the first coupled signal from the first cross-coupler, wherein a second power amplifier, of the plurality of power amplifiers, is in signal communication with the second cross-coupler and the first horn antenna and is configured to amplify the second coupled signal from the first cross-coupler, wherein a third power amplifier, of the plurality of power amplifiers, is in signal communication with the third cross-coupler and the second horn antenna and is configured to amplify the first coupled signal from the second cross-coupler, and wherein a fourth power amplifier, of the plurality of power amplifiers, is in signal communication with the fourth cross-coupler and the second horn antenna and is configured to amplify the second coupled signal from the second cross-coupler.

7. The AAS of claim 6, wherein a first planar coupling slot and a second planar coupling slot, of the first pair of planar coupling slots, are positioned a quarter-wavelength apart and wherein a first planar coupling slot and a second planar coupling slot, of the second pair of planar coupling slots, are positioned a quarter-wavelength apart.

8. The AAS of claim 7, wherein the first planar coupling slot and the second planar coupling slot have a geometry that is chosen from the group consisting of a slot, crossed-slot, and circular orifices.

9. The AAS of claim 2, wherein the feed waveguide wall is the broad-wall.

10. The AAS of claim 5, further including a first septum polarizer in the first horn antenna and a second septum polarizer in the second horn antenna, wherein the first horn antenna is configured to produce a first polarized signal from the received first coupled signal and a second polarized signal from the received second coupled signal and the second horn antenna is configured to produce a first polarized signal from the received first coupled signal and a second polarized signal from the received second coupled signal, wherein the first polarized signal of the first horn antenna is a first circularly polarized signal of the first horn antenna and the second polarized signal of the first horn antenna is a second circularly polarized signal of the first horn antenna, wherein the first polarized signal of the second horn antenna is a first circularly polarized signal of the second horn antenna and the second polarized signal of the second horn antenna is a second circularly polarized signal of the second horn antenna, wherein the first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna, and wherein the first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

11. The AAS of claim 1, further including a first circulator and a second circulator, wherein the first circulator is in signal communication with the first feed waveguide input and the second circulator is signal communication with the second feed waveguide input.

12. The AAS of claim 1, further including a reflector in signal communication with an even plurality of horn antennas.

13. A method for directing and steering an antenna beam utilizing an antenna array system ("AAS") having a straight feed waveguide with a first feed waveguide input, a second feed waveguide input, and a feed waveguide length, at least four cross-couplers in signal communication with the straight feed waveguide, at least four pairs of planar coupling slots along a straight feed waveguide length, and at least two horn antennas, the method comprising:

receiving a first input signal at the first feed waveguide input and a second input signal at the second feed waveguide input, wherein the second input signal is propagating in the opposite direction of the first input signal;

coupling the first input signal to a first cross-coupler, of the at least four cross-couplers, via a first pair of coupling slots, wherein the first cross-coupler produces a first coupled output signal;

coupling the second input signal to a second cross-coupler, of the at least four cross-couplers, via a second pair of coupling slots, wherein the second cross-coupler produces a second coupled output signal;

coupling the first input signal to a third cross-coupler, of the at least four cross-couplers, via a third pair of coupling slots, wherein the third cross-coupler produces a third coupled output signal;

coupling the second input signal to a fourth cross-coupler, of the at least four cross-couplers, via a fourth pair of coupling slots, wherein the fourth cross-coupler produces a fourth coupled output signal;

radiating a first polarized signal from a first horn antenna, of the at least two horn antennas, in response to the first horn antenna receiving the first coupled output signal;

radiating a second polarized signal from the first horn antenna, in response to the first horn antenna receiving the second coupled output signal;

radiating a third polarized signal from a second horn antenna, of the at least two horn antennas, in response to the second horn antenna receiving the third coupled output signal; and radiating a fourth polarized signal from the second horn antenna, in response to the second horn antenna receiving the fourth coupled output signal, wherein the first polarized signal of the first horn antenna is cross polarized with the second polarized signal of the first horn antenna and the third polarized signal of the second horn antenna is cross polarized with the fourth polarized signal of the second horn antenna, and wherein the first polarized signal of the first horn antenna is polarized in the same direction as the third polarized signal of the second horn antenna and second polarized signal of the first horn antenna is polarized in the same direction as the fourth polarized signal of the second horn antenna.

14. The method of claim 13, further including amplifying the first coupled output signal and the second coupled output signal.

15. The method of claim 14, wherein the first input signal and second input signal are $TE_{10}$ mode signals propagating in opposite directions through the straight feed waveguide.

16. The method of claim 13, further including amplifying the first coupled output signal of the first cross-coupler with a first power amplifier, amplifying the second coupled output signal of the second cross-coupler with a second power amplifier, amplifying the third coupled output signal of the third cross-coupler with a third power amplifier, and amplifying the fourth coupled output signal of the fourth cross-coupler with a fourth power amplifier.

17. An AAS for directing and steering an antenna beam, the AAS comprising:

a straight feed waveguide having a feed waveguide wall, a feed waveguide length, a first feed waveguide input at a first end of the straight feed waveguide, and a second feed waveguide input at a second end of the straight feed waveguide, wherein the straight feed waveguide is configured to receive a first input signal at the first feed waveguide input and a second input signal at the second feed waveguide input, and at least four cross-couplers in signal communication with the straight feed waveguide, wherein each cross-coupler, of the at least four cross-couplers, has a bottom wall that is adjacent to the feed waveguide wall of the straight feed waveguide, and wherein each cross-coupler is configured to produce a coupled signal from either the first input signal or the second input signal;

at least four pairs of planar coupling slots along the feed waveguide length, wherein a first pair of planar coupling slots, of the at least four pairs of planar coupling slots, corresponds to a first cross-coupler, of the at least four cross-couplers, a second pair of planar coupling slots, of the at least four pairs of planar coupling slots, corresponds to a second cross-coupler, of the at least four cross-couplers, a third pair of planar coupling slots, of the at least four pairs of planar coupling slots, corresponds to the a third cross-coupler, of the at least four cross-couplers, and a fourth pair of planar coupling slots, of the at least four pairs of planar coupling slots, corresponds to the a fourth cross-coupler, of the at least four cross-couplers, wherein the first pair of planar coupling slots are cut into the feed waveguide wall of the straight feed waveguide and the adjacent bottom wall of the first cross-coupler, the second pair of planar coupling slots are cut into the feed waveguide wall of the straight feed waveguide and the adjacent bottom wall of the second cross-coupler, the third pair of planar coupling slots are cut into the feed waveguide wall of the straight feed waveguide and the adjacent bottom wall of the third cross-coupler, and the fourth pair of planar coupling slots are cut into the feed waveguide wall of the straight feed waveguide and the adjacent bottom wall of the fourth cross-coupler; and at least two horn antennas, wherein a first horn antenna, of the at least two horn antennas, is in signal communication with the first cross-coupler and the second cross-coupler and a second horn antenna, of the at least two horn antennas, is in signal communication with the third cross-coupler and the fourth cross-coupler, wherein the first horn antenna is configured to receive the coupled signal from the first cross-coupler and the coupled signal from the second cross-coupler and the second horn antenna is configured to receive the coupled signal from the third cross-coupler and the coupled signal from the fourth cross-coupler, wherein the first horn antenna is configured to produce a first circularly polarized signal from the received coupled signal from the first cross-coupler and a second circularly polarized signal from the received coupled signal from the second cross-coupler and the second horn antenna is configured to produce a first circularly polarized signal from the received coupled signal from the third cross-coupler and a second circularly polarized signal from the received coupled signal from the fourth cross-coupler, wherein the first circularly polarized signal of the first horn antenna rotates in the opposite direction of the second circularly polarized signal of the first horn antenna and the first circularly polarized signal of the second horn antenna rotates in the opposite direction of the second circularly polarized signal of the second horn antenna, and wherein the first circularly polarized signal of the first horn antenna rotates in the same direction as the first circularly polarized signal of the second horn antenna and second circularly polarized signal of the first horn antenna rotates in the same direction as the second circularly polarized signal of the second horn antenna.

18. The AAS of claim 17, further including at least four power amplifiers, wherein a first power amplifier, of the at least four power amplifiers, is in signal communication with the first cross-coupler and the first horn antenna and is configured to amplify the coupled signal from the first cross-coupler, wherein a second power amplifier, of the at least four power amplifiers, is in signal communication with the second cross-coupler and the first horn antenna and is configured to amplify the coupled signal from the second cross-coupler, wherein a third power amplifier, of the at least four power amplifiers, is in signal communication with the third cross-coupler and the second horn antenna and is configured to amplify the coupled signal from the third cross-coupler, and wherein a fourth power amplifier, of the at least four power amplifiers, is in signal communication with the fourth cross-coupler and the second horn antenna and is configured to amplify the coupled signal from the fourth cross-coupler.

19. The AAS of claim 17, wherein the straight feed waveguide is a rectangular waveguide having a broad-wall and a narrow-wall.

20. The AAS of claim 19, wherein the feed waveguide wall is the broad-wall.

21. The AAS of claim 20, wherein a first planar coupling slot and a second planar coupling slot, of the first pair of planar coupling slots, are positioned a quarter-wavelength apart, wherein a first planar coupling slot and a second planar coupling slot, of the second pair of planar coupling slots, are positioned a quarter-wavelength apart, wherein a first planar coupling slot and a second planar coupling slot, of the third pair of planar coupling slots, are positioned a quarter-wavelength apart, and wherein a first planar coupling slot and a second planar coupling slot, of the fourth pair of planar coupling slots, are positioned a quarter-wavelength apart.

22. The AAS of claim 17, further including a first septum polarizer in the first horn antenna and a second septum polarizer in the second horn antenna.

* * * * *